US010538095B2

(12) United States Patent
Tanaka et al.

(10) Patent No.: US 10,538,095 B2
(45) Date of Patent: Jan. 21, 2020

(54) DROPLET EJECTING APPARATUS

(71) Applicant: SEIKO EPSON CORPORATION, Tokyo (JP)

(72) Inventors: Yoshiyuki Tanaka, Matsumoto (JP); Koji Kawai, Shiojiri (JP); Tomoyuki Higuchi, Shiojiri (JP); Ichiro Yoshioka, Matsumoto (JP); Yusuke Yamashita, Matsumoto (JP); Masahide Nakagawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/846,881

(22) Filed: Dec. 19, 2017

(65) Prior Publication Data

US 2018/0194142 A1 Jul. 12, 2018

(30) Foreign Application Priority Data

Jan. 12, 2017 (JP) ..... 2017-003131

(51) Int. Cl.
*B41J 2/175* (2006.01)

(52) U.S. Cl.
CPC .. *B41J 2/17566* (2013.01); *B41J 2002/17573* (2013.01)

(58) Field of Classification Search
CPC ..... B41J 2/17566; B41J 2002/17569; B41J 2002/17573
See application file for complete search history.

(56) References Cited

U.S. PATENT DOCUMENTS 1,457,811 A * 6/1923 Baker ..... G01F 23/02 222/438
5,025,764 A * 6/1991 Kobayashi ..... F01M 11/12 123/196 R
5,079,570 A * 1/1992 Mohr ..... G01F 23/02 116/276
5,686,947 A * 11/1997 Murray ..... B41J 2/17513 347/85
5,802,420 A * 9/1998 Garr ..... B41J 2/17566 347/19
6,053,608 A * 4/2000 Ishii ..... B41J 2/17513 347/88
6,375,031 B1 * 4/2002 Kwan ..... G01F 19/00 215/365
6,412,929 B1 * 7/2002 Chen ..... B41J 2/17513 347/86

(Continued)

FOREIGN PATENT DOCUMENTS

EP 3278995 2/2018
JP 2014-054823 3/2014

(Continued)

*Primary Examiner* — Shelby L Fidler
(74) *Attorney, Agent, or Firm* — Workman Nydegger

(57) ABSTRACT

There is provided a printer that functions as a droplet ejecting apparatus including: a tank which is configured of at least a part having light transmission property; a tank cover which functions as a cover portion that covers the tank; and a light transmitting portion which is provided at least at a part of the tank cover, and through which liquid accommodated on the inside of the tank can be visually confirmed, in which at least one of gradations and reference marks is provided in the light transmitting portion.

16 Claims, 42 Drawing Sheets

(56) References Cited

U.S. PATENT DOCUMENTS

| | | | | |
|---|---|---|---|---|
| 8,905,504 | B2 * | 12/2014 | Iizawa | B41J 2/17513 347/7 |
| 2004/0196645 | A1 * | 10/2004 | Allinson | G02B 6/0068 362/613 |
| 2008/0266565 | A1 * | 10/2008 | McConica | B41J 2/17553 356/436 |
| 2010/0122587 | A1 * | 5/2010 | Sun | A61B 10/0051 73/864 |
| 2014/0043408 | A1 | 2/2014 | Kudo et al. | |
| 2015/0124028 | A1 * | 5/2015 | Kimura | B41J 2/17509 347/86 |
| 2015/0306882 | A1 | 10/2015 | Kudo et al. | |
| 2016/0009096 | A1 | 1/2016 | Suzuki et al. | |
| 2016/0016409 | A1 | 1/2016 | Kimura et al. | |
| 2016/0091820 | A1 * | 3/2016 | Osakabe | B41J 2/20 347/1 |
| 2016/0159099 | A1 | 6/2016 | Kudo et al. | |
| 2016/0264306 | A1 * | 9/2016 | Nishimaki | B65D 41/005 |
| 2016/0009100 | A1 | 11/2016 | Kudo et al. | |
| 2017/0008298 | A1 | 1/2017 | Suzuki et al. | |

FOREIGN PATENT DOCUMENTS

| | | |
|---|---|---|
| JP | 2016-022725 | 2/2016 |
| TW | 201434670 | 9/2014 |
| TW | 201641309 | 12/2016 |

* cited by examiner

DROPLET EJECTING APPARATUS

BACKGROUND

1. Technical Field

The present invention relates to a droplet ejecting apparatus that ejects a droplet to a medium.

2. Related Art

As a droplet ejecting apparatus (ink jet printer) which is an example of a liquid consuming apparatus, a configuration in which a droplet (ink is an example thereof) is discharged to a medium from a recording head while a carriage on which the recording head is loaded reciprocates in a main scanning direction, is known. The droplet ejected to the medium from the recording head is supplied as liquid that fills an ink tank (hereinafter, referred to as a tank) which is separately provided on the carriage, toward the recording head. The tank is configured of a member having light transmission properties, and gradations or the like are provided on a surface of the tank. In addition, a configuration in which a user can visually confirm a residual amount of the liquid by the gradations or the like on the surface of the tank exposed to the outside, is employed (for example, refer to JP-A-2014-54823 and JP-A-2016-22725).

However, in the liquid consuming apparatus described in JP-A-2014-54823 and JP-A-2016-22725, since the gradations or the like are provided on the surface of the tank, the gradations are polluted by ink or the like leaked during the filling, and there is a concern that visibility deteriorates when the user visually confirms the residual amount of the ink.

SUMMARY

An advantage of some aspects of the invention is to provide a droplet ejecting apparatus which can ensure visibility without generation of pollution of gradations or the like, even when the ink is leaked out during the filling.

The invention can be realized in the following aspects or application examples.

APPLICATION EXAMPLE 1

According to this application example, there is provided a droplet ejecting apparatus including: a tank which is configured of at least a part having light transmission property; a cover portion which covers the tank; and a light transmitting portion which is provided at least at a part of the cover portion, and through which liquid accommodated on the inside of the tank is visually confirmed, in which at least one of gradations and reference marks is provided in the light transmitting portion.

According to the configuration of the application example, since at least one of the gradations and the reference marks is provided in the light transmitting portion provided at least at a part of the cover portion, even when the outer surface of the tank is polluted by the accommodated liquid or the like, there is not a case where the gradations or the reference marks are polluted. Therefore, visibility when the user visually confirms the liquid amount (residual amount of the liquid) via the light transmitting portion of a member having light transmission properties in the tank and the cover portion does not deteriorate, and it is possible to maintain a state where visibility is excellent.

APPLICATION EXAMPLE 2

In the droplet ejecting apparatus according to the application example, it is preferable that the gradations be provided corresponding to an amount of the liquid, and the reference marks be provided corresponding to the types of the liquid.

According to the configuration of the application example, the user can easily visually confirm the liquid amount (residual amount of the liquid) of each type of the liquid by the gradations which correspond to the amount of the liquid and the reference marks which correspond to the types of the liquid, and it is possible to prevent wrong filling caused by a difference in type or color of the ink.

APPLICATION EXAMPLE 3

In the droplet ejecting apparatus according to the application example, it is preferable that the light transmitting portion be configured of a structure integrated with the cover portion.

According to the configuration of the application example, by the structure in which the cover portion and the light transmitting portion are integrated with each other, it is possible to easily perform the processing, and thus, it is possible to reduce production costs. In addition, it is possible to configure the cover portion without damaging design properties, for example, it is possible to prevent the thickness of a part at which the light transmitting portion is provided from increasing.

APPLICATION EXAMPLE 4

In the droplet ejecting apparatus according to the application example, it is preferable that the light transmitting portion include a through-hole provided at a part of a wall surface of the cover portion, and a light transmitting plate which covers the through-hole.

According to the configuration of the application example, it is possible to configure the light transmitting portion by the through-hole and the light transmitting plate which can be formed by relatively easy processing.

APPLICATION EXAMPLE 5

In the droplet ejecting apparatus according to the application example, it is preferable that a housing which holds the tank further be provided, and the cover portion be supported to be openable and closable by the housing.

According to the configuration of the application example, it is possible to easily expose the tank (filling port) on the inside by opening the cover as necessary, for example, in a case of replenishing the tank with the liquid.

APPLICATION EXAMPLE 6

In the droplet ejecting apparatus according to the application example, it is preferable that the tank have a filling port through which the tank can be filled with the liquid.

According to the configuration of the application example, since it is possible to fill the tank with the liquid from the filling port in a case where the amount of liquid is small, work of exchanging the tank is unnecessary. In addition, it is possible to easily replenish the tank with the liquid when the amount of liquid is reduced or the liquid is run out.

APPLICATION EXAMPLE 7

In the droplet ejecting apparatus according to the application example, it is preferable that at least a part of the light transmitting portion protrude from an outer surface of the cover portion.

According to the configuration of the application example, it is possible to improve visibility of the user in a case of visually confirming the liquid amount (residual amount of the liquid) from sides other than a front surface, for example, by allowing the light transmitting portion to individually protrude in accordance with the types of the ink.

APPLICATION EXAMPLE 8

In the droplet ejecting apparatus according to the application example, it is preferable that an outer edge portion including an outline arranged along an outer edge of the light transmitting portion be provided on an outer circumferential side of the light transmitting portion.

According to the configuration of the application example, it is possible to clearly divide each of the light transmitting portions by the outer edge portion including the outline arranged along the outer edge of the light transmitting portion, and to further improve visibility of the user.

APPLICATION EXAMPLE 9

In the droplet ejecting apparatus according to the application example, it is preferable that the outer edge portion be colored.

According to the configuration of the application example, it is possible to divide each of the light transmitting portions by color division by coloring the outer edge portion and to further improve visibility of the user.

APPLICATION EXAMPLE 10

In the droplet ejecting apparatus according to the application example, it is preferable that the outer edge portion be emboss-processed.

According to the configuration of the application example, since the emboss processing (wrinkle processing) is performed with respect to the outer edge portion, it is possible to more clearly perform the division of the outer edge portion and the light transmitting portion, and to further improve visibility of the user.

APPLICATION EXAMPLE 11

In the droplet ejecting apparatus according to the application example, it is preferable that at least any one of the gradations and the reference marks be provided on a transparent sheet, and the transparent sheet is attached to the light transmitting portion.

According to the configuration of the application example, by replacing the transparent sheet, it is possible to easily change the gradations or the reference marks to other gradations or reference marks.

APPLICATION EXAMPLE 12

In the droplet ejecting apparatus according to the application example, it is preferable that the gradations be configured to include at least one of a point and a line.

According to the configuration of the application example, it is possible to realize gradations having improved visibility by configuring the gradations including at least one of the point and the line.

APPLICATION EXAMPLE 13

In the droplet ejecting apparatus according to the application example, it is preferable that the line include at least one of a solid line and a dotted line.

According to the configuration of the application example, by using various types of lines, it is possible to realize the gradations having improved visibility.

APPLICATION EXAMPLE 14

In the droplet ejecting apparatus according to the application example, it is preferable that the residual amount of the liquid be divided by changing at least one of the shape, color, and shades of the color of the point and the line.

According to the configuration of the application example, the division which is easily seen by performing division of the residual amount of the liquid by the shape, the color, and the shades of the color of the point and the line, and it is possible to improve visibility at a glance of the user.

APPLICATION EXAMPLE 15

In the droplet ejecting apparatus according to the application example, it is preferable that the gradations be disposed in the outer edge portion.

According to the configuration of the application example, it is possible to visually confirm the amount of the liquid that can be visually confirmed through the light transmitting portion comparing the gradations of the outer edge portion, and to easily visually confirm the liquid amount (residual amount of the liquid).

APPLICATION EXAMPLE 16

In the droplet ejecting apparatus according to the application example, it is preferable that the reference marks be disposed in the outer edge portion, and connect the light transmitting portion and at least one of the outline and the gradations to each other.

According to the configuration of the application example, as the reference marks disposed in the outer edge portion is connected to at least one of the light transmitting portion, the outline, and the gradations, the connection between the type of the liquid and the liquid amount (residual amount of the liquid) becomes apparent, and it is possible to further improve visibility of the user.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments will be described using an ink jet printer (hereinafter, referred to as a printer) which is an example of a droplet ejecting apparatus as an example. The printer according to the following embodiments can perform printing with respect to a recording medium, such as a recording paper sheet, by ejecting ink which is one example of liquid. In the printer according to first, second, third, and fourth embodiments, a basic configuration is common, and in a tank cover which is a cover portion that covers the tank, a configuration for visually confirming an ink amount (residual amount of ink) of the ink accommodated in the tank is different. In addition, in the printer according to each of the embodiments, in order to improve visibility of the ink amount (residual amount of ink) of the ink accommodated in the tank, examples in which gradations or reference marks which are arranged in the tank cover are different from each other in various manners, are prepared.

Hereinafter, each of the embodiments will be described with reference to the drawings. In addition, in each of the drawings, since each of the configurations has a size to the extent that can be recognized, there is a case where a scale of the configuration or a member varies. In addition, elements other than configuration elements necessary for the description will be omitted.

1. FIRST EMBODIMENT

Figure 1:
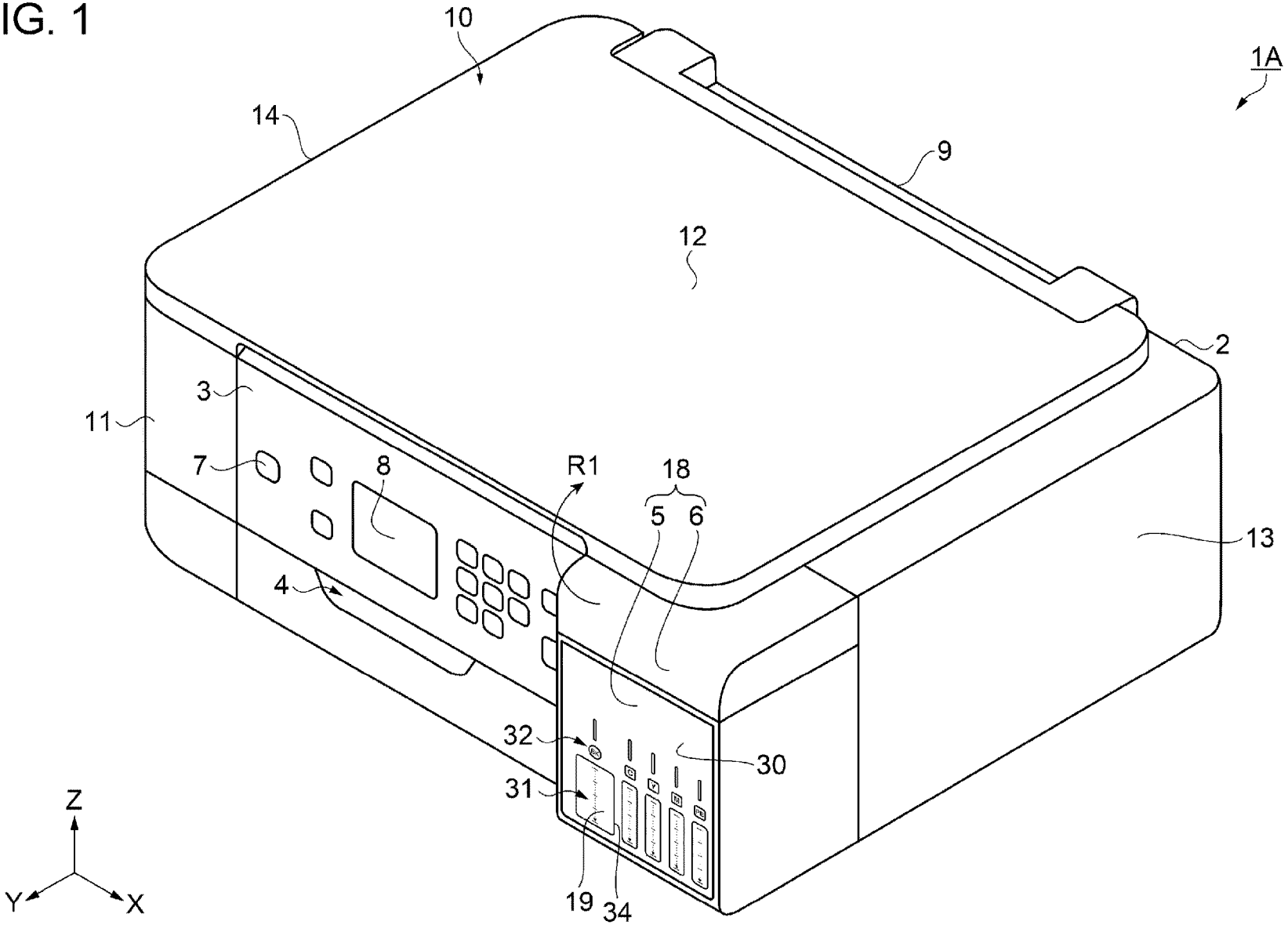
FIG. 1 is a perspective view illustrating an external appearance of a printer according to a first embodiment.
Figure 2:
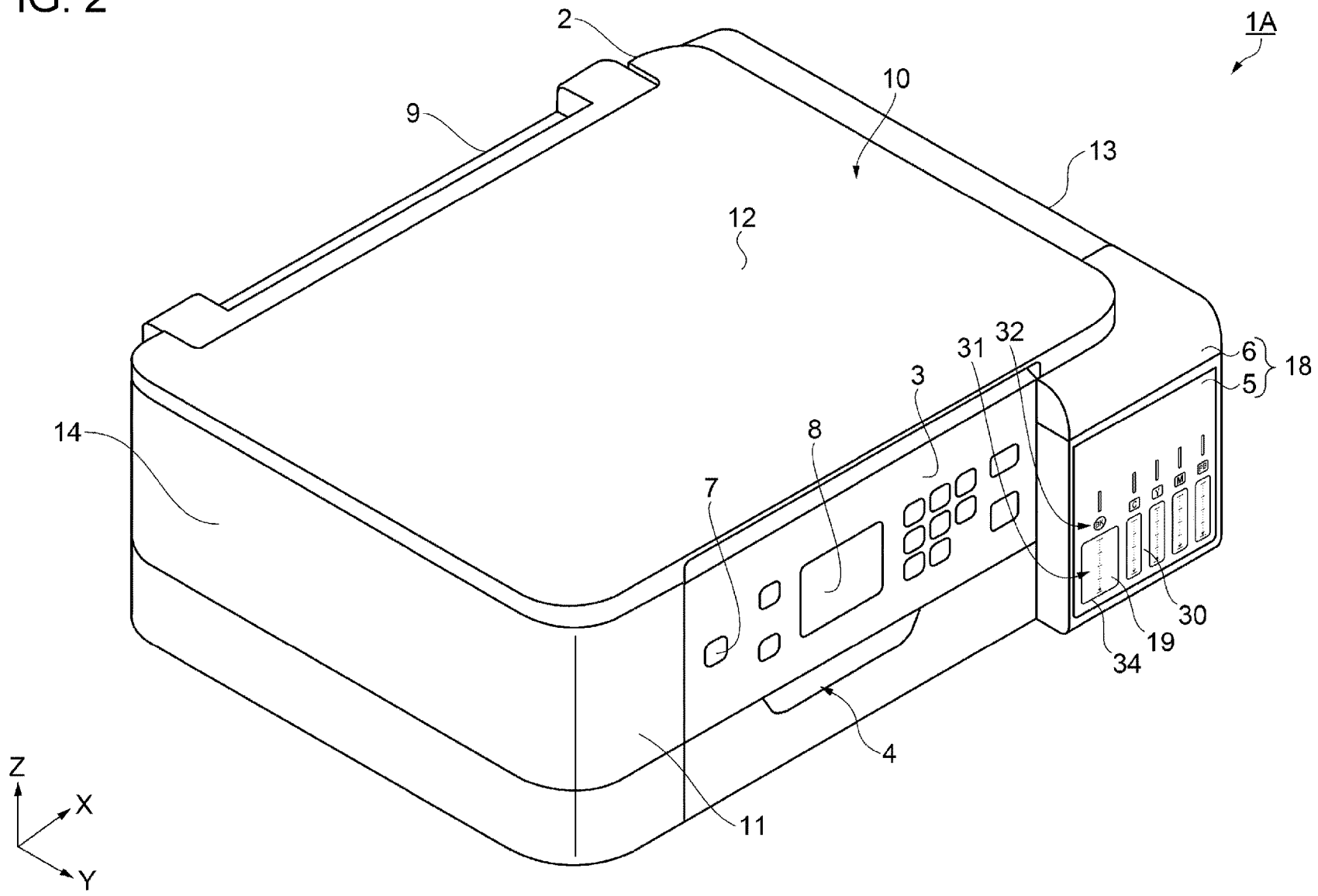
FIG. 2 is a perspective view illustrating the external appearance of the printer according to the first embodiment.
Figure 3:
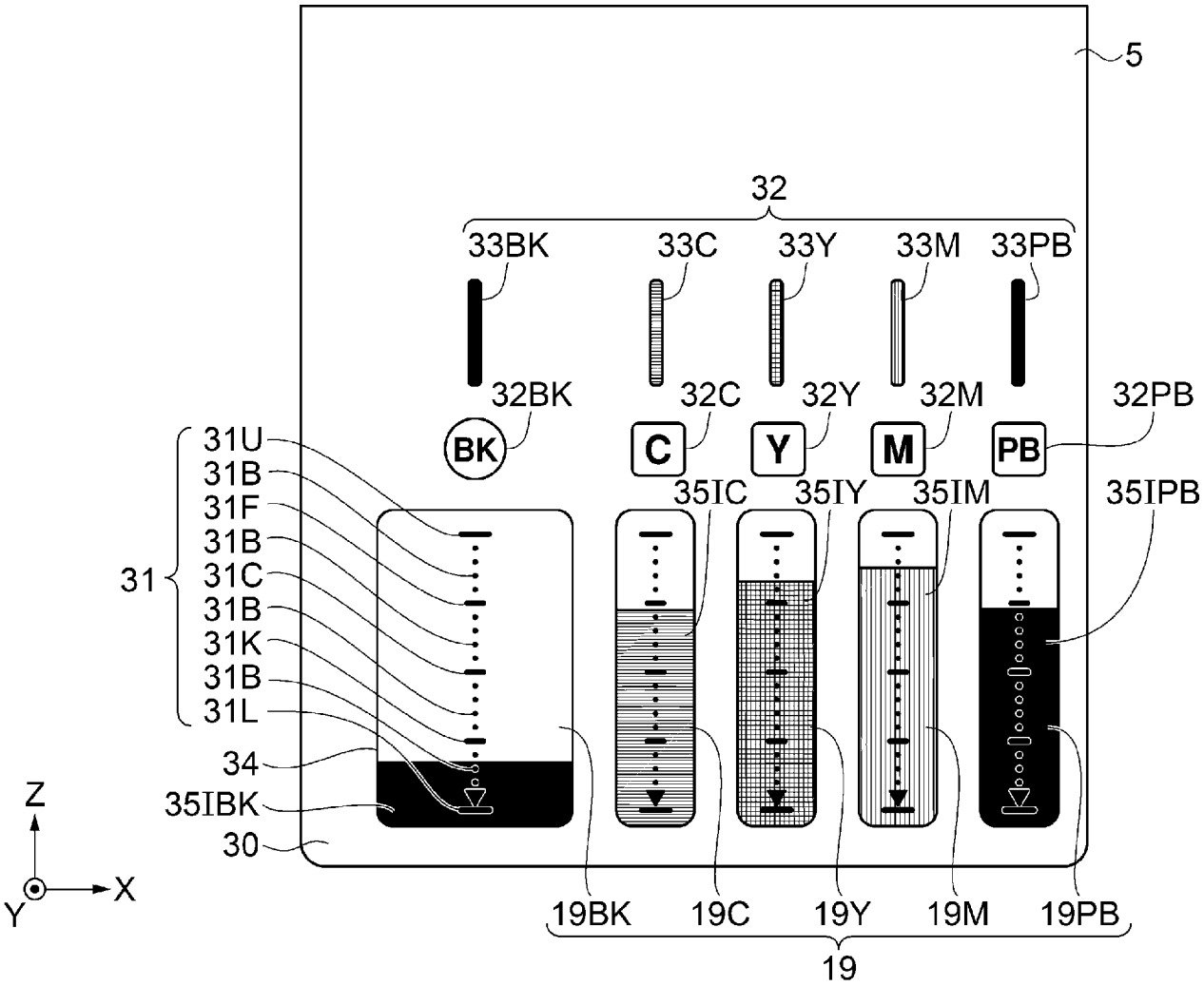
FIG. 3 is a front view illustrating a configuration example of a visible cover of the printer according to the first embodiment.

First, a schematic configuration in the external appearance of a printer 1A according to a first embodiment will be described with reference to FIGS. 1, 2, and 3. FIGS. 1 and 2 are perspective views illustrating the external appearance of the printer according to the first embodiment. Specifically, FIG. 1 is a perspective view when the printer 1A according to the first embodiment is viewed from a +X direction side, and FIG. 2 is a perspective view when the printer 1A is viewed from a −X direction side. FIG. 3 is a front view illustrating a configuration example of a visible cover of the printer according to the first embodiment. In FIGS. 1, 2, and 3, XYZ-axes which are coordinate axes orthogonal to each other are attached. In the embodiment, a state where the printer 1A is disposed on a horizontal plane (XY plane) regulated by the X-axis and the Y-axis, is a state where the printer 1A is being used. A posture of the printer 1A when the printer 1A is disposed on the XY plane is called a use posture of the printer 1A. In addition, the XYZ-axes are attached in the views illustrating the following embodiments as necessary.

The Z-axis is an axis orthogonal to the horizontal plane. In the use state of the printer 1A, a direction along the Z-axis is a perpendicular direction. In addition, in the use state of the printer 1A, in FIGS. 1 and 2, the −Z direction is a perpendicularly lower direction. In addition, in each of the XYZ-axes, a direction of an arrow illustrates a + (positive) direction, and a direction opposite to the direction of the arrow illustrates a − (negative) direction. FIG. 1 is a perspective direction when the printer 1A is viewed from the +X direction side. FIG. 2 is a perspective view when the printer 1A is viewed from the −X direction side.

As illustrated in FIGS. 1 and 2, the printer 1A according to the first embodiment includes a housing 2, an operation panel 3, a paper discharge portion 4, a visible cover 5, a lid portion 6, a cover 9, and a cover 10. In addition, a tank cover 18 which functions as a cover portion that covers a tank unit 20 (refer to FIG. 4) with the visible cover 5 and the lid portion 6, is configured. In addition, the printer 1A includes a scanner unit (not illustrated). In other words, the printer 1A is a multifunction machine including the scanner unit. In addition, the printer 1A may not be a multifunction machine, and may be a printer which does not include the scanner unit.

The housing 2 configures an outer shell of the printer 1A. The operation panel 3 is disposed on an outer side of the housing 2. The operation panel 3 is disposed on a surface (front surface 11) on which the paper discharge portion 4 is disposed in the printer 1A. The operation panel 3 includes a power button 7, a display panel 8 or the like. In addition, as the display panel 8, it is possible to employ a panel which can receive an input by a user, such as a touch panel. In addition, a structure in which an inclination of the operation panel 3 can be adjusted (also referred to as tilt adjustment) may be employed. When it is possible to adjust the inclination of the operation panel 3, the user can see or operate the operation panel 3 by a desirable inclination, and thus, convenience is improved.

The paper discharge portion 4 is provided on a surface on the same side as the operation panel 3 in the housing 2. In the printer 1A, a recording medium P (refer to FIG. 4) is discharged from the paper discharge portion 4. In the printer 1A, a surface on which the paper discharge portion 4 is provided is the front surface 11. The front surface 11 of the printer 1A is also the front surface 11 of the housing 2. In the example, positions in the Y-axis direction on an outer surface of the operation panel 3 and an outer surface of the paper discharge portion 4 are substantially the same as the position in the Y-axis direction on an outer surface of the front surface 11 of the housing 2.

The housing 2 includes an upper surface 12 intersecting with the front surface 11, and a side wall 13 and a side wall 14 which intersect with the front surface 11 and the upper surface 12. When the front surface 11 is viewed in a front view, that is, when the front surface 11 is viewed from a +Y direction side in a plan view, the side wall 13 is positioned on the +X direction side of the front surface 11, and the side wall 14 is positioned on the −X direction side of the front surface 11. In the housing 2, a part on the +X direction side of the operation panel 3 and the paper discharge portion 4 (a corner side between the front surface 11 and the side wall 13) protrudes further to the +Y direction side than a part at which the operation panel 3 and the paper discharge portion 4 are provided.

The visible cover 5 is provided on the front surface 11 side of the housing 2. In the housing 2, the visible cover 5 is disposed at a part which protrudes further to the +Y direction side than the part at which the operation panel 3 and the paper discharge portion 4 are provided. Therefore, the visible cover 5 is disposed further on the side wall 13 side (+X direction side) than the operation panel 3 and the paper discharge portion 4 in the X-axis direction, and further on a near side (+Y direction side) than the operation panel 3 and the paper discharge portion 4 in the Y-axis direction.

The visible cover 5 has a surface along the front surface 11 (XZ plane). Although not being illustrated in detail, an opening portion is provided at a part at which the visible cover 5 of the housing 2 is disposed, and the visible cover 5 is provided to block the opening portion. The visible cover 5 is connected to the lid portion 6 which will be described later, and configures the tank cover 18. In addition, when the front surface 11 of the printer 1A is viewed from the +Y direction side in a plan view, the visible cover 5 is provided at a position which overlaps a disposition side of a member having light transmission properties of the tank unit 20 (five tanks 21) which will be described later with reference to FIG. 4.

The visible cover 5 includes light transmitting portions 19 through which the inner side (−Y side) of the visible cover 5, that is, the tank unit 20 (refer to FIG. 4) can be visually confirmed, an outer edge portion 30 which is disposed on the outer circumferential side of the light transmitting portion 19, gradations 31 which are provided in the light transmitting portion 19, and reference marks 32 which are provided in the outer edge portion 30. Here, with reference to FIG. 3, a configuration of the visible cover 5 will be described in detail hereinafter.

As illustrated in FIG. 3, the visible cover 5 is formed of a resin material having light transmission properties to the extent that the inner side (−Y side) of the visible cover 5 can be visually confirmed. By forming the visible cover 5 by the resin material, compared to a case of forming the visible cover 5 by glass or the like, it is possible to easily perform processing, and thus, it is possible to reduce the production costs.

Five light transmitting portions 19 (light transmitting window portions 19BK, 19C, 19Y, 19M, and 19PB) having a substantially rectangular shape which is vertically long in the Z direction and of which four corners are rounded in an arc shape, are provided in accordance with each of five tanks 21 of the tank unit 20 which will be described later with reference to FIG. 4. In addition, the outer edge portion 30 which is disposed on the outer side of the XZ plane of the light transmitting window portions 19BK, 19C, 19Y, 19M, and 19PB which function as the light transmitting portion 19, is formed by coating the surface of the resin material with a coloring coating material, by attaching a coloring film, or by performing emboss (wrinkle) processing. In addition, examples of a pattern formed by the emboss processing include leather (scales), crepe, wood grain, rock grain, sand grain, fabric pattern, or geometric pattern. In addition, in the emboss processing, a hairline finish which is called folding or a silk line, or a mat finish can be included. In this manner, by providing the outer edge portion 30, it is possible to clearly divide the light transmitting window portions 19BK, 19C, 19Y, 19M, and 19PB which function as the light transmitting portion 19, and the outer edge portion 30, and to further improve visibility of the user. In addition, at an outer edge of the light transmitting window portions 19BK, 19C, 19Y, 19M, and 19PB which function as the light transmitting portion 19, an outline 34 arranged along the outer edge of each of the light transmitting window portions 19BK, 19C, 19Y, 19M, and 19PB may be provided. In addition, the outline 34 may be any color tone, such as individual colors which correspond to each of the ink colors, unified black color, or an outlined line. In addition, the outline 34 can be included in the outer edge portion 30.

The user can visually confirm the tank unit 20 (five tanks 21) in the light transmitting portion 19 when the front surface 11 of the printer 1A is viewed from the +Y direction side in a plan view, and additionally, the user can visually confirm the ink (residual amount of ink) accommodated in the tank unit 20 (five tanks 21) through the member having light transmission properties of the tank unit 20 (five tanks 21). In addition, in the embodiment, an example in which black ink is accommodated in the tank 21 positioned on the most −X side, and cyan ink, yellow ink, magenta ink, and pigment-based black ink are accommodated in each of the tanks 21 in an order of orienting toward the +X side following the most −X side, is illustrated.

In each of the light transmitting window portions 19BK, 19C, 19Y, 19M, and 19PB which configure the light transmitting portion 19, as the gradation 31, for example, an upper limit gradation 31U illustrated by a horizontal line or a lower limit gradation 31L configured of a horizontal line and a black triangular symbol, an upper gradation 31F, an intermediate gradation 31C, or a lower gradation 31K which are illustrated by horizontal lines that are slightly shorter than the horizontal line of the upper limit gradation 31U, a subdivided gradation 31B provided with a plurality of points between each of the horizontal lines, and the like, are arranged. In addition, the upper limit gradation 31U, the lower limit gradation 31L, the upper gradation 31F, the intermediate gradation 31C, the lower gradation 31K, and the subdivided gradation 31B which configure the gradation 31 may be any color tone, such as individual colors which correspond to each of the ink colors, unified black color, or an outlined character.

In addition, by contrasting the gradations 31 which are provided in each of the light transmitting window portions 19BK, 19C, 19Y, 19M, and 19PB which configure the light transmitting portion 19, and the reference marks 32 (will be described later in detail) which are provided in the outer edge portion 30 and illustrate, for example, ink type, with each other, the user can visually confirm and grasp the amount (residual amount of ink) of ink 35IBK, 35IC, 35IY, 35IM, and 35IPB accommodated in the tank unit 20 (five tanks 21) via the visible cover 5 when the front surface 11 of the printer 1A is viewed from the +Y direction side, and it is possible to prevent wrong filling caused by a difference in type or color of the ink.

In addition, by configuring the gradation 31 to include at least one of a point and a line, or by using various types of lines including at least one of a solid line or a dotted line, it is possible to realize the gradations having more improved visibility. In addition, the division which is easily seen is achieved by performing division of the residual amount of the ink by the shape, the color, and the shades of the color of the point and the line, and it is possible to improve visibility at a glance of the user.

The reference marks 32 of the embodiment illustrate the types of the ink accommodated in each of five tanks 21, and include, for example, a mark 32BK of "BK in outlined ○" that indicates the black ink, a mark 32C of "C in a square and round outlined □" that indicates the cyan ink, a mark 32Y of "Y in a square and round outlined □" that indicates the yellow ink, a mark 32M of "M in a square and round outlined □" that indicates the magenta ink, and a mark 32PB of "PB in a square and round outlined □" that indicates the pigment-based black ink. In addition, the marks 32BK, 32C, 32Y, 32M, and 32PB may be any color tone, such as individual colors which correspond to each of the ink colors, unified black color, or an outlined character.

In addition, above (+Z direction side) each of the marks 32BK, 32C, 32Y, 32M, and 32PB, marks 33BK, 33C, 33Y, 33M, and 33PB of vertical lines of colors which correspond to the marks 32BK, 32C, 32Y, 32M, and 32PB and correspond to each of the ink colors (types of ink) for easily identify the color of the ink, are disposed. Specifically, the mark 33BK having the black-based color is disposed corresponding to the mark 32BK that indicates the black ink, the mark 33C having the blue-based color is disposed corresponding to the mark 32C that indicates the cyan ink, the mark 33M having the red-based color is disposed corresponding to the mark 32M that indicates the magenta ink, and the mark 33Y having the yellow-based color is disposed corresponding to the mark 32Y that indicates the yellow ink. Furthermore, the mark 33PB having the black-based color is disposed corresponding to the mark 32PB that indicates the pigment-based black ink.

In addition, regarding the gradation 31 and the reference marks 32, as described in the embodiment, a configuration in which both of the gradation 31 and the reference marks 32 are provided may be employed, or a configuration in which at least one of the gradations 31 and the reference marks 32 is provided may be employed. In this manner, as the gradations 31 and the reference marks 32 are provided, in any case, it is possible to visually confirm and grasp the amount (residual amount of ink) of the ink 35IBK, 35IC, 35IY, 35IM, and 35IPB accommodated in the tank unit 20 (five tanks 21).

In addition, various different disposition examples of the light transmitting portion 19, the outer edge portion 30 disposed on the outer circumferential side of the light transmitting portion 19, the gradations 31 provided in the light transmitting portion 19, and the reference marks 32 provided in the outer edge portion 30, will be described in each of the examples that will be described later.

The lid portion 6 is provided on the front surface 11 side of the housing 2. The lid portion 6 is disposed above (+Z direction side) the visible cover 5 at the part which protrudes further to the +Y direction side than the part at which the operation panel 3 and the paper discharge portion 4 are provided in the housing 2. The lid portion 6 can have a structure integrated with the visible cover 5 including the light transmitting portion 19. In this manner, by employing a structure in which the visible cover 5 including the light transmitting portion 19 and the lid portion 6 are integrated with each other, it is possible to easily perform the processing, and thus, it is possible to reduce the production costs. In addition, it is possible to configure the tank cover 18 without damaging design properties, for example, it is possible to prevent the thickness of the part at which the light transmitting portion 19 is provided from increasing. In addition, the lid portion 6 and the light transmitting portion 19 can be separately provided.

The lid portion 6 is supported to be openable and closable with respect to the housing 2. More specifically, the lid portion 6 is configured to be rotatable in an R1 direction illustrated by an arrow in FIG. 1. The R1 direction corresponds to a clockwise direction when the YZ plane is viewed from the +X direction side in a plan view regarding an axis along the X-axis as a rotation axis. By rotating the lid portion 6 with respect to the housing 2 in the R1 direction, the lid portion 6 can be open with respect to the housing 2. In other words, it is possible to open the tank cover 18 configured of the lid portion 6 and the visible cover 5 with respect to the housing 2. By rotating the lid portion 6 in a direction opposite to the R1 direction from a state where the lid portion 6 is open, it is possible to close the lid portion 6 with respect to the housing 2. In other words, by rotating the tank cover 18 in the direction opposite to the R1 direction, it is possible to close the tank cover 18 with respect to the housing 2.

The cover 9 and the cover 10 respectively configure a part of the housing 2. The cover 9 and the cover 10 are provided on the upper surface 12 of the housing 2. The cover 9 is provided at one end on the −Y direction side on the upper surface 12. The cover 10 is positioned on the +Y direction side of the cover 9.

The cover 9 is configured to be rotatable in the R1 direction similar to the lid portion 6. By rotating the cover 9 in the R1 direction with respect to the housing 2, it is possible to open the cover 9 with respect to the housing 2.

By rotating the cover 9 in the direction opposite to the R1 direction from the state where the cover 9 is open, it is possible to close the cover 9 with respect to the housing 2. In this manner, the cover 9 is configured to be openable and closable with respect to the housing 2.

When the cover 9 is open with respect to the housing 2, the paper supply portion (not illustrated) is exposed. It is possible to supply the recording medium P to the printer 1A from the paper supply portion. When supplying the recording medium P to the printer 1A from the paper supply portion, it is possible to support the recording medium P by the cover 9. In other words, the cover 9 has a paper support function.

The cover 10 covers the scanner unit (not illustrated). The cover 10 is configured to be rotatable in the R1 direction similar to the lid portion 6. By rotating the cover 10 in the R1 direction with respect to the housing 2, it is possible to open the cover 10 with respect to the housing 2. By rotating the cover 10 in the direction opposite to the R1 direction from the state where the cover 10 is open, it is possible to close the cover 10 with respect to the housing 2. In this manner, the cover 10 is configured to be openable and closable with respect to the housing 2.

When opening the cover 10 with respect to the housing 2, the scanner unit is exposed. The scanner unit is a flat bed type, and includes an imaging element (not illustrated), such as an image sensor. The scanner unit can read an image or the like recorded in the medium, such as a paper sheet, as image data via the imaging element. Therefore, the scanner unit functions as a reading device of the image or the like.

In the X-axis direction, the length of the housing 2 and the length of the cover 10 are substantially the same as each other. In the Y-axis direction, the length at the position at which the operation panel 3 of the housing 2 is provided is substantially the same as the length of the cover 10, but the length at the position at which the visible cover 5 and the lid portion 6 of the housing 2 are provided is longer than the length of the cover 10.

Therefore, when the upper surface 12 of the printer 1A is viewed from the +X direction side in a plan view, the cover 10 overlaps a part other than the part which protrudes to the +Y direction side in the housing 2. In other words, when the upper surface 12 of the printer 1A is viewed from the +X direction side in a plan view, the visible cover 5 and the lid portion 6 which are provided at the part which protrudes to the +Y direction side in the housing 2 are disposed not to overlap the cover 10. Accordingly, when rotating the lid portion 6 in the R1 direction with respect to the housing 2, it is possible to rotate the lid portion 6 without interfering with the cover 10.

Next, a main configuration of the inside of the housing 2 of the printer 1A according to the first embodiment will be described with reference to FIG. 4. FIG. 4 is a perspective view illustrating a main configuration of the printer according to the first embodiment. As illustrated in FIG. 4, the printer 1A includes a recording head 15 which functions as a recording portion, a control portion 16, and a tank unit 20. The recording head 15, the control portion 16, and the tank unit 20 are accommodated in the housing 2.

The recording head 15 discharges (ejects) the ink as an ink droplet, and performs the recording with respect to the recording medium P. The recording head 15 performs the recording using the ink with respect to the recording medium P transported in the +Y direction by a transport apparatus (not illustrated). In addition, the transport apparatus intermittently transports the recording medium P, such as the recording paper sheet, in the +Y direction. The recording head 15 is configured to be capable of reciprocating along the X-axis by a moving apparatus (not illustrated). The control portion 16 controls the driving of each of the above-described configurations.

The tank unit 20 is held to be disposed on the inner side of the part (refer to FIGS. 1 and 2) which protrudes to the +Y direction side than the operation panel 3 and the paper discharge portion 4 in the housing 2. Therefore, the tank unit 20 is positioned between the operation panel 3 and the paper discharge portion 4, and the side wall 13 in the X-axis direction. From another point of view, when the printer 1A is viewed from the front surface, that is, when the printer 1A is viewed from the +Y direction side, the tank unit 20 is disposed on the inner side (−Y direction side) of the tank cover 18 (refer to FIGS. 1 and 2) configured of the visible cover 5 and the lid portion 6.

In the embodiment, the tank unit 20 includes five tanks 21. In addition, the number of tanks 21 in the tank unit 20 is not limited to five, and may be the number which is lower than four, or may be the number which exceeds five. In the embodiment, five tanks 21 are disposed to be aligned along the X-axis. In the embodiment, the ink having different colors is accommodated in each of the tanks 21. In the specific example illustrated in the embodiment, the black ink is accommodated in the tank 21 positioned on the most −X side, the cyan ink is accommodated in the tank 21 positioned on the +X side of the tank 21 in which the black ink is accommodated. A configuration in which the yellow ink, the magenta ink, and the pigment-based black ink are accommodated in each of the tanks 21 in an order of orienting toward the +X side following the most −X side, is illustrated as an example.

In addition, in the embodiment, a plurality of tanks 21 are configured to be separated from each other. However, the configuration of the tank 21 is not limited thereto. A configuration in which the plurality of tanks 21 are integrated with each other and the tank unit 20 is regarded as one liquid accommodation body, may be employed. In a case of the configuration, the tank unit 20 is configured to be partitioned into the tanks 21 separated from each other and to be capable of accommodating different types of liquid. In this case, for example, it is possible to separately accommodate different colors of ink, for example, in the plurality of tanks 21.

In the tank 21, as the filling port of the ink, a liquid filling port 22 through which the inside can be filled with the ink is formed. In the tank 21, the inside of the tank 21 can be filled with the ink from the outside of the tank 21 via the liquid filling port 22. In addition, a configuration in which the liquid filling port 22 is sealed by a cap (not illustrated) may be employed. In a case of the configuration, the user can fill the inside with the ink after opening the liquid filling port 22 by opening the cap when filling the tank 21 with the ink.

In the embodiment, the liquid filling port 22 is configured as an opening formed on a filling surface 23 positioned on the +Z direction side of the tank 21. In addition, in the embodiment, in the use posture of the printer 1A, the filling surface 23 is inclined. The filling surface 23 is inclined in an orientation toward the +Z direction side as approaching the −Y direction side from the +Y direction side. Therefore, the filling surface 23 is oriented in the direction intersecting with the perpendicular direction.

When the filling surface 23 is oriented in the direction intersecting with the perpendicular direction, foreign substances, such as dust, are unlikely to accumulate on the filling surface 23. Therefore, the foreign substances, such as dust, are unlikely to adhere to the filling surface 23. Accordingly, intrusion of the foreign substances, such as dust, into the liquid filling port 22 is likely to be avoided. In addition, the configuration of the tank 21 is not limited to the description above. As a configuration of the tank 21, for example, a configuration in which a tube-like liquid filling portion which protrudes from an outer surface of the tank 21 is provided, may be employed.

The tank 21 is configured of a member of which at least a part has light transmission properties. A visual confirmation surface 24 positioned in the +Y direction of the tank 21 has light transmission properties, and the amount (residual amount of ink) of the ink accommodated in the tank 21 can be visually confirmed from the visual confirmation surface 24. In addition, on the visual confirmation surface 24 of the tank 21, the gradations or marks may be provided.

The tank 21 has a side surface 27 and a side surface 28 which intersect with the filling surface 23 and the visual confirmation surface 24. When the visual confirmation surface 24 of the tank 21 is viewed from the +Y direction side, the side surface 27 is positioned on the side wall 13 side (+X direction side) of the housing 2, and the side surface 28 is positioned on the side wall 14 side (−X direction side) of the housing 2.

Ink supply tubes 17 are connected to each of the tanks 21. The ink in the tank 21 is supplied to the recording head 15 via the ink supply tubes 17. In addition, the ink supplied to the recording head 15 is discharged as the ink droplet from a nozzle (not illustrated) oriented toward the recording medium P side.

The ink is not limited to any one of aqueous ink and oil-based ink. In addition, as the aqueous ink, any of ink having a configuration in which a solute, such as dye, is dissolved in an aqueous solvent and a configuration in which a dispersoid, such as pigment, is dispersed in an aqueous dispersion medium, may be employed. In addition, as the oil-based ink, any of ink having a configuration in which a solute, such as dye, is dissolved in an oil-based medium and a configuration in which a dispersoid, such as pigment, is dissolved in an oil-based dispersion medium, may be employed.

The tank unit 20 (five tanks 21) is disposed at a position at which at least a part thereof and the visible cover 5 that configures the tank cover 18 which is a cover portion that covers the tank unit 20 including the tank 21 illustrated in FIGS. 1 and 2 overlap each other when the front surface 11 of the printer 1A is viewed from the +Y direction side in a plan view. Therefore, even when the surface of the tank 21 is not exposed to the outside, the user can visually confirm the tank 21 through the light transmitting window portions 19BK, 19C, 19Y, 19M, and 19PB (light transmitting portion 19) of the visible cover 5 from the outside of the printer 1A. In addition, the user can grasp the amount (residual amount of ink) of the ink accommodated in the tank 21 regarding the gradations 31 or the reference marks 32 which are provided in the visible cover 5 as a sign, from the outside of the printer 1A.

In a case of replenishing the tank 21 with the ink, by rotating the tank cover 18 illustrated in FIGS. 1 and 2 in the R1 direction with respect to the housing 2, the tank cover 18 is open with respect to the housing 2. Accordingly, a part (filling surface 23) of each of the tanks 21 is exposed from the part at which the tank cover 18 is open. The user can fill the inside of the tank 21 with the ink from the outside of the printer 1A via the liquid filling port 22 in a state where the tank cover 18 is open with respect to the housing 2. After replenishing the tank 21 with the ink, when the tank cover 18 is closed, the liquid filling port 22 is covered with the tank cover 18.

In a case where the tank 21 is filled with the ink from the liquid filling port 22 in this manner, as the ink which fills the inside spills from the liquid filling port 22, or the ink adheres to the outer surface, such as the visual confirmation surface 24 in the tank 21, there is a case where the outer surface of the tank 21 is polluted.

However, in the configuration of the printer 1A according to the first embodiment, even when the outer surface of the tank 21 is polluted by the accommodated ink or the like, there is not a case where the gradations 31 or the reference marks 32 which are provided in the visible cover 5 which configures the tank cover 18 and in the light transmitting portion 19 (light transmitting window portions 19BK, 19C, 19Y, 19M, and 19PB) provided in the visible cover 5, are polluted. Therefore, visibility when the user visually confirms the amount (residual amount of ink) of the ink via the member having light transmission properties in the tank 21 and the light transmitting portion (not illustrated) of the tank cover 18 does not deteriorate, and it is possible to maintain a state where visibility is excellent. Accordingly, the user can prevent wrong filling caused by a difference in type or color of the ink.

In addition, by using the tank cover 18, it is possible to prevent intrusion of dust into the tank 21 from the outside of the printer 1A (housing 2) or a damage of the tank unit 20 due to the contact or the like from the outside. Therefore, compared to a case where the surface of the tank 21 is exposed to the outside, it is possible to suppress negative influence on visibility due to the dust or the damage from the outside. In addition, since the tank 21 is disposed on the inside of the protruding part of the housing 2, a capacity of the tank 21 can be increased by suppressing the width (length in the X-axis direction) of the housing 2.

2. SECOND EMBODIMENT

Figure 5:
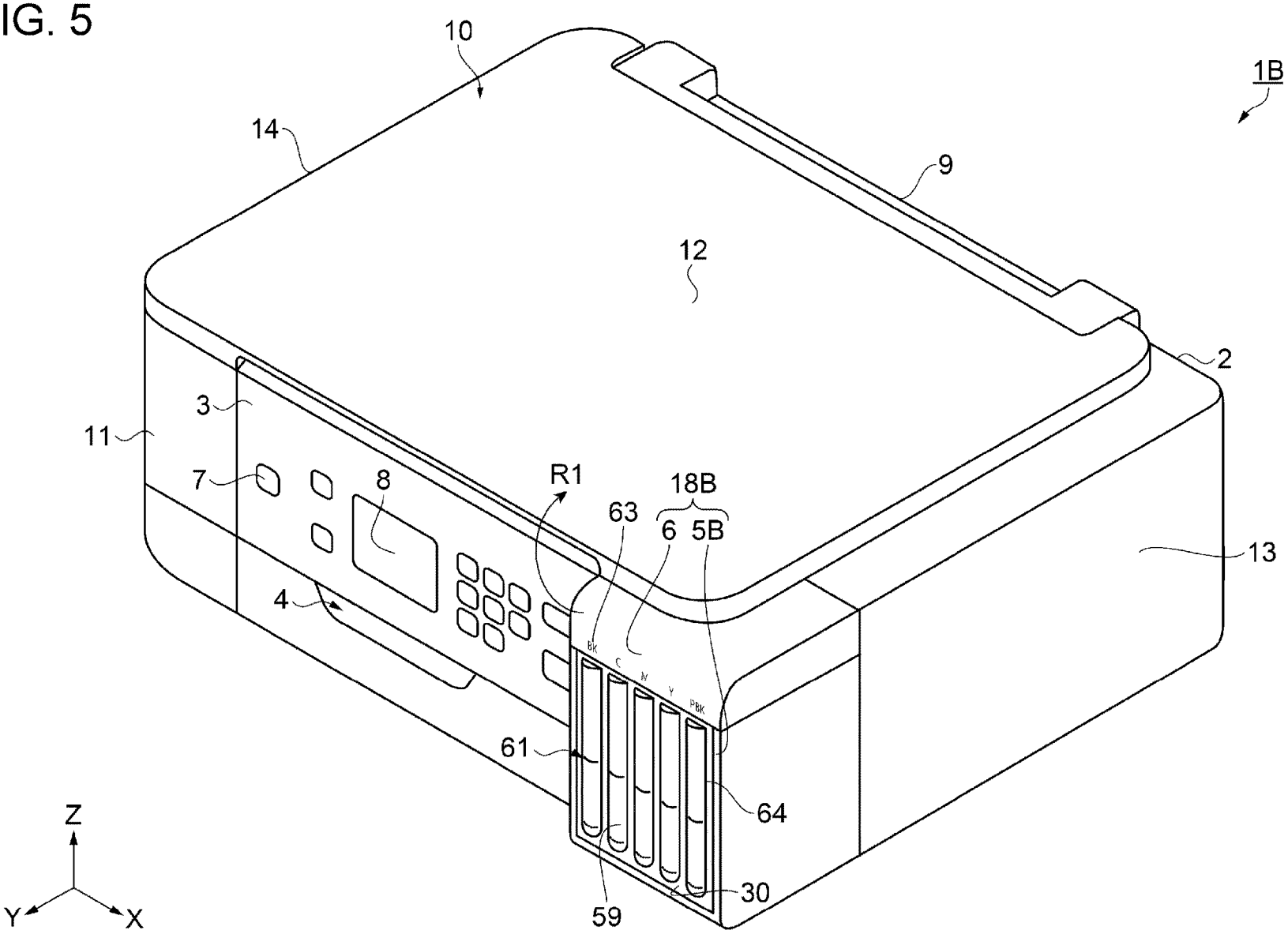
FIG. 5 is a perspective view illustrating an external appearance of a printer according to a second embodiment.
Figure 6:
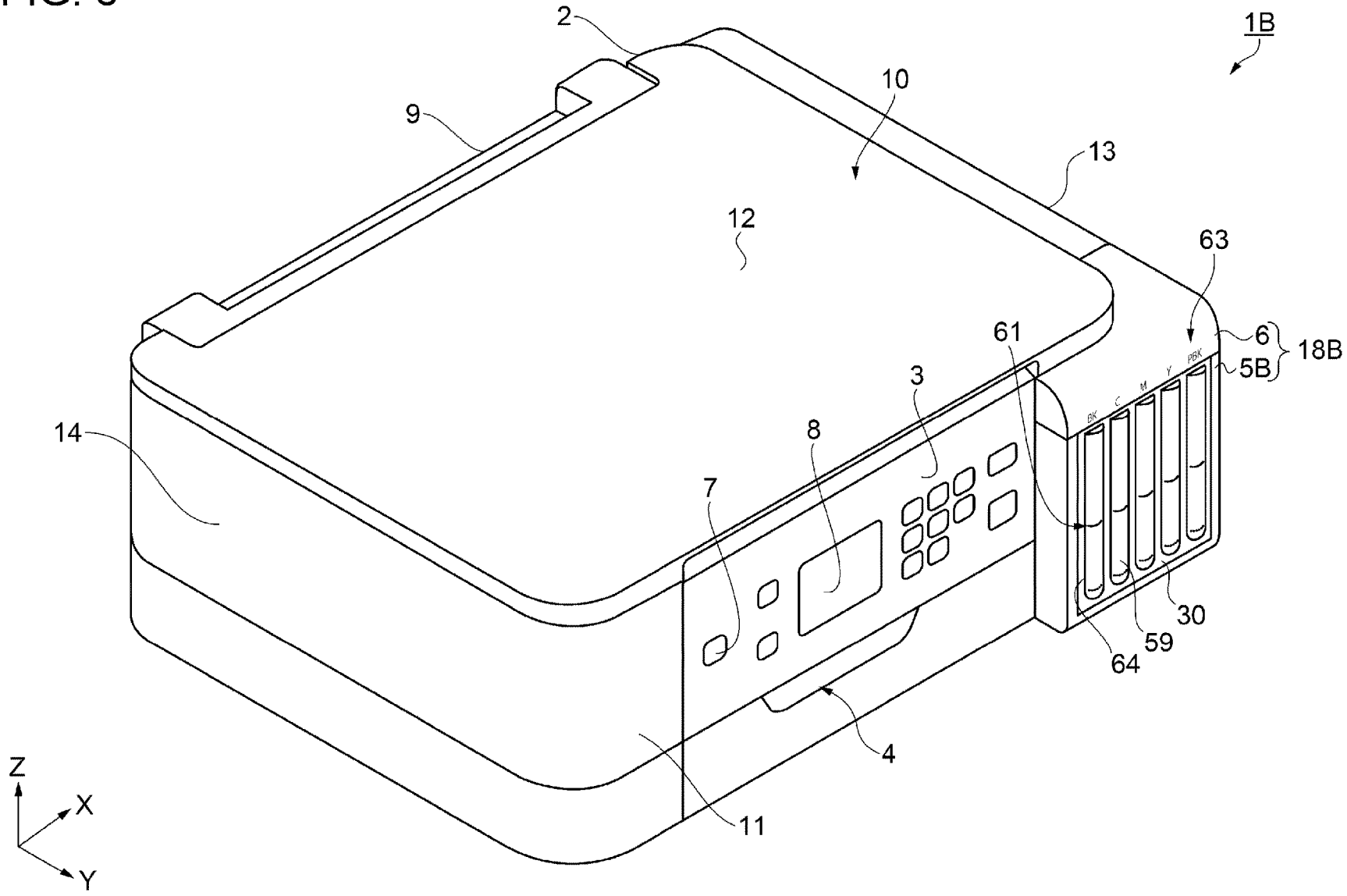
FIG. 6 is a perspective view illustrating the external appearance of the printer according to the second embodiment.
Figure 7:
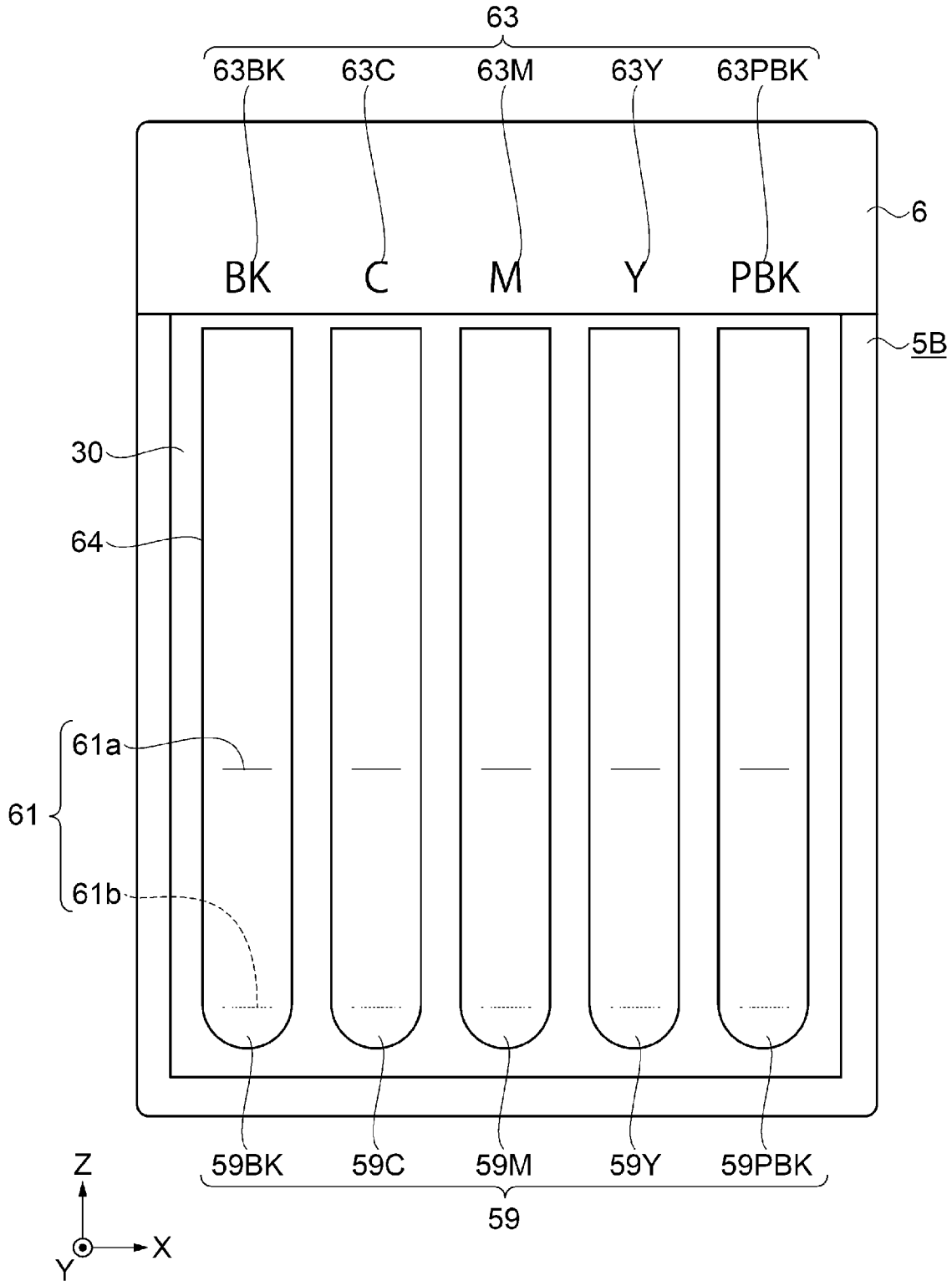
FIG. 7 is a front view illustrating a configuration example of a visible cover of the printer according to the second embodiment.

Next, a schematic configuration in the external appearance of a printer 1B according to a second embodiment will be described with reference to FIGS. 5, 6, and 7. FIGS. 5 and 6 are perspective views illustrating the external appearance of the printer according to the second embodiment. Specifically, FIG. 5 is a perspective view when the printer 1B according to the second embodiment is viewed from the +X direction side, and FIG. 6 is a perspective view when the printer 1B is viewed from the −X direction side. FIG. 7 is a front view illustrating a configuration example of a visible cover of the printer according to the second embodiment.

As illustrated in FIGS. 5 and 6, the printer 1B according to the second embodiment includes the housing 2, the operation panel 3, the paper discharge portion 4, a visible cover 5B, the lid portion 6, the cover 9, and the cover 10. The printer 1B according to the second embodiment is different from the printer 1A according to the first embodiment in a configuration of a tank cover 18B which functions as a cover portion that covers the tank unit 20 (refer to FIG. 4). The tank cover 18B is configured of the visible cover 5B and the lid portion 6. In addition, in the following description, the configuration similar to that of the printer 1A according to first embodiment will be given the same reference numbers, and the description thereof will be omitted.

Figure 4:
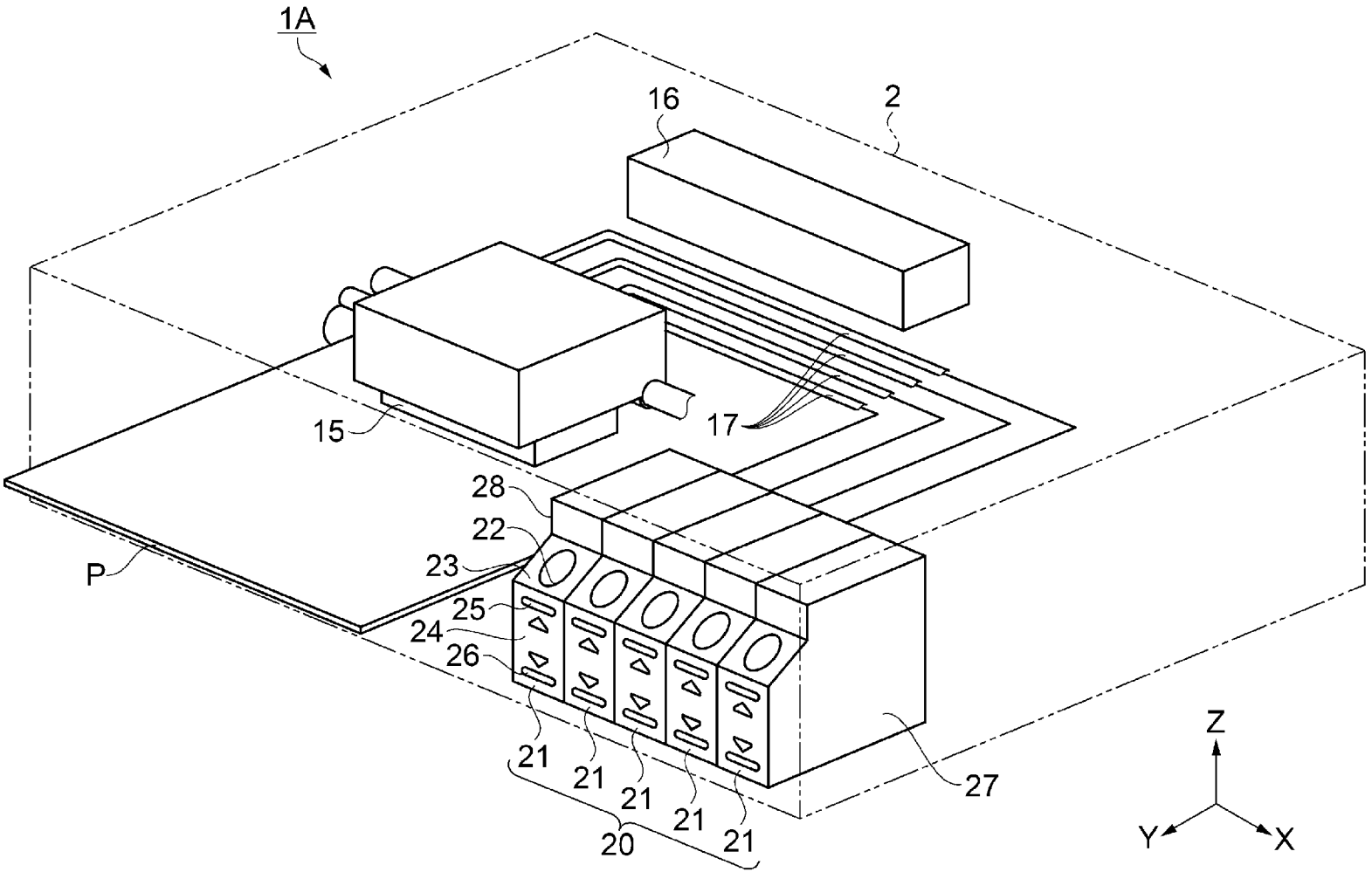
FIG. 4 is a perspective view illustrating a main configuration of the printer according to the first embodiment.

The printer 1B according to the second embodiment is different from the printer 1A according to the first embodiment in the configuration of the tank cover 18B which functions as a cover portion that covers the tank unit 20 (refer to FIG. 4). More specifically, the configuration of light transmitting portions 59 provided in the visible cover 5B that configures the tank cover 18B, and gradations 61 or reference marks 63, are different. Hereinafter, the description will focus on the different points, configuration elements similar to those of the printer 1A according to the first embodiment, such as the disposition or basic configurations of the visible cover 5B in the printer 1B according to the second embodiment, will be given the same reference numbers, and the description thereof will be omitted. In addition, the description of each of the following embodiments will focus on the points different from the above-described embodiment, the same configuration elements will be given the same reference numbers, and the description thereof will be omitted.

The visible cover 5B includes the light transmitting portion 59 (light transmitting window portions 59BK, 59C, 59M, 59Y, and 59PBK) through which the inner side (−Y side) of the visible cover 5B, that is, the tank unit 20 (refer to FIG. 4) can be visually confirmed, the outer edge portion 30 disposed on the outer circumferential side of the light transmitting portion 59, and the gradations 61 configured of horizontal lines 61*a* illustrated by solid lines or vertical lines 61*b* illustrated by dotted lines which are respectively provided in each of the light transmitting window portions 59BK, 59C, 59M, 59Y, and 59PBK. In addition, the horizontal line 61*a* illustrated by the solid line or the vertical line 61*b* illustrated by the dotted line which configures the gradation 61 may be any color tone, such as individual colors which correspond to each of the ink colors, unified black color, or an outlined character.

In addition, at an outer edge of the light transmitting window portions 59BK, 59C, 59M, 59Y, and 59PBK, an outline 64 which is arranged along the outer edge of each of the light transmitting window portions 59BK, 59C, 59M, 59Y, and 59PBK may be provided. The outline 64 at this time may be any color tone, such as individual colors which correspond to each of the ink colors, unified black color, or an outlined character.

Each of the five light transmitting window portions 59BK, 59C, 59M, 59Y, and 59PBK which configure the light transmitting portion 59 is disposed corresponding to each of five tanks 21 of the tank unit 20, and has a shape which extends in a shape of a vertically long belt from the end in the upper portion (+Z direction), and of which the end portion of the lower portion (−Z direction) is rounded in an arc shape. In other words, the shape in a plan view from the +Y-axis direction is a shape which is similar to a so-called test tube shape. In addition, each of the light transmitting window portions 59BK, 59C, 59M, 59Y, and 59PBK protrudes such that the vertically long belt-like part has a semicircular shape from the outer surface along the front surface 11 (XZ plane) of the visible cover 5B, and in addition, the part rounded in an arc shape of the lower portion (−Z direction) protrudes in a hemispherical shape. In other words, the shape of which a part of the test tube protrudes from the outer surface along the front surface 11 (XZ plane) of the visible cover 5B is formed.

In this manner, as each of the light transmitting window portions 59BK, 59C, 59M, 59Y, and 59PBK allows a section to protrude in a semicircular shape from the outer surface along the front surface 11 (XZ plane) of the visible cover 5B, it is possible to improve visibility of the user in a case of visually confirming the amount (residual amount of ink) of the ink from the direction other than the front surface 11 (XZ plane).

The visible cover 5B is formed to have a shape in which the light transmitting window portions 59BK, 59C, 59M, 59Y, and 59PBK protrude by using a resin material having light transmission properties to the extent that the inner side (−Y side) of the visible cover 5B can be visually confirmed. In addition, the outer edge portion 30 disposed on the outer side of the XZ plane of the light transmitting window portions 59BK, 59C, 59M, 59Y, and 59PBK can have light transmittance different from that of the light transmitting window portions 59BK, 59C, 59M, 59Y, and 59PBK or can have non-light transmission properties by coating the surface of the resin material with a coloring coating material, by attaching a coloring film, or by performing emboss (wrinkle) processing. In this manner, by providing the outer edge portion 30, it is possible to clearly divide the light transmitting window portions 59BK, 59C, 59M, 59Y, and 59PBK, and the outer edge portion 30, and to further improve visibility of the user.

The lid portion 6 is provided on the front surface 11 side of the housing 2. The lid portion 6 is disposed on the upper side (+Z direction side) of the visible cover 5B at the part which protrudes further to the +Y direction side than the part at which the operation panel 3 and the paper discharge portion 4 are provided in the housing 2.

The lid portion 6 is configured to be openable and closable with respect to the housing 2. More specifically, the lid portion 6 is configured to be rotatable in the R1 direction illustrated by an arrow in the drawing. The R1 direction corresponds to a clockwise direction when the YZ plane is viewed from the +X direction side in a plan view regarding an axis along the X-axis as a rotation axis. By rotating the lid portion 6 in the R1 direction with respect to the housing 2, it is possible to open the lid portion 6 with respect to the housing 2. In other words, it is possible to open the tank cover 18B configured of the lid portion 6 and the visible cover 5B with respect to the housing 2. By rotating the lid portion 6 in the direction opposite to the R1 direction from the state where the lid portion 6 is open, it is possible to close the lid portion 6 with respect to the housing 2. In other words, by rotating the tank cover 18B in the direction opposite to the R1 direction, it is possible to close the tank cover 18B with respect to housing 2.

In addition, the reference marks 63 are provided on the surface positioned on the front surface 11 side of the housing 2 of the lid portion 6. The reference marks 63 are disposed on the +Z side (upper side) which corresponds to each of the light transmitting window portions 59BK, 59C, 59M, 59Y, and 59PBK provided in the visible cover 5B. Specifically, a mark 63BK of "BK" which is provided corresponding to the light transmitting window portion 59BK and indicates the black ink, a mark 63C of "C" which is provided corresponding to the light transmitting window portion 59C and indicates the cyan ink, a mark 63M of "M" which is provided corresponding to the light transmitting window portion 59M and indicates the magenta ink, a mark 63Y of "Y" which is provided corresponding to the light transmitting window portion 59Y and indicates the yellow ink, and a mark 63PBK of "PBK" which is provided corresponding to the light transmitting window portion 59PBK and indicates the pigment-based black ink, are included. In addition, the marks 63BK, 63C, 63M, 63Y, and 63PBK may be a color tone, such as individual colors which correspond to each of the ink colors, unified black color, or an outlined line.

The user can visually confirm five tanks 21 (refer to FIG. 4) in the light transmitting portion 59 when the front surface 11 of the printer 1A is viewed from the +Y direction side in a plan view, and additionally, the user can visually confirm the ink (residual amount of ink) accommodated in five tanks 21 through the member having light transmission properties in the five tanks 21. In addition, in the embodiment, an example in which the black ink is accommodated in the tank 21 positioned on the most −X side, and the cyan ink, the magenta ink, the yellow ink, and the pigment-based black ink are accommodated in each of the tanks 21 in an order of orienting toward the +X side following the most −X side, is illustrated.

In addition, by contrasting the gradations 61 which are provided in each of the light transmitting window portions 59BK, 59C, 59M, 59Y, and 59PBK which configure the light transmitting portion 59, and the reference marks 63 which are provided in the lid portion 6 and illustrate, for example, the ink type, with each other, the user can visually confirm and grasp the amount (residual amount of ink) of ink accommodated in the tank unit 20 (five tanks 21) via the visible cover 5B when the front surface 11 of the printer 1B is viewed from the +Y direction side.

By the configuration of the printer 1B according to the second embodiment, in addition to the effects of the first embodiment, as each of the light transmitting window portions 59BK, 59C, 59M, 59Y, and 59PBK protrudes in a semicircular sectional shape from the outer surface along the front surface 11 (XZ plane) of the visible cover 5B, it is possible to improve visibility of the user in a case of visually confirming the amount (residual amount of ink) of the ink from the direction other than the front surface 11 (XZ plane).

3. THIRD EMBODIMENT

Figure 8:
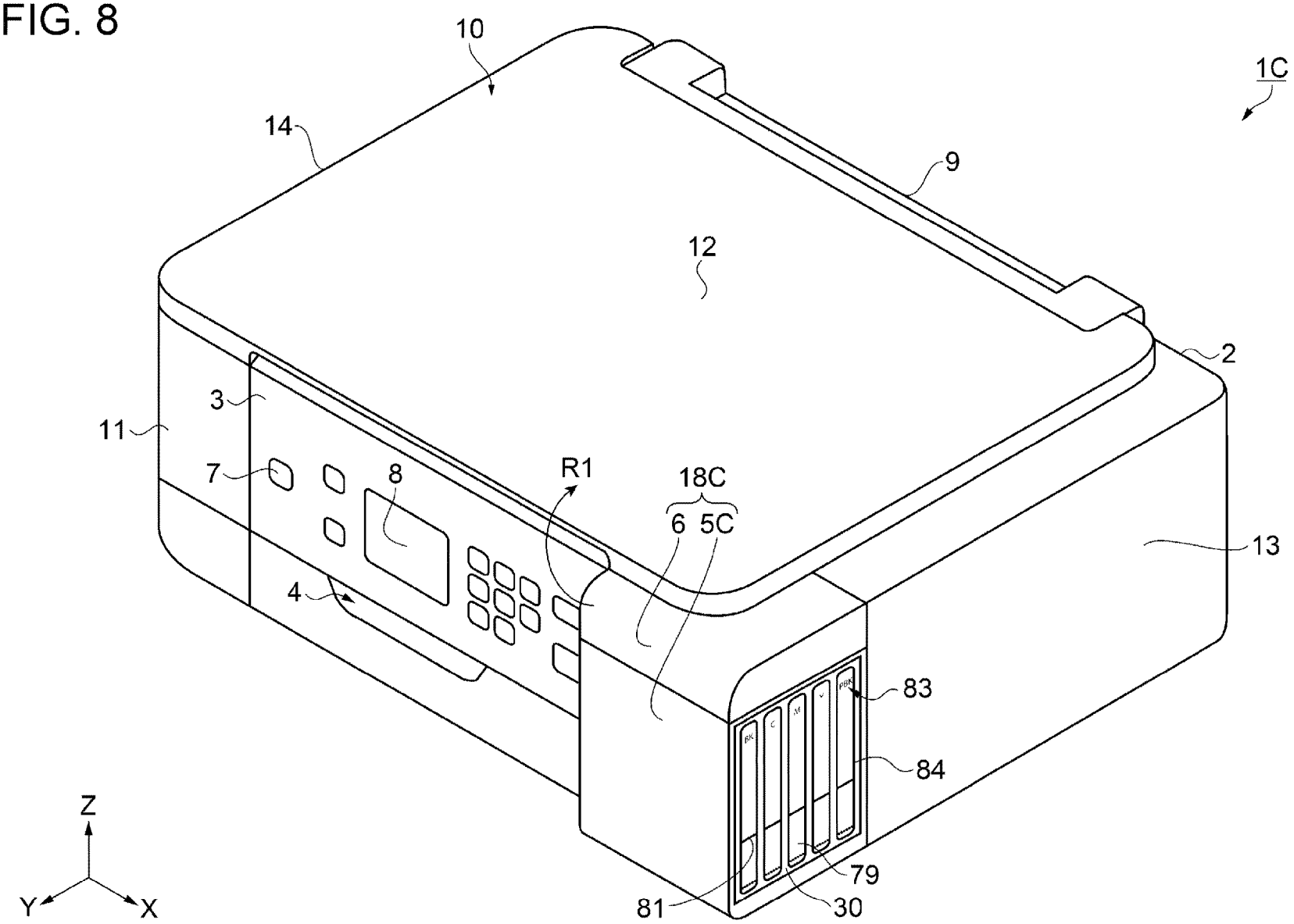
FIG. 8 is a perspective view illustrating an external appearance of a printer according to a third embodiment.
Figure 9:
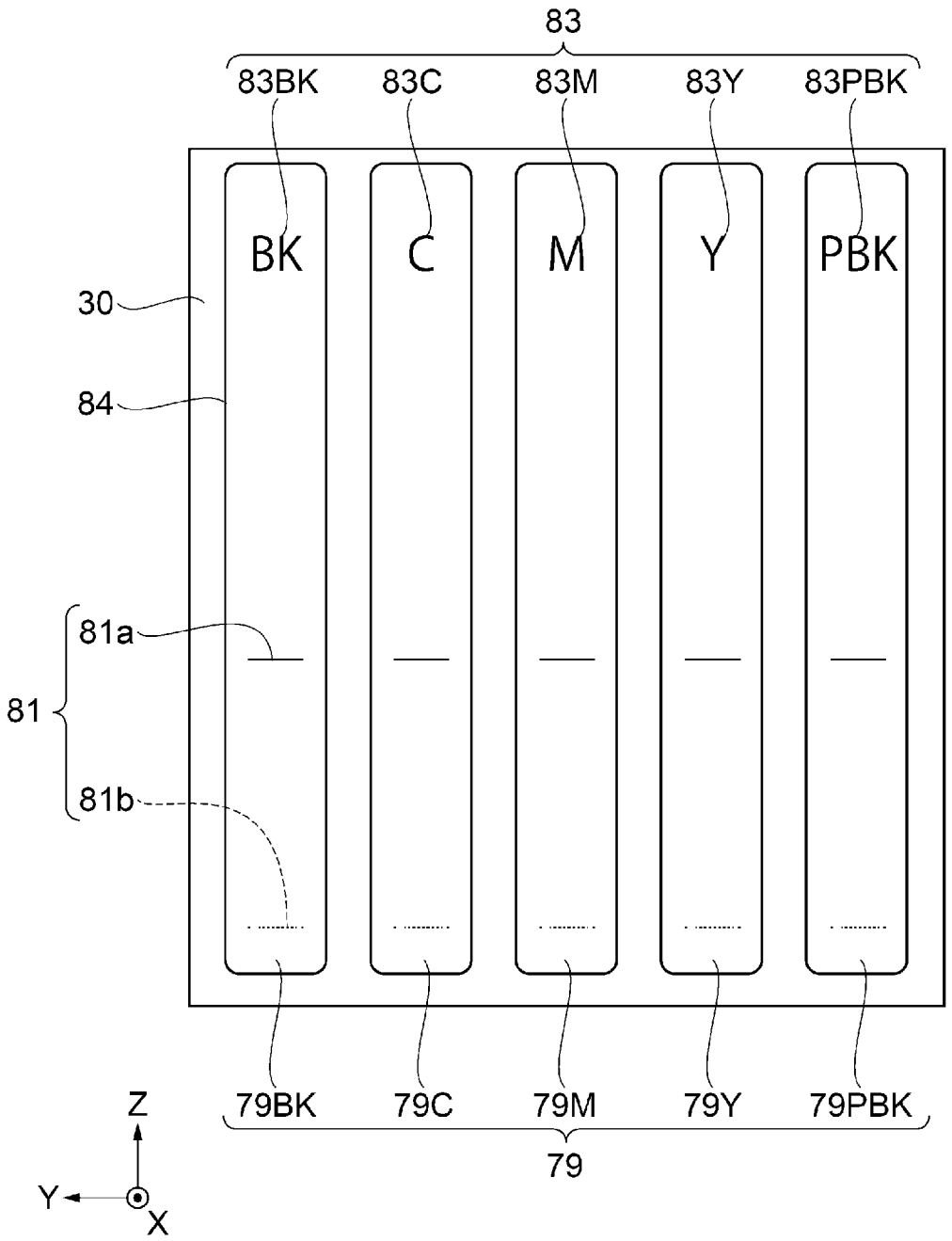
FIG. 9 is a front view illustrating a configuration example of a visible cover of the printer according to the third embodiment.

Next, a schematic configuration in the external appearance of a printer 1C according to a third embodiment will be described with reference to FIGS. 8 and 9. FIG. 8 is a perspective view illustrating the external appearance of the printer according to the third embodiment, and is a perspective view when the printer 1C according to the third embodiment is viewed from the +X direction side. FIG. 9 is a front view illustrating a configuration example of the visible cover of the printer according to the third embodiment.

As illustrated in FIGS. 8 and 9, the printer 1C according to the third embodiment includes the housing 2, the operation panel 3, the paper discharge portion 4, a visible cover 5C, the lid portion 6, the cover 9, and the cover 10. The printer 1C according to the third embodiment is different from the printer 1A according to the first embodiment in a configuration of a tank cover 18C which functions as a cover portion that covers the tank unit 20 (refer to FIG. 4). The tank cover 18C is configured of the visible cover 5C and the lid portion 6. When the front surface 11 of the printer 1C is viewed from the +Y direction side, light transmitting portions 79 are disposed on the side surface of the visible cover 5C on the side wall 13 side positioned on the +X direction side. In other words, in the printer 1C, in the tank unit 20 positioned on the inner side of the visible cover 5C, a part having light transmission properties is oriented at least toward the +X direction, and the plurality of tanks 21 (five tanks 21 in the example) are arranged along the Y direction. In addition, in the following description, the configuration similar to that of the printer 1A according to first embodiment will be given the same reference numbers, and the description thereof will be omitted.

The printer 1C according to the third embodiment is different from the printer 1A according to the first embodiment in the configuration of the tank cover 18C which functions as a cover portion that covers the tank unit 20 (refer to FIG. 4). More specifically, the position (surface) at which the visible cover 5C that configures the tank cover 18C is provided, and the configuration or the disposition of gradations 81 or reference marks 83, are different.

In the visible cover 5C, when the front surface 11 of the printer 1C is viewed from the +Y direction side in a plan view, the light transmitting portion 79 is disposed on the side surface of the visible cover 5C that faces the side wall 13 side positioned on the +X direction side. The light transmitting portion 79 includes five light transmitting window portions 79BK, 79C, 79M, 79Y, and 79PBK, and has light transmission properties by which the tank unit 20 (refer to FIG. 4) disposed on the inner side of the visible cover 5C can be visually confirmed when viewed from the +X side. The light transmitting window portions 79BK, 79C, 79M, 79Y, and 79PBK are disposed corresponding to each of five tanks of the tank unit 20, and have a vertically long belt-like substantially rectangular shape of which four corners are rounded in an arc shape. In addition, on the outer circumferential side of each of the light transmitting window portions 79BK, 79C, 79M, 79Y, and 79PBK, the outer edge portion 30 is disposed.

The light transmitting window portions 79BK, 79C, 79M, 79Y, and 79PBK include the gradations 81 configured of horizontal lines 81*a* illustrated by solid lines or horizontal lines 81*b* illustrated by dotted lines, and the reference mark 83 including marks 83BK, 83C, 83M, 83Y, and 83PBK. In addition, the horizontal line 81*a* illustrated by the solid line or the horizontal line 81*b* illustrated by the dotted line which configures the gradation 81 may be any color tone, such as individual colors which correspond to each of the ink colors, unified black color, or an outlined character.

In addition, at an outer edge of the light transmitting window portions 79BK, 79C, 79M, 79Y, and 79PBK, an outline 84 which is arranged along the outer edge of each of the light transmitting window portions 79BK, 79C, 79M, 79Y, and 79PBK may be provided. The outline 84 at this time may be any color tone, such as individual colors which correspond to each of the ink colors, unified black color, or an outlined character.

The reference mark 83 including the marks 83BK, 83C, 83M, 83Y, and 83PBK includes the mark 83BK of "BK" which is provided in the light transmitting window portion 79BK and indicates the black ink, the mark 83C of "C" which is provided in the light transmitting window portion 79C and indicates the cyan ink, the mark 83M of "M" which is provided in the light transmitting window portion 79M and indicates the magenta ink, the mark 83Y of "Y" which is provided in the light transmitting window portion 79Y and indicates the yellow ink, and the mark 83PBK of "PBK" which is provided in the light transmitting window portion 79PBK and indicates the pigment-based black ink. In addition, the marks 83BK, 83C, 83M, 83Y, and 83PBK may be any color tone, such as individual colors which correspond to each of the ink colors, unified black color, or an outlined character.

The visible cover 5C is formed of a resin material having light transmission properties to the extent that the inner side (−Y side) of the visible cover 5C can be visually confirmed. In addition, the outer edge portion 30 disposed on the outer side of the XZ plane of the light transmitting window portions 79BK, 79C, 79M, 79Y, and 79PBK can have light transmittance different from that of the light transmitting window portions 79BK, 79C, 79M, 79Y, and 79PBK or can have non-light transmission properties by coating the surface of the resin material with a coloring coating material, by attaching a coloring film, or by performing emboss (wrinkle) processing. In this manner, by providing the outer edge portion 30, it is possible to clearly divide the light transmitting window portions 79BK, 79C, 79M, 79Y, and 79PBK, and the outer edge portion 30, and to further improve visibility of the user.

The lid portion 6 is provided on the front surface 11 side of the housing 2. The lid portion 6 is disposed above (+Z direction side) the visible cover 5C at the part which protrudes further to the +Y direction side than the part at which the operation panel 3 and the paper discharge portion 4 are provided in the housing 2.

The lid portion 6 is configured to be openable and closable with respect to the housing 2. More specifically, the lid portion 6 is configured to be rotatable in the R1 direction illustrated by an arrow in the drawing. The R1 direction corresponds to a clockwise direction when the YZ plane is viewed from the +X direction side in a plan view regarding an axis along the X-axis as a rotation axis. By rotating the lid portion 6 in the R1 direction with respect to the housing 2, it is possible to open the lid portion 6 with respect to the housing 2. In other words, it is possible to open the tank cover 18C configured of the lid portion 6 and the visible cover 5C with respect to the housing 2. By rotating the lid portion 6 in the direction opposite to the R1 direction from the state where the lid portion 6 is open, it is possible to close the lid portion 6 with respect to the housing 2. In other words, by rotating the tank cover 18C in the direction opposite to the R1 direction, it is possible to close the tank cover 18C with respect to the housing 2.

When the side wall 13 of the printer 1C is viewed from the +X direction side in a plan view, the user can visually confirm five tanks 21 (refer to FIG. 4), and additionally, can visually confirm the ink (residual amount of ink) accommodated in five tanks 21 through the member having light transmission properties of five tanks 21, in the light transmitting portion 79. In addition, in the embodiment, an example in which the black ink is accommodated in the tank 21 positioned on the most +Y side, and the cyan ink, the magenta ink, the yellow ink, and the pigment-based black ink are accommodated in each of the tanks 21 in an order of orienting toward the −Y side following the most +Y side, is illustrated.

In addition, by contrasting the gradations 81 which are provided in each of the light transmitting window portions 79BK, 79C, 79M, 79Y, and 79PBK which configure the light transmitting portion 79, and the reference marks 83 which illustrate, for example, the ink type, with each other, the user can visually confirm and grasp the amount (residual amount of ink) of ink accommodated in the tank unit 20 (five tanks 21) via the visible cover 5C from the side wall 13 side of the printer 1C.

According to the configuration of the printer 1C according to the third embodiment, it is possible to visually confirm and grasp the amount (residual amount of ink) of the ink accommodated in the tank unit 20 (five tanks 21) from the side wall 13 side (+X direction side) of the printer 1C.

4. FOURTH EMBODIMENT

Figure 10:
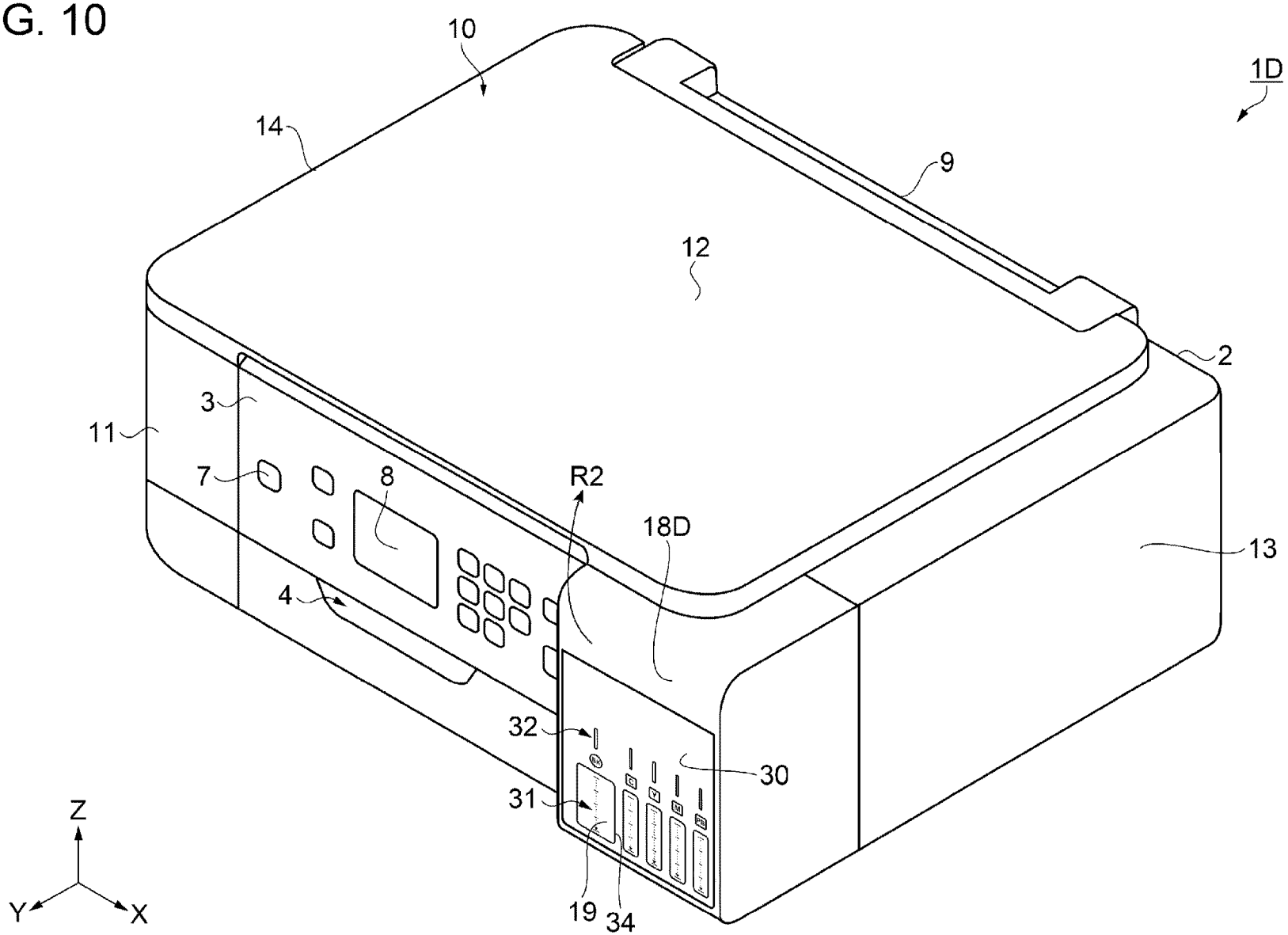
FIG. 10 is a perspective view illustrating an external appearance of a printer according to a fourth embodiment.

Next, a schematic configuration in the external appearance of a printer 1D according to a fourth embodiment will be described with reference to FIG. 10. FIG. 10 is a perspective view illustrating the external appearance of the printer according to the fourth embodiment, and is a perspective view when the printer 1D according to the fourth embodiment is viewed from the +X direction side.

As illustrated in FIG. 10, the printer 1D according to the fourth embodiment includes the housing 2, the operation panel 3, the paper discharge portion 4, the cover 9, the cover 10, and a tank cover 18D. The printer 1D according to the fourth embodiment is different from the printer 1A according to the first embodiment in a configuration of the tank cover 18D which functions as a cover portion that covers the tank unit 20 (refer to FIG. 4). Hereinafter, the description will focus on the different points, configuration elements similar to those of the printer 1A according to the first embodiment, such as a basic configuration of the printer 1D according to the fourth embodiment will be given the same reference numbers, and the description thereof will be omitted.

The tank cover 18 of the printer 1A according to the first embodiment is a configuration including the visible cover 5 and the lid portion 6, but the tank cover 18D according to the fourth embodiment has a configuration in which the visible cover 5 and the lid portion 6 of the printer 1A according to the first embodiment are consecutively connected to each other. In other words, in the tank cover 18D according to the fourth embodiment, a part which corresponds to the lid portion oriented in the +Z direction, and a part which corresponds to the visible cover oriented in the +Y direction, have, for example, an integrated structure in which the parts are consecutively molded by a bent shape or the like.

In the printer 1D, similar to the first embodiment, an example in which the black ink is accommodated in the tank 21 positioned on the most −X side (refer to FIG. 4), and the cyan ink, the magenta ink, the yellow ink, and the pigment-based black ink are accommodated in each of the tanks 21 in an order of orienting toward the +X side following the most −X side, is illustrated. In the tank unit 20 positioned on the inner side of the tank cover 18D, the part having light transmission properties is oriented at least in the +X direction, and the plurality of tanks 21 are arranged along the Y direction.

The tank cover 18D is positioned on the +X direction side when the front surface 11 of the printer 1D is viewed from the +Y direction side in a plan view, and the light transmitting portion 19 is disposed on the front surface of the tank cover 18D along the front surface 11. On the outer side of the XZ plane of the light transmitting portion 19 (light transmitting window portions 19BK, 19C, 19Y, 19M, and 19PB), the disposed outer edge portion 30 is provided. Since the light transmitting portion 19 and the outer edge portion 30 are similar to those of the first embodiment, a summary thereof will be described hereinafter, and detailed description will be omitted.

The light transmitting portion 19 includes five light transmitting window portions 19BK, 19C, 19Y, 19M, and 19PB (refer to FIG. 3) having a vertically long substantially rectangular shape of which four corners are rounded in an arc shape. In each of the light transmitting window portions 19BK, 19C, 19Y, 19M, and 19PB, the gradations 31 having configuration similar to that of the first embodiment are provided. In addition, in the outer edge portion 30, for example, the reference marks 32 which illustrate the ink type are provided corresponding to each of the light transmitting window portions 19BK, 19C, 19Y, 19M, and 19PB.

The tank cover 18D is provided on the front surface 11 side of the housing 2. The tank cover 18D is disposed at the part which protrudes further to the +Y direction side than the part at which the operation panel 3 and the paper discharge portion 4 are provided in the housing 2.

The tank cover 18D is configured to be openable and closable with respect to the housing 2. More specifically, the tank cover 18D is configured to be rotatable in a R2 direction illustrated by an arrow in FIG. 10. The R2 direction corresponds to a clockwise direction when the YZ plane is viewed from the +X direction side in a plan view regarding an axis along the X-axis as a rotation axis. By rotating the tank cover 18D in the R2 direction with respect to the housing 2, it is possible to open the tank cover 18D with respect to the housing 2. By rotating the tank cover 18D in the direction opposite to the R2 direction from the state where the tank cover 18D is open, it is possible to close the tank cover 18D with respect to the housing 2.

In a case of replenishing the tank 21 with the ink, by rotating the tank cover 18D in the R2 direction with respect to the housing 2, the tank cover 18D is open with respect to the housing 2. Accordingly, a part (filling surface 23) of each of the tanks 21 is exposed from the part at which the tank cover 18D is open. The user can fill the inside of the tank 21 with the ink from the outside of the printer 1D via the liquid filling port 22 in a state where the tank cover 18D is open with respect to the housing 2. After replenishing the tank 21 with the ink, when the tank cover 18D is closed, the liquid filling port 22 is covered with the tank cover 18D.

In the printer 1D according to the fourth embodiment having the configuration, even when the outer surface of the tank 21 is polluted due to the accommodated ink or the like, there is not a case where the gradations 31 or the reference marks 32 which are provided in the light transmitting portion 19 (light transmitting window portions 19BK, 19C, 19Y, 19M, and 19PB) provided in the tank cover 18D are polluted. Therefore, visibility when the user visually confirms the amount (residual amount of ink) of the ink via the member having light transmission properties in the tank 21 and the light transmitting portion (not illustrated) of the cover portion does not deteriorate, and it is possible to maintain a state where visibility is excellent.

According to the printers 1A, 1B, 1C, and 1D according to each of the above-described embodiments, since at least one of the gradations 31, 61, and 81 and the reference marks 32, 63, and 83 is provided in the light transmitting portions 19, 59, and 79 which are provided at least at a part of the tank covers 18, 18B, 18C, and 18D which function as the cover portion, for example, even when the outer surface of the tank 21 is polluted due to the accommodated ink or the like, there is not a case where the gradations 31, 61, and 81 or the reference marks 32, 63, and 83 are polluted. Therefore, visibility when the user visually confirms the amount (residual amount of ink) of the ink via the tank 21 which is the member having light transmission properties and the light transmitting portions 19, 59, and 79 of the tank covers 18, 18B, 18C, and 18D does not deteriorate, and it is possible to maintain a state where visibility is excellent.

In addition, the user can easily visually confirm the amount (residual amount of the ink) for each type of the ink by the gradations 31, 61, and 81 which correspond to the amount of the ink and the reference marks 32, 63, and 83 which corresponds to the type of the ink.

In addition, a configuration in which at least one of the gradations 31, 61, and 81 and the reference marks 32, 63, and 83 is provided on a transparent sheet in each of the above-described embodiments, and the transparent sheet on which at least one of the gradations 31, 61, and 81 and the reference marks 32, 63, and 83 is provided is attached to the light transmitting portions 19, 59, and 79, can be employed. According to such a configuration, by replacing the transparent sheet, it is possible to easily use or change the gradations 31, 61, and 81 or the reference marks 32, 63, and 83 having various designs.

In addition, in each of the above-described embodiments, the visible covers 5, 5B, and 5C having an integrated configuration by forming the visible covers 5, 5B, and 5C by the resin material having light transmission properties, by coating the outer edge portion 30 of the light transmitting window portions 19BK, 19C, 19Y, 19M, and 19PB with the coloring coating material, by attaching the coloring film, or by performing emboss (wrinkle) processing, are described, but are not limited thereto. As the visible cover having other configurations, a configuration in which a through-hole is provided on a cover wall surface at a part which corresponds to the light transmitting window portions 19BK, 19C, 19Y, 19M, and 19PB that configures the light transmitting portion, and a light transmitting plate, such as transparent glass or transparent film, is provided to cover the through-hole, may be employed. In this case, on the light transmitting plate, the gradations or the reference marks can be formed. Even in a case of the visible cover having such a configuration, it is possible to configure the light transmitting portion by the through-hole and the light transmitting plate which are relatively easily processed. In addition, since it is possible form the gradations or the reference marks on the light transmitting plate, it is possible to easily form the gradations or the reference marks having various designs.

In addition, since at least one of the gradations 31, 61, and 81 and the reference marks 32, 63, and 83 is provided in the visible covers 5, 5B, and 5C in each of the above-described embodiments, for example, a configuration in which at least one of the gradations 31, 61, and 81 and the reference marks 32, 63, and 83 protrudes from the visible covers 5, 5B, and 5C can be employed, and the gradations or the reference marks which correspond to universal design can be employed.

In addition, in each of the above-described embodiments, a digital method in which a liquid crystal display or the like in which at least one of the gradations 31, 61, and 81 and the reference marks 32, 63, and 83 is disposed in the visible covers 5, 5B, and 5C is used, can be performed.

5. EXAMPLES OF VISIBLE COVERS (LIGHT TRANSMITTING PORTIONS, GRADATIONS, AND REFERENCE MARKS)

Figure 11:
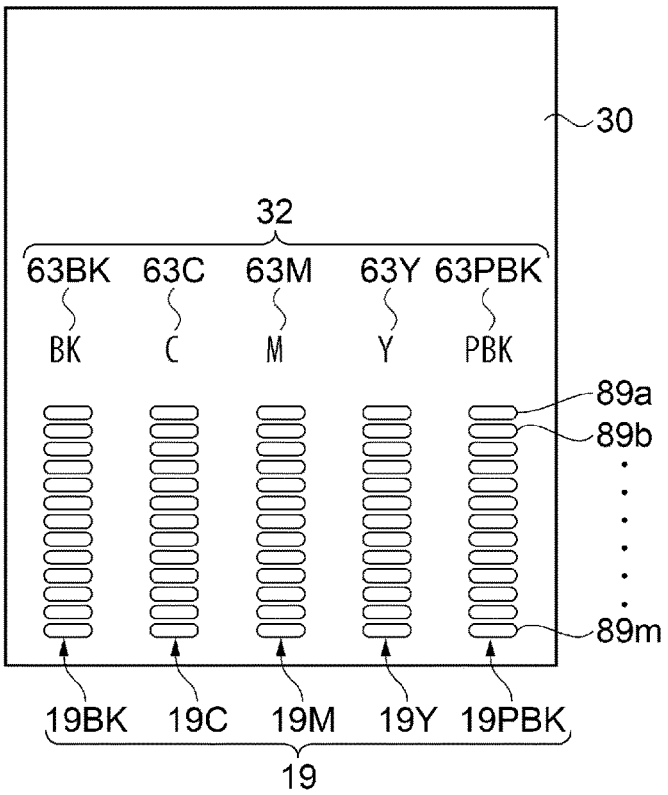
FIG. 11 is a front view illustrating light transmitting portions, gradations, and reference marks according to Example 1.
Figure 70:
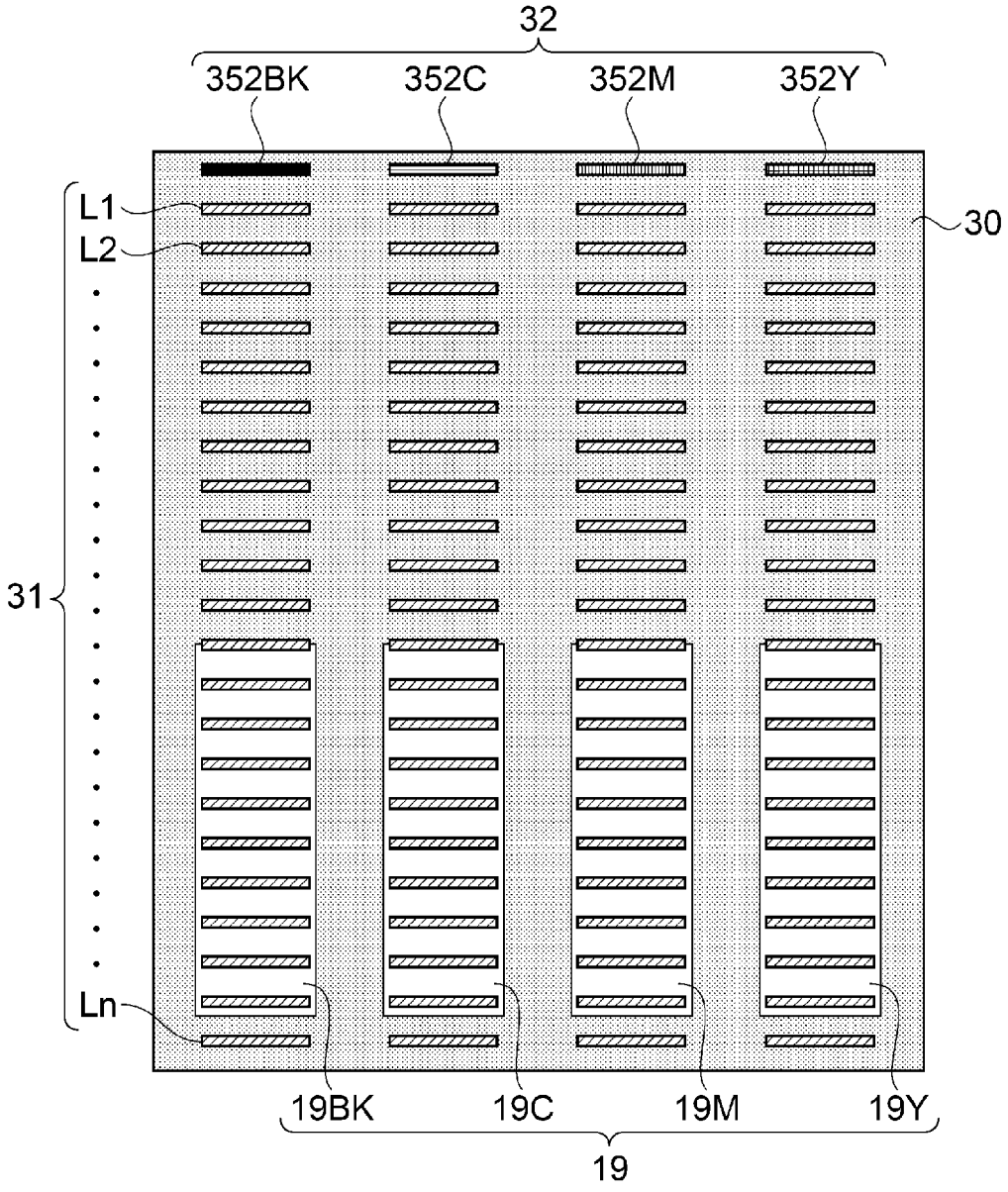
FIG. 70 is a front view illustrating light transmitting portions, gradations, and reference marks according to Example 60.

In each of the above-described embodiments, a configuration example of the visible cover 5 including the outer edge portion 30 disposed on the outer circumferential side of the light transmitting portions 19, 59, and 79 and the light transmitting portions 19, 59, and 79, the gradations 31 provided in the light transmitting portions 19, 59, and 79 or in the outer edge portion 30, and the reference marks 32, is described as an example, but the configuration of the visible cover 5 (gradations 31 and the reference marks 32) is not limited thereto. Hereinafter, various examples of the configurations of the gradations 31 and reference marks 32 which are disposed in the visible cover 5 will be described in order with reference to FIGS. 11 to 70. FIGS. 11 to 70 are front views illustrating the gradations and the reference marks which are disposed in the visible cover according to each of the examples. In addition, hereinafter, there is a case where the reference numbers used in the descriptions of the printers 1A, 1B, 1C, and 1D according to each of the above-described embodiments are employed in the description. In addition, the +Z direction in the drawing of the printers 1A, 1B, 1C, and 1D according to each of the above-described embodiments is an upper side, and the −Z direction in the direction opposite thereto is a lower side, in the description.

5.1. Example 1

Light transmitting portions, gradations, and reference marks according to Example 1 will be described with reference to FIG. 11. The gradations according to Example 1 have a so-called indicator lamp style disposition design, and a design in which the reference marks are disposed in accordance with the gradations is employed.

As illustrated in FIG. 11, the light transmitting window portions 19BK, 19C, 19M, 19Y, and 19PBK according to Example 1 are configured such that a plurality of slit windows 89*a*, 89*b*, . . . and 89*m* having a horizontally long circular shape having light transmission properties are arranged in a shape of a belt from the upper side to the lower side. Further on the outer side than the outer edge of the slit windows 89*a*, 89*b*, . . . and 89*m*, the outer edge portion 30 divided into the slit windows 89*a*, 89*b*, . . . , and 89*m* is provided by coating the surface with the coloring coating material, by attaching the coloring film, or by performing emboss (wrinkle) processing, is provided. In addition, as the gradation 31, for example, the slit window 89*a* can be used as a gradation that indicates the upper limit of the amount of the ink, and the slit window 89*m* can be used as a gradation that indicates the lower limit of the amount of the ink.

In the vicinity on the slit window 89*a* side of each of the light transmitting window portions 19BK, 19C, 19M, 19Y, and 19PBK, the reference mark 32 is provided. The reference mark 32 specifically includes the mark 63BK of "BK" which is provided corresponding to the light transmitting window portion 19BK and indicates the black ink, the mark 63C of "C" which is provided corresponding to the light transmitting window portion 19C and indicates the cyan ink, the mark 63M of "M" which is provided corresponding to the light transmitting window portion 19M and indicates the magenta ink, the mark 63Y of "Y" which is provided corresponding to the light transmitting window portion 19Y and indicates the yellow ink, and the mark 63PBK of "PBK" which is provided corresponding to the light transmitting window portion 19PBK and indicates the pigment-based black ink. In addition, the marks 63BK, 63C, 63M, 63Y, and 63PBK may be any color tone, such as individual colors which correspond to each of the ink colors, unified black color, or an outlined character.

5.2. Example 2

Figure 12:
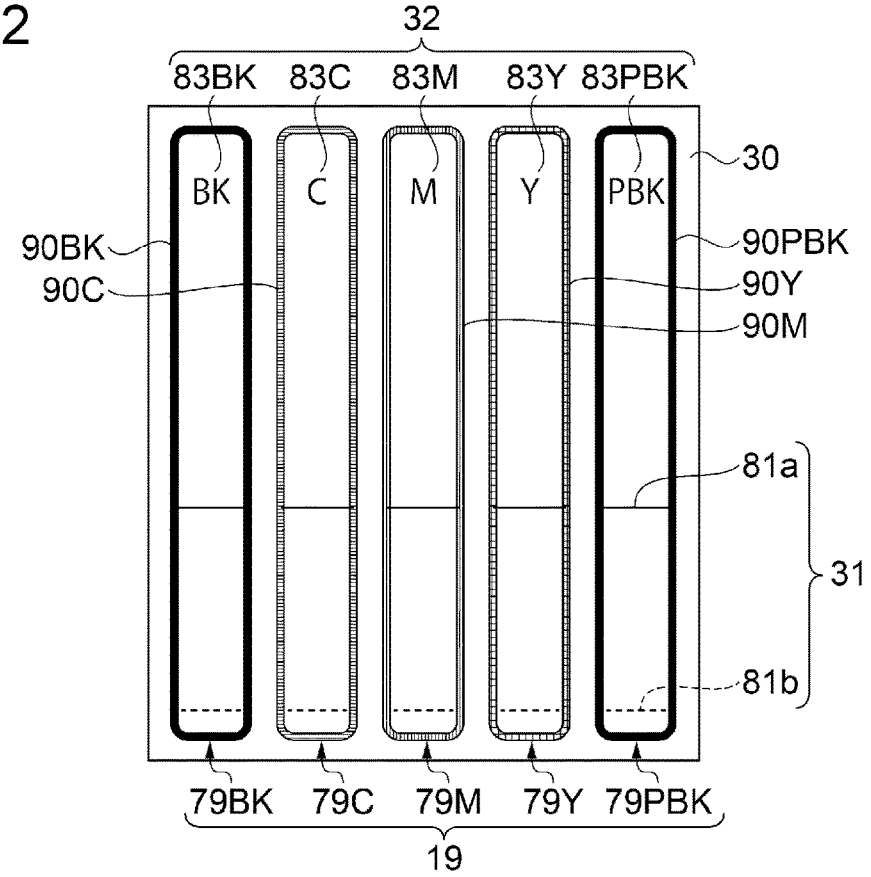
FIG. 12 is a front view illustrating light transmitting portions, gradations, and reference marks according to Example 2.

Light transmitting portions, gradations, and reference marks according to Example 2 will be described with reference to FIG. 12. In Example 2, as illustrated in FIG. 12, the light transmitting window portions 79BK, 79C, 79M, 79Y, and 79PBK provided with color line frames (hereinafter, referred to as outlines 90BK, 90C, 90M, 90Y, and 90PBK) are included. In addition, in the example, the light transmitting window portion 79BK, the light transmitting window portion 79C, the light transmitting window portion 79M, the light transmitting window portion 79Y, and the light transmitting window portion 79PBK oppose the tanks 21 (refer to FIG. 4) which respectively accommodate the black ink, the cyan ink, the magenta ink, the yellow ink, and the pigment-based black ink therein. In addition, on the outer side of the light transmitting window portions 79BK, 79C, 79M, 79Y, and 79PBK, the outer edge portion 30 is provided.

The light transmitting window portions 79BK, 79C, 79M, 79Y, and 79PBK which configure the light transmitting portion 19 according to Example 2 have light transmission properties, and have a substantially rectangular shape which is vertically long from the upper side to the lower side. In addition, four corners of the light transmitting window portions 79BK, 79C, 79M, 79Y, and 79PBK having a substantially rectangular shape are rounded in an arc shape. In addition, at the outer edges of each of the light transmitting window portions 79BK, 79C, 79M, 79Y, and 79PBK, the outlines 90BK, 90C, 90M, 90Y, and 90PBK which are arranged along the outer edge are provided.

The outlines 90BK, 90C, 90M, 90Y, and 90PBK are respectively colored by the colors which have the same base as each of the colors of the corresponding ink. Specifically, the black-based color is used in the outline 90BK arranged in the light transmitting window portion 79BK which corresponds to the black ink, the blue-based color is used in the outline 90C arranged in the light transmitting window portion 79C which corresponds to the cyan ink, the red-based color is used in the outline 90M arranged in the light transmitting window portion 79M which corresponds to the magenta ink, the yellow-based color is used in the outline 90Y arranged in the light transmitting window portion 79Y which corresponds to the yellow ink, and the black-based color is used in the outline 90PBK arranged in the light transmitting window portion 79PBK which corresponds to the pigment-based black ink, respectively.

In the light transmitting window portions 79BK, 79C, 79M, 79Y, and 79PBK, the gradations 31 configured of the horizontal line 81*a* illustrated by a solid line or the horizontal line 81*b* illustrated by a dotted line, and the reference marks 32 including the marks 83BK, 83C, 83M, 83Y, and 83PBK, are provided.

The reference mark 83 including the marks 83BK, 83C, 83M, 83Y, and 83PBK includes the mark 83BK of "BK" which is provided in the light transmitting window portion 79BK and indicates the black ink, the mark 83C of "C" which is provided in the light transmitting window portion 79C and indicates the cyan ink, the mark 83M of "M" which is provided in the light transmitting window portion 79M and indicates the magenta ink, the mark 83Y of "Y" which is provided in the light transmitting window portion 79Y and indicates the yellow ink, and the mark 83PBK of "PBK" which is provided in the light transmitting window portion 79PBK and indicates the pigment-based black ink.

In addition, the horizontal line 81*a* illustrated by a solid line or the horizontal line 81*b* illustrated by a dotted line which configure the gradation 31, and the marks 83BK, 83C, 83M, 83Y, and 83PBK may be any color tone, such as individual colors which correspond to each of the ink colors, unified black color, or an outlined character.

5.3. Example 3

Figure 13:
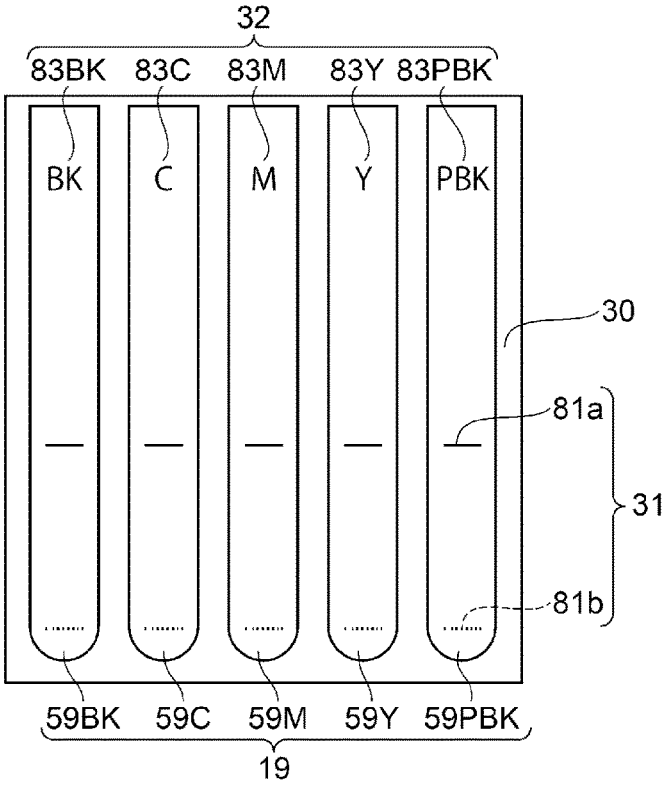
FIG. 13 is a front view illustrating light transmitting portions, gradations, and reference marks according to Example 3.

Light transmitting portions, gradations, and reference marks according to Example 3 will be described with reference to FIG. 13. In Example 3, as illustrated in FIG. 13, the light transmitting window portions 59BK, 59C, 59M, 59Y, and 59PBK which configure the light transmitting portion 19 have an external shape which considers a test tube as a motive. In addition, in the example, the light transmitting window portion 59BK, the light transmitting window portion 59C, the light transmitting window portion 59M, the light transmitting window portion 59Y, and the light transmitting window portion 59PBK oppose the tanks 21 (refer to FIG. 4) which respectively accommodate the black ink, the cyan ink, the magenta ink, the yellow ink, and the pigment-based black ink therein. In addition, on the outer side of the light transmitting window portions 59BK, 59C, 59M, 59Y, and 59PBK, the outer edge portion 30 is provided.

In each of the light transmitting window portions 59BK, 59C, 59M, 59Y, and 59PBK, the gradation 31 configured of the horizontal line 81*a* illustrated by a solid line and the horizontal line 81*b* illustrated by a dotted line, and the reference marks 32 including the marks 83BK, 83C, 83M, 83Y, and 83PBK are provided.

The reference mark 32 including the marks 83BK, 83C, 83M, 83Y, and 83PBK includes the mark 83BK of "BK" which is provided in the light transmitting window portion 59BK and indicates the black ink, the mark 83C of "C" which is provided in the light transmitting window portion 59C and indicates the cyan ink, the mark 83M of "M" which is provided in the light transmitting window portion 59M and indicates the magenta ink, the mark 83Y of "Y" which is provided in the light transmitting window portion 59Y and indicates the yellow ink, and the mark 83PBK of "PBK" which is provided in the light transmitting window portion 59PBK and indicates the pigment-based black ink.

In addition, the horizontal line 81*a* illustrated by a solid line or the horizontal line 81*b* illustrated by a dotted line which configure the gradation 31, and the marks 83BK, 83C, 83M, 83Y, and 83PBK may be any color tone, such as individual colors which correspond to each of the ink colors, unified black color, or an outlined character.

Each of the five light transmitting window portions 59BK, 59C, 59M, 59Y, and 59PBK which configure the light transmitting portion 19 is disposed corresponding to each of the five tanks 21 of the tank unit 20, and has a shape which extends in a shape of a vertically long belt from the upper end (a side on which the reference mark 32 is disposed), of which the end portion of the lower portion (a side on which the horizontal line 81*b* illustrated by the dotted line is disposed) is rounded in an arc shape, and which is similar to so-called test tube shape.

5.4. Example 4

Figure 14:
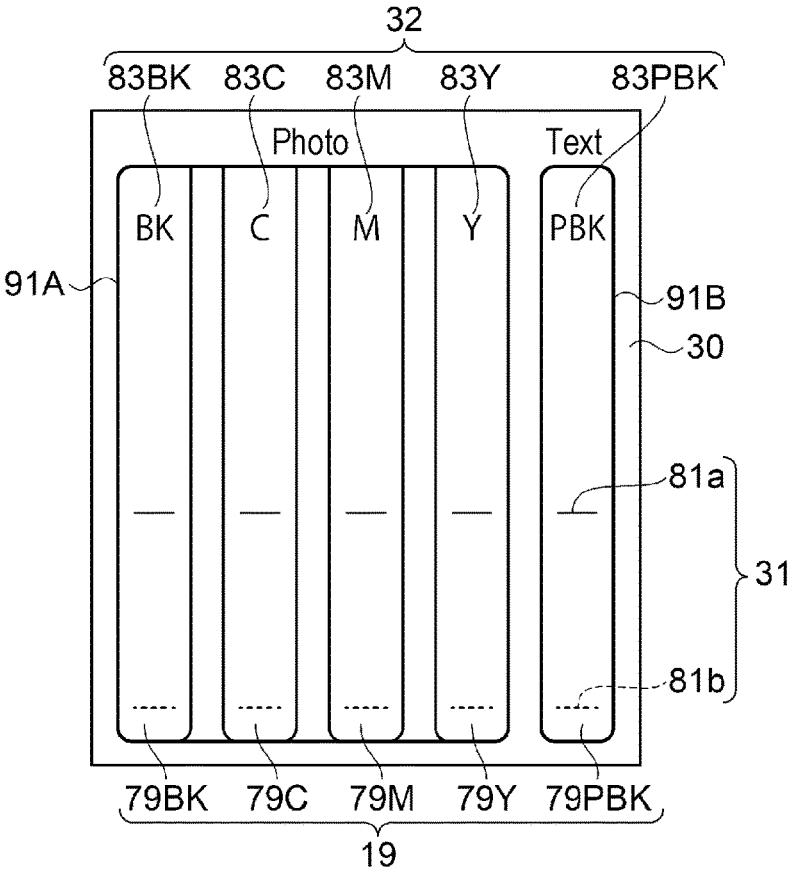
FIG. 14 is a front view illustrating light transmitting portions, gradations, and reference marks according to Example 4.

Light transmitting portions, gradations, and reference marks according to Example 4 will be described with reference to FIG. 14. In Example 4, as illustrated in FIG. 14, a single outline 91B is arranged in the light transmitting window portion 79PBK that corresponds the pigment-based black ink, and a frame line 91A in which the light transmitting window portions 79BK, 79C, 79M, and 79Y are bound to each other is arranged in the light transmitting window portions 79BK, 79C, 79M, and 79Y that correspond to other four colors of ink. In addition, in the example, the light transmitting window portion 79BK, the light transmitting window portion 79C, the light transmitting window portion 79M, the light transmitting window portion 79Y, and the light transmitting window portion 79PBK oppose the tanks 21 (refer to FIG. 4) which respectively accommodate the black ink, the cyan ink, the magenta ink, the yellow ink, and the pigment-based black ink therein. In addition, on the outer side of the light transmitting window portions 79BK, 79C, 79M, 79Y, and 79PBK, the outer edge portion 30 is provided.

The light transmitting window portions 79BK, 79C, 79M, 79Y, and 79PBK which configure the light transmitting portion 19 according to Example 4 have light transmission properties. The light transmitting window portion 79BK and the light transmitting window portion 79Y have a substantially rectangular shape which is vertically long and of which three corners are rounded in an arc shape, and the light transmitting window portion 79C and the light transmitting window portion 79M have a substantially rectangular shape which is vertically long and of which two corners on the horizontal line 81*b* side illustrated by a dotted line are rounded in an arc shape. The light transmitting window portion 79PBK has a substantially rectangular shape which is vertically long and of which four corners are rounded in an arc shape. In the light transmitting window portion 79PBK, the outline 91B arranged along the outer edge is provided. In addition, in other light transmitting window portions 79BK, 79C, 79M, and 79Y, the frame line 91A which binds the outer edge part of the four light transmitting window portions 79BK, 79C, 79M, and 79Y is provided.

In the light transmitting window portions 79BK, 79C, 79M, 79Y, and 79PBK, the gradations 31 configured of the horizontal line 81*a* illustrated by a solid line or the horizontal line 81*b* illustrated by a dotted line, and the reference marks 32 including the marks 83BK, 83C, 83M, 83Y, and 83PBK, are provided.

The reference mark 32 including the marks 83BK, 83C, 83M, 83Y, and 83PBK includes the mark 83BK of "BK" which is provided in the light transmitting window portion 79BK and indicates the black ink, the mark 83C of "C" which is provided in the light transmitting window portion 79C and indicates the cyan ink, the mark 83M of "M" which is provided in the light transmitting window portion 79M and indicates the magenta ink, the mark 83Y of "Y" which is provided in the light transmitting window portion 79Y and indicates the yellow ink, and the mark 83PBK of "PBK" which is provided in the light transmitting window portion 79PBK and indicates the pigment-based black ink. In addition, the reference mark 32 includes "Photo" provided above the frame line 91A, or "Text" provided above the outline 91B.

In addition, the frame line 91A or the outline 91B, the horizontal line 81*a* illustrated by a solid line or the horizontal line 81*b* illustrated by a dotted line which configure the gradation 31, and the marks 83BK, 83C, 83M, 83Y, and 83PBK may be any color tone, such as individual colors which correspond to each of the ink colors, unified black color, or an outlined character.

5.5. Example 5

Figure 15:
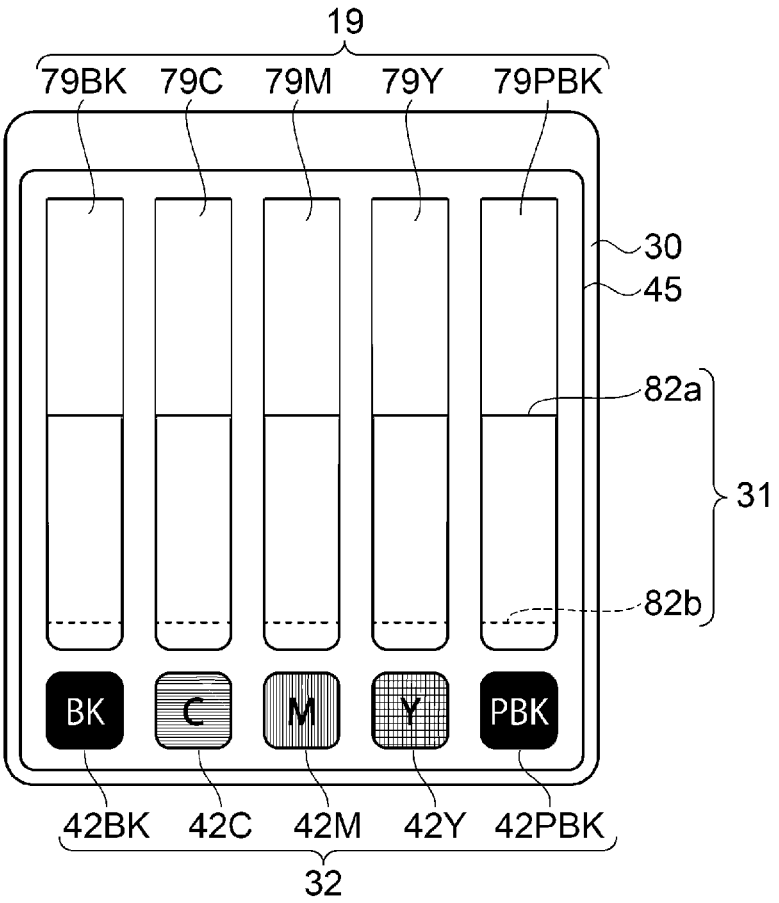
FIG. 15 is a front view illustrating light transmitting portions, gradations, and reference marks according to Example 5.

Light transmitting portions, gradations, and reference marks according to Example 5 will be described with reference to FIG. 15. In Example 5, as illustrated in FIG. 15, the reference marks 32 (also referred to as an application icon) which are colored corresponding to the colors of the ink in the outer edge portion 30 below the light transmitting window portions 79BK, 79C, 79M, 79Y, and 79PBK, are provided. The outer edge portion 30 is a region provided on the outer side of the light transmitting window portions 79BK, 79C, 79M, 79Y, and 79PBK. In addition, in the example, the light transmitting window portion 79BK, the light transmitting window portion 79C, the light transmitting window portion 79M, the light transmitting window portion 79Y, and the light transmitting window portion 79PBK oppose the tanks 21 (refer to FIG. 4) which respectively accommodate the black ink, the cyan ink, the magenta ink, the yellow ink, and the pigment-based black ink therein.

The light transmitting window portions 79BK, 79C, 79M, 79Y, and 79PBK which configure the light transmitting portion 19 according to Example 5 have light transmission properties, and have a substantially rectangular shape which is vertically long from the upper side to the lower side. In addition, two corners on the lower side of the light transmitting window portions 79BK, 79C, 79M, 79Y, and 79PBK having a substantially rectangular shape are rounded in an arc shape.

In each of the light transmitting window portions 79BK, 79C, 79M, 79Y, and 79PBK, the gradations 31 configured of a horizontal line 82*a* illustrated by a solid line or a horizontal line 82*b* illustrated by a dotted line which goes across the light transmitting window portions 79BK, 79C, 79M, 79Y, and 79PBK, are provided. In addition, the horizontal line 82*a* illustrated by a solid line or the horizontal line 82*b* illustrated by a dotted line which configures the gradation 31 may be any color tone, such as individual colors which correspond to each of the ink colors, unified black color, or an outlined character.

The reference marks 32 which are provided in the outer edge portion 30 below the light transmitting window portions 79BK, 79C, 79M, 79Y, and 79PBK include marks 42BK, 42C, 42M, 42Y, and 42PBK. The mark 42BK provided below the light transmitting window portion 79BK is provided with "BK" that indicates the black ink in a substantial quadrangular frame of the black-based color. The mark 42C provided below the light transmitting window portion 79C is provided with "C" that indicates the cyan ink in a substantial quadrangular frame of the blue-based color. The mark 42M provided below the light transmitting window portion 79M is provided with "M" that indicates the magenta ink in a substantial quadrangular frame of the red-based color. The mark 42Y provided below the light transmitting window portion 79Y is provided with "Y" that indicates the yellow ink in a substantial quadrangular frame of the yellow-based color. The mark 42PBK provided below the light transmitting window portion 79PBK is provided with "PBK" that indicates the pigment-based black ink in a substantial quadrangular frame of the black-based color. In addition, in each of the substantial quadrangular frames, the frame line may be provided at the outer edge thereof.

5.6. Example 6

Figure 16:
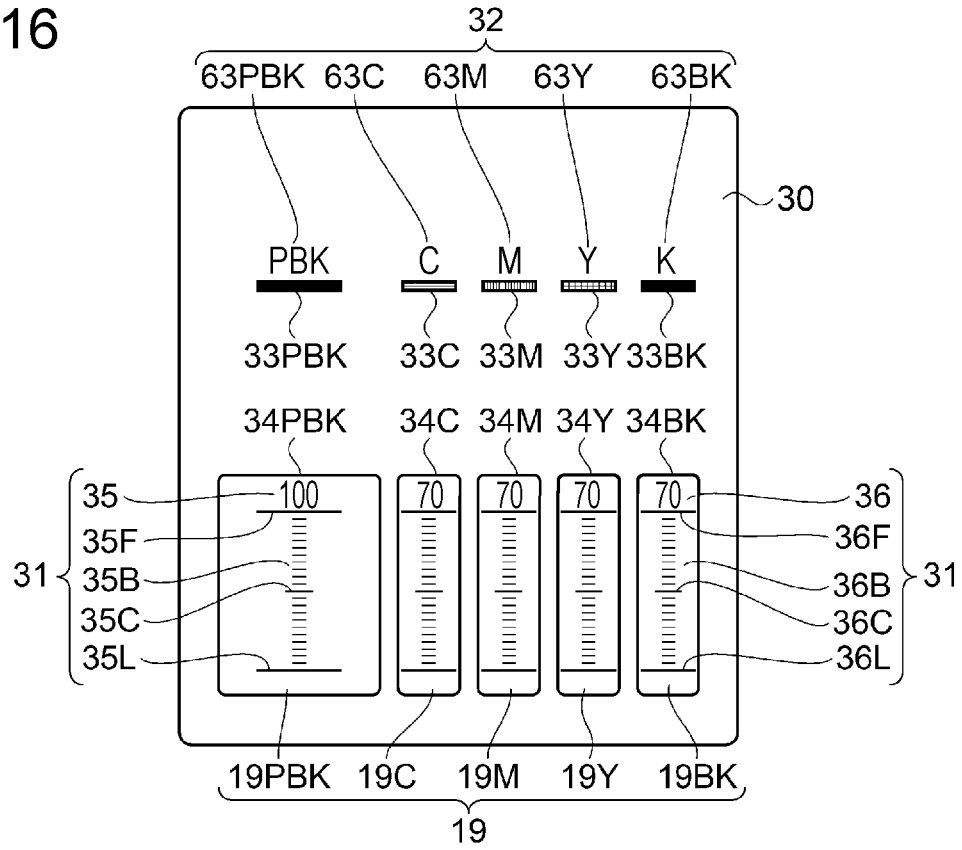
FIG. 16 is a front view illustrating light transmitting portions, gradations, and reference marks according to Example 6.

Light transmitting portions, gradations, and reference marks according to Example 6 will be described with reference to FIG. 16. In Example 6, as illustrated in FIG. 16, numerical gradations illustrating the capacity of the tank of each of the tanks 21 (refer to FIG. 4) are provided in the light transmitting window portions 19PBK, 19C, 19M, 19Y, and 19BK, and the reference marks 32 are provided in the outer edge portion 30 above the light transmitting window portions 19PBK, 19C, 19M, 19Y, and 19BK. The outer edge portion 30 is a region provided on the outer side of the light transmitting window portions 19PBK, 19C, 19M, 19Y, and 19BK. In addition, in the example, the light transmitting window portion 19PBK, the light transmitting window portion 19C, the light transmitting window portion 19M, the light transmitting window portion 19Y, and the light transmitting window portion 19BK oppose the tanks 21 (refer to FIG. 4) which respectively accommodate the pigment-based black ink, the cyan ink, the magenta ink, the yellow ink, and the black ink therein.

The light transmitting window portions 19PBK, 19C, 19M, 19Y, and 19BK which configure the light transmitting portion 19 according to Example 6 have light transmission properties, and have a substantially rectangular shape which is vertically long from the upper side to the lower side. In addition, four corners of the light transmitting window portions 19PBK, 19C, 19M, 19Y, and 19BK having a substantially rectangular shape are rounded in an arc shape. In addition, the light transmitting window portions 19PBK, 19C, 19M, 19Y, and 19BK can be provided with outlines 34PBK, 34C, 34M, 34Y, and 34BK that surround the outer edge thereof.

In the light transmitting window portion 19PBK, a numerical gradation 35 which indicates the capacity of the tank of the tank 21 (refer to FIG. 4) that accommodates the pigment-based black ink, and gradation lines 35F, 35L, 35C, and 35B are provided. In addition, the numerical gradation 35 is illustrated by a numerical value of "100" as the maximum value of the tank 21 which accommodates the pigment-based black ink therein.

In each of the light transmitting window portions 19C, 19M, 19Y, and 19BK, a numerical gradation 36 which indicates the capacity of the tank 21 that accommodates the corresponding ink, and gradation lines 36F, 36L, 36C, and 36B, are provided. In addition, the numerical gradation 36 is illustrated by a numerical value of "70" as the maximum value of the tanks 21 which respectively accommodate the cyan ink, the magenta ink, the yellow ink, and the black ink therein.

In addition, the numerical gradations 35 and 36 which configure the gradation 31 and the gradation lines 35F, 35L, 35C, 35B, 36F, 36L, 36C, and 36B may be any color tone, such as individual colors which correspond to each of the ink colors, unified black color, or an outlined character.

The reference marks 32 of the example illustrate the types of the ink which are accommodated in each of the five tanks 21, the marks 63PBK, 63C, 63M, 63Y, 63BK are disposed above the light transmitting window portions 19PBK, 19C, 19M, 19Y, and 19BK, and the marks 33PBK, 33C, 33M, 33Y, and 33BK illustrated by a horizontal line are disposed on the upper side thereof. Specifically, for example, the mark 63PBK and the mark 33PBK of "PBK" that indicates the pigment-based black ink, the mark 63C and the mark 33C of "C" that indicates the cyan ink, the mark 63M and the mark 33M of "M" that indicates the magenta ink, the mark 63Y and the mark 33Y of "Y" that indicates the yellow ink, and the mark 63BK and the mark 33BK of "BK" that indicates the black ink, are included. In addition, coloring which corresponds to the color of the ink is performed such that the mark 33PBK is colored by the black-based color, the mark 33C is colored by the blue-based color, the mark 33M is colored by the red-based color, the mark 33Y is colored by the yellow-based color, and the mark 33BK is colored by the black-based color. In addition, the marks 63PBK, 63C, 63Y, 63M, and 63BK may be any color tone, such as individual colors which correspond to each of the ink colors, unified black color, or an outlined character.

5.7. Example 7

Figure 17:
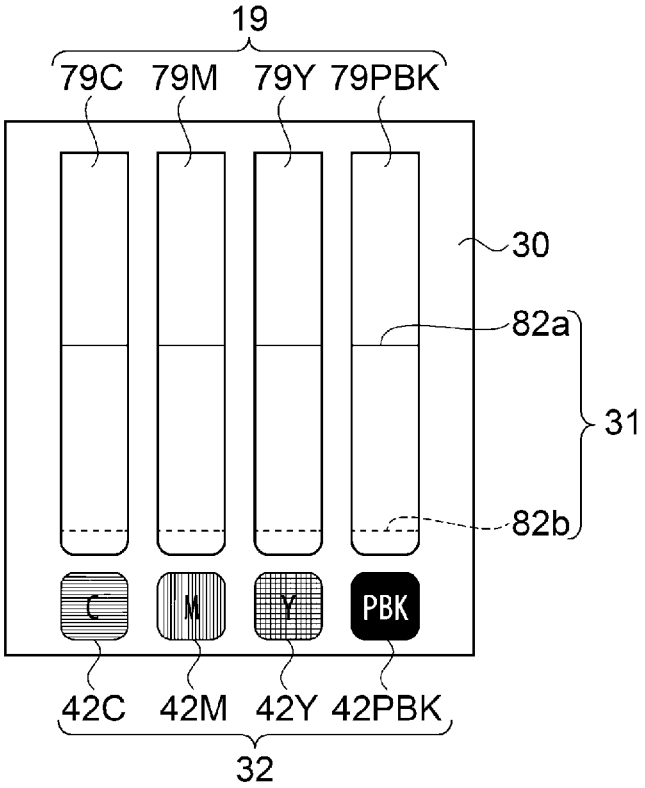
FIG. 17 is a front view illustrating light transmitting portions, gradations, and reference marks according to Example 7.

Light transmitting portions, gradations, and reference marks according to Example 7 will be described with reference to FIG. 17. In Example 7, as illustrated in FIG. 17, the reference marks 32 colored corresponding to the colors of the ink in the outer edge portion 30 below the light transmitting window portions 79C, 79M, 79Y, and 79PBK, are provided. The outer edge portion 30 is a region provided on the outer side of the light transmitting window portions 79C, 79M, 79Y, and 79PBK. In addition, in the example, the light transmitting window portion 79C, the light transmitting window portion 79M, the light transmitting window portion 79Y, and the light transmitting window portion 79PBK oppose the tanks 21 (refer to FIG. 4) which respectively accommodate the cyan ink, the magenta ink, the yellow ink, and the pigment-based black ink therein.

The light transmitting window portions 79C, 79M, 79Y, and 79PBK which configure the light transmitting portion 19 according to Example 7 have light transmission properties, and have a substantially rectangular shape which is vertically long from the upper side to the lower side. In addition, two corners on the lower side of the light transmitting window portions 79C, 79M, 79Y, and 79PBK having a substantially rectangular shape are rounded in an arc shape.

In each of the light transmitting window portions 79C, 79M, 79Y, and 79PBK, the gradation 31 configured of the horizontal line 82*a* illustrated by a solid line or the horizontal line 82*b* illustrated by a dotted line which goes across the light transmitting window portion 79C, 79M, 79Y, and 79PBK, is provided. In addition, the horizontal line 82*a* illustrated by a solid line or the horizontal line 82*b* illustrated by a dotted line which configures the gradation 31 may be any color tone, such as individual colors which correspond to each of the ink colors, unified black color, or an outlined character.

The reference marks 32 which are provided in the outer edge portion 30 below the light transmitting window portions 79C, 79M, 79Y, and 79PBK include the marks 42C, 42M, 42Y, and 42PBK. The mark 42C provided below the light transmitting window portion 79C is provided with "C" that indicates the cyan ink in a substantial quadrangular frame having the blue-based color. The mark 42M provided below the light transmitting window portion 79M is provided with "M" that indicates the magenta ink in a substantial quadrangular frame having the red-based color. The mark 42Y provided below the light transmitting window portion 79Y is provided with "Y" that indicates the yellow ink in a substantial quadrangular frame having the yellow-based color. The mark 42PBK provided below the light transmitting window portion 79PBK is provided with "PBK" that indicates the pigment-based black ink in a substantial quadrangular frame having the black-based color. In addition, in each of the substantial quadrangular frames, the frame line may be provided at the outer edge thereof.

5.8. Example 8

Figure 18:
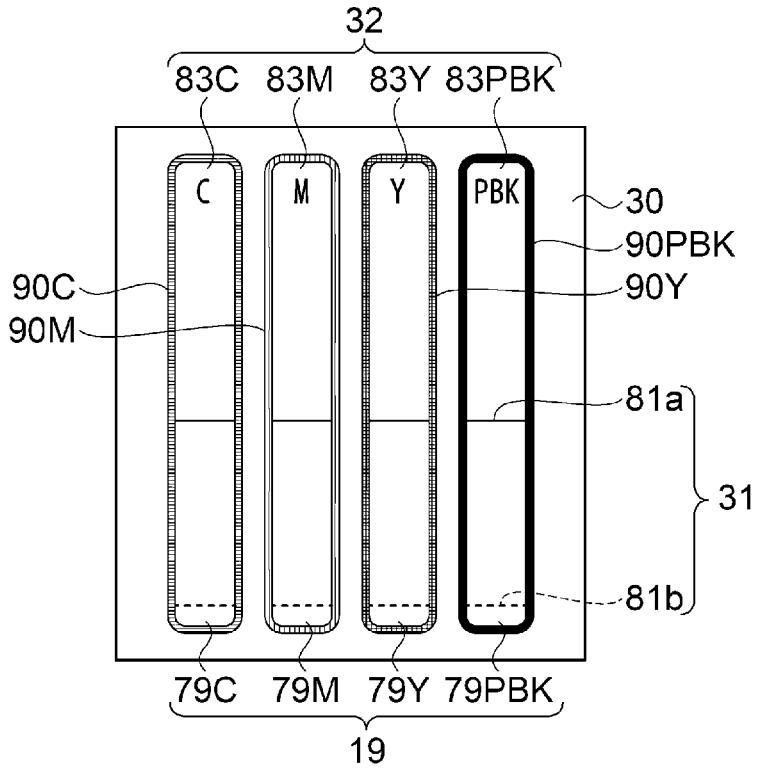
FIG. 18 is a front view illustrating light transmitting portions, gradations, and reference marks according to Example 8.

Light transmitting portions, gradations, and reference marks according to Example 8 will be described with reference to FIG. 18. In Example 8, as illustrated in FIG. 18, the light transmitting window portions 79C, 79M, 79Y, and 79PBK provided with color line frames (hereinafter, referred to as the outlines 90C, 90M, 90Y, and 90PBK) are included. In addition, in the example, the light transmitting window portion 79C, the light transmitting window portion 79M, the light transmitting window portion 79Y, and the light transmitting window portion 79PBK oppose the tanks 21 (refer to FIG. 4) which respectively accommodate the cyan ink, the magenta ink, the yellow ink, and the pigment-based black ink therein. In addition, on the outer side of the light transmitting window portions 79C, 79M, 79Y, and 79PBK, the outer edge portion 30 is provided.

The light transmitting window portions 79C, 79M, 79Y, and 79PBK which configure the light transmitting portion 19 according to Example 8 have light transmission properties, and have a substantially rectangular shape which is vertically long from the upper side to the lower side. In addition, four corners of the light transmitting window portions 79C, 79M, 79Y, and 79PBK having a substantially rectangular shape are rounded in an arc shape. In addition, at the outer edges of each of the light transmitting window portions 79C, 79M, 79Y, and 79PBK, the outlines 90C, 90M, 90Y, and 90PBK which are arranged along the outer edge are provided.

The outlines 90C, 90M, 90Y, and 90PBK are respectively colored by the colors which have the same base as each of the colors of the corresponding ink. Specifically, the blue-based color is used in the outline 90C arranged in the light transmitting window portion 79C which corresponds to the cyan ink, the red-based color is used in the outline 90M arranged in the light transmitting window portion 79M which corresponds to the magenta ink, the yellow-based color is used in the outline 90Y arranged in the light transmitting window portion 79Y which corresponds to the yellow ink, and the black-based color is used in the outline 90PBK arranged in the light transmitting window portion 79PBK which corresponds to the pigment-based black ink, respectively.

In the light transmitting window portions 79C, 79M, 79Y, and 79PBK, the gradations 31 configured of the horizontal line 81*a* illustrated by a solid line or the horizontal line 81*b* illustrated by a dotted line, and the reference marks 32 including the marks 83C, 83M, 83Y, and 83PBK, are provided.

The reference mark 32 including the marks 83C, 83M, 83Y, and 83PBK includes the mark 83C of "C" which is provided in the light transmitting window portion 79C and indicates the cyan ink, the mark 83M of "M" which is provided in the light transmitting window portion 79M and indicates the magenta ink, the mark 83Y of "Y" which is provided in the light transmitting window portion 79Y and indicates the yellow ink, and the mark 83PBK of "PBK" which is provided in the light transmitting window portion 79PBK and indicates the pigment-based black ink.

In addition, the horizontal line 81*a* illustrated by a solid line or the horizontal line 81*b* illustrated by a dotted line which configures the gradation 31, and the marks 83C, 83M, 83Y, and 83PBK may be any color tone, such as individual colors which correspond to each of the ink colors, unified black color, or an outlined character.

5.9. Example 9

Figure 19:
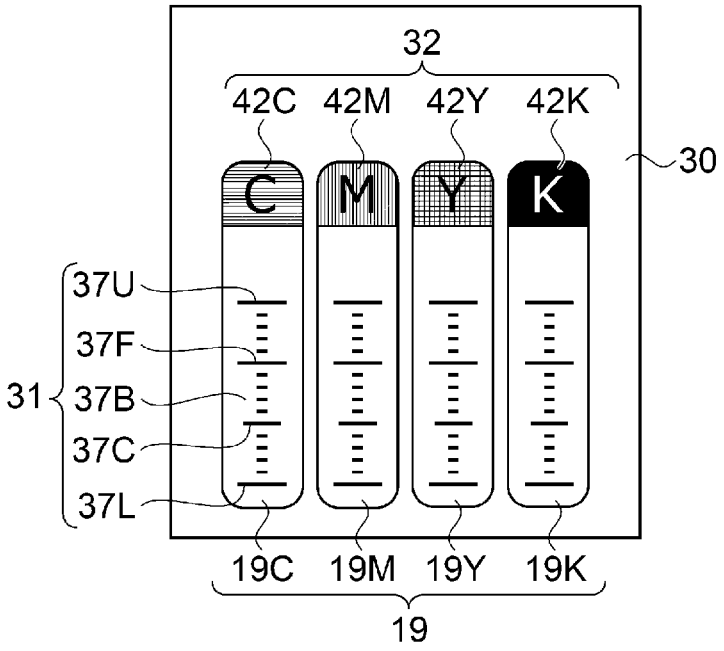
FIG. 19 is a front view illustrating light transmitting portions, gradations, and reference marks according to Example 9.

Light transmitting portions, gradations, and reference marks according to Example 9 will be described with reference to FIG. 19. In Example 9, as illustrated in FIG. 19, the reference marks 32 are provided in an end portion above the light transmitting window portions 19C, 19M, 19Y, and 19K. In addition, in the example, the light transmitting window portion 19C, the light transmitting window portion 19M, the light transmitting window portion 19Y, and the light transmitting window portion 19K oppose the tanks 21 (refer to FIG. 4) which respectively accommodate the cyan ink, the magenta ink, the yellow ink, and the black ink therein. In addition, on the outer side of the light transmitting window portions 19C 19M, 19Y, and 19K, the outer edge portion 30 is provided.

The light transmitting window portions 19C, 19M, 19Y, and 19K which configure the light transmitting portion 19 according to Example 9 have light transmission properties, and have a substantially rectangular shape which is vertically long from the upper side to the lower side. In addition, four corners of the light transmitting window portions 19C, 19M, 19Y, and 19K having a substantially rectangular shape are rounded in an arc shape.

In each of the light transmitting window portions 19C, 19M, 19Y, and 19K, as the gradation 31, for example, an upper limit gradation 37U illustrated by a horizontal line, an upper gradation 37F illustrated by a horizontal line, an intermediate gradation 37C, a lower limit gradation 37L illustrated by a horizontal line, and a subdivided gradation 37B which is provided between each of the upper limit gradation 37U, the upper gradation 37F, the intermediate gradation 37C, and the lower limit gradation 37L, are arranged. In addition, the intermediate gradation 37C is configured by a horizontal line which is slightly shorter than the upper gradation 37F and the lower limit gradation 37L.

In addition, the upper limit gradation 37U, the upper gradation 37F, the intermediate gradation 37C, the lower limit gradation 37L, and the subdivided gradation 37B which configure the gradation 31 may be any color tone, such as individual colors which correspond to each of the ink colors, unified black color, or an outlined character.

The reference marks 32 provided in the end portion of the upper side of the light transmitting window portions 19C, 19M, 19Y, and 19K include the marks 42C, 42M, 42Y, and 42K. The mark 42C provided on the upper side of the light transmitting window portion 19C is provided with "C" that indicates the cyan ink on the background having the blue-based color. The mark 42M provided on the upper side of the light transmitting window portion 19M is provided with "M" that indicates the magenta ink on the background having the red-based color. The mark 42Y provided on the upper side of the light transmitting window portion 19Y is provided with "Y" that indicates the yellow ink on the background having the yellow-based color. The mark 42K provided on the upper side of the light transmitting window portion 19K is provided with "K" that indicates the black ink on the background having the black-based color. In addition, in each of the substantial quadrangular frames, the frame line may be provided at the outer edge thereof.

5.10. Example 10

Figure 20:
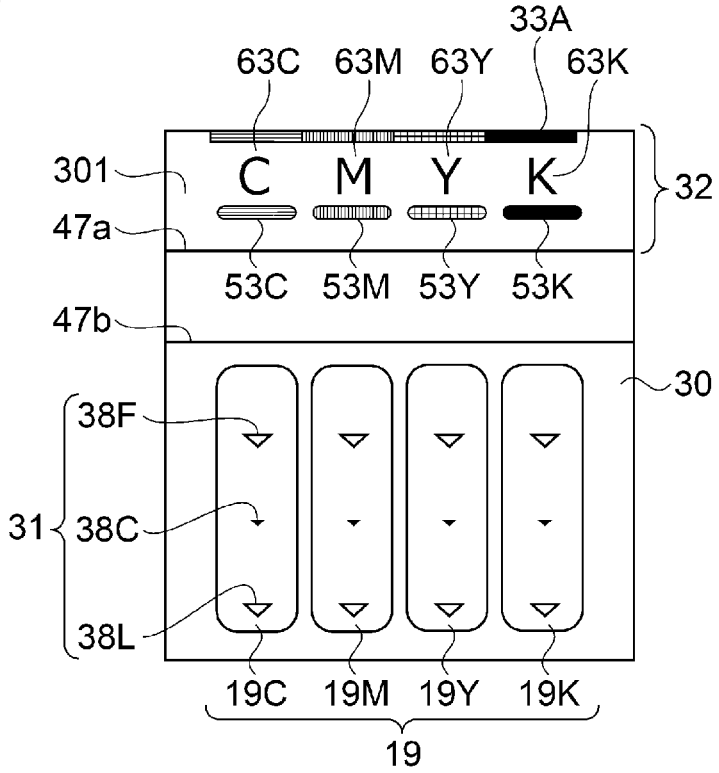
FIG. 20 is a front view illustrating light transmitting portions, gradations, and reference marks according to Example 10.

Light transmitting portions, gradations, and reference marks according to Example 10 will be described with reference to FIG. 20. In Example 10, as illustrated in FIG. 20, the outer edge portion 30 is provided at a part other than the light transmitting window portions 19C, 19M, 19Y, and 19K. In addition, the outer edge portion 30 above the light transmitting window portions 19C, 19M, 19Y, and 19K is divided into three by a first division line 47*a* and a second division line 47*b*. In addition, the reference mark 32 including a color line 33A is provided in a divided region 301 divided above the first division line 47*a*. In addition, in the example, the light transmitting window portion 19C, the light transmitting window portion 19M, the light transmitting window portion 19Y, and the light transmitting window portion 19K oppose the tanks 21 (refer to FIG. 4) which respectively accommodate the cyan ink, the magenta ink, the yellow ink, and the black ink therein.

The light transmitting window portions 19C, 19M, 19Y, and 19K which configure the light transmitting portion 19 according to Example 10 have light transmission properties, and have a substantially rectangular shape which is vertically long from the upper side to the lower side. In addition, four corners of the light transmitting window portions 19C, 19M, 19Y, and 19K having a substantially rectangular shape are rounded in an arc shape.

In each of the light transmitting window portions 19C, 19M, 19Y, and 19K, as the gradation 31, for example, an upper limit gradation 38F or a lower limit gradation 38L illustrated by triangular marks, and an intermediate gradation 38C illustrated by a small triangular mark, are arranged. In addition, the upper limit gradation 38F, the lower limit gradation 38L, and the intermediate gradation 38C which configure the gradation 31 may be any color tone, such as individual colors which correspond to each of the ink colors, unified black color, or an outlined character.

The reference marks 32 provided in the region 301 illustrate the types of the ink accommodated in each of the four tanks 21, and include the marks 63C, 63M, 63Y, and 63K which correspond to each of the light transmitting window portions 19C, 19M, 19Y, and 19K, track-like horizontal line marks 53C, 53M, 53Y, and 53K which are disposed below the marks 63C, 63M, 63Y, and 63K, and the color line 33A disposed above the marks 63C, 63M, 63Y, and 63K.

Specifically, the mark 63C and the horizontal line mark 53C of "C" that indicates the cyan ink, the mark 63M and the horizontal line mark 53M of "M" that indicates the magenta ink, the mark 63Y and the horizontal line mark 53Y of "Y" that indicates the yellow ink, and the mark 63K and the horizontal line mark 53K of "K" that indicates the black ink, are disposed. In addition, the marks and the horizontal line marks are colored corresponding to the colors of the ink such that the mark 63C and the horizontal line mark 53C are colored by the blue-based color, the mark 63M and the horizontal line mark 53M are colored by the red-based color, the mark 63Y and the horizontal line mark 53Y are colored by the yellow-based color, and the mark 63K and the horizontal line mark 53K are colored by the black-based color.

The color line 33A corresponds to the marks 63C, 63M, 63Y, and 63K, and is divided by colors having the same base as each of the colors. In the example, the colors are arranged in an order of the blue-based color which corresponds to the mark 63C, the red-based color which corresponds to the mark 63M, the yellow-based color which corresponds to the mark 63Y, and the black-based color which corresponds to the mark 63K.

5.11. Example 11

Figure 21:
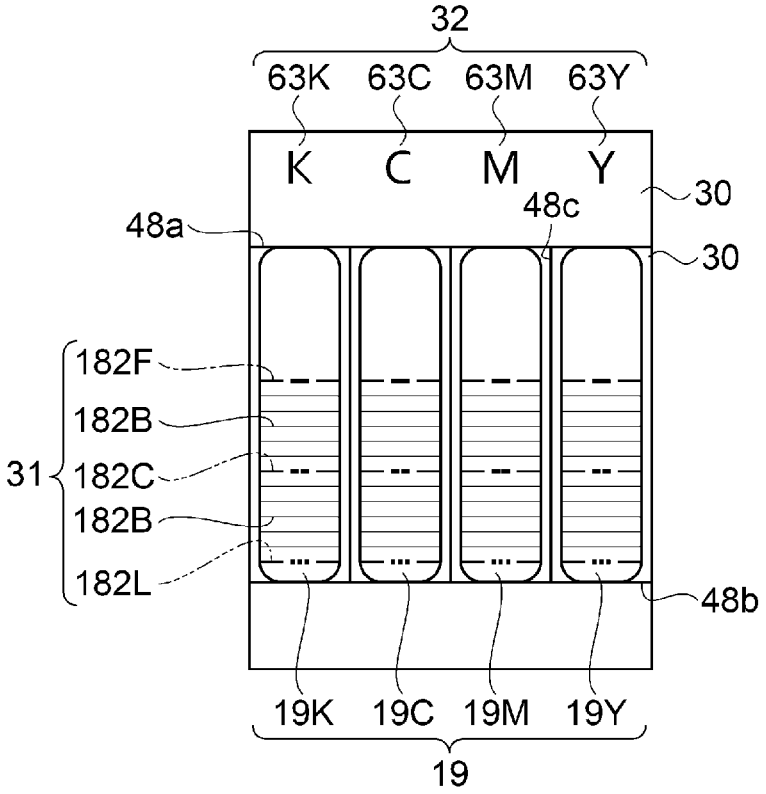
FIG. 21 is a front view illustrating light transmitting portions, gradations, and reference marks according to Example 11.

Light transmitting portions, gradations, and reference marks according to Example 11 will be described with reference to FIG. 21. In Example 11, as illustrated in FIG. 21, the gradations 31 illustrated by horizontally long lines which go through the light transmitting window portions 19C, 19M, 19Y, and 19K that serve as a standard of the residual amount of the ink, are provided in the light transmitting window portions 19K, 19C, 19M, and 19Y. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 11 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by a first division line 48*a* which binds the outer edge on the upper side of each of the light transmitting window portions, a second division line 48*b* which binds the outer edge on the lower side of each of the light transmitting window portions, and a third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, an upper limit gradation 182F illustrated by a horizontally long one-dot chain line or a lower limit gradation 182L illustrated by a horizontally long three-dot chain line which goes across the light transmitting window portions 19K, 19C, 19M, and 19Y, an intermediate gradation 182C illustrated by a horizontally long two-dot chain line, and a subdivided gradation 182B provided between the intermediate gradation 182C, and the upper limit gradation 182F and the lower limit gradation 182L, are arranged. In addition, the upper limit gradation 182F, the lower limit gradation 182L, the intermediate gradation 182C, and the subdivided gradation 182B which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include the marks 63K, 63C, 63M, and 63Y which correspond to each of the light transmitting window portions 19K, 19C, 19M, and 19Y. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.12. Example 12

Figure 22:
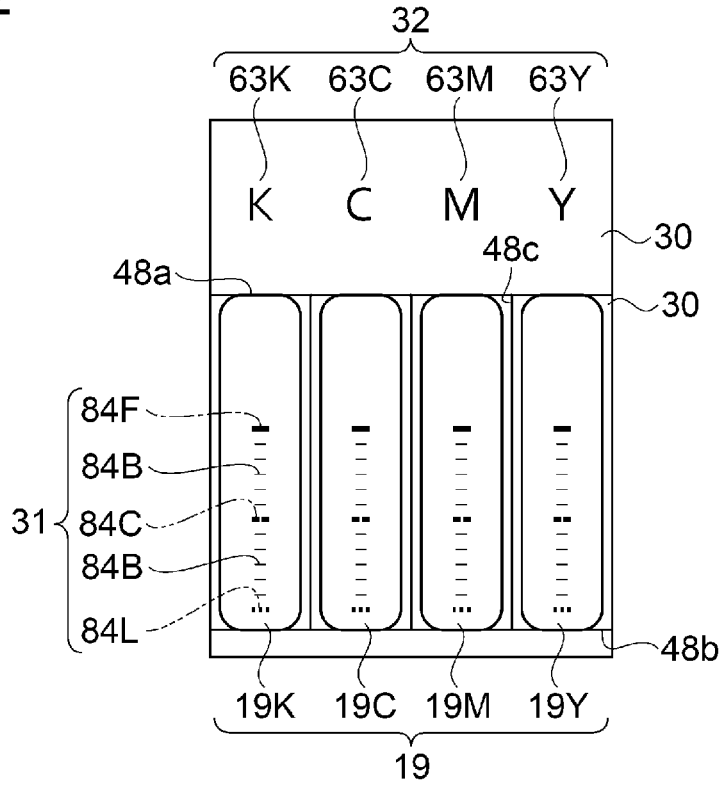
FIG. 22 is a front view illustrating light transmitting portions, gradations, and reference marks according to Example 12.

Light transmitting portions, gradations, and reference marks according to Example 12 will be described with reference to FIG. 22. In Example 12, as illustrated in FIG. 22, the gradations 31 illustrated by horizontally long lines which are short and serve as a standard of the residual amount of the ink, are provided in the light transmitting window portions 19K, 19C, 19M, and 19Y. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 12 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, an upper limit gradation 84F illustrated by one horizontally long dot and a lower limit gradation 84L illustrated by three horizontally long dots, an intermediate gradation 84C illustrated by two horizontally long dots, and a subdivided gradation 84B provided between the intermediate gradation 84C, and the upper limit gradation 84F and the lower limit gradation 84L, are arranged. In addition, the upper limit gradation 84F, the lower limit gradation 84L, the intermediate gradation 84C, and the subdivided gradation 84B which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include the marks 63K, 63C, 63M, and 63Y which correspond to each of the light transmitting window portions 19K, 19C, 19M, and 19Y. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.13. Example 13

Figure 23:
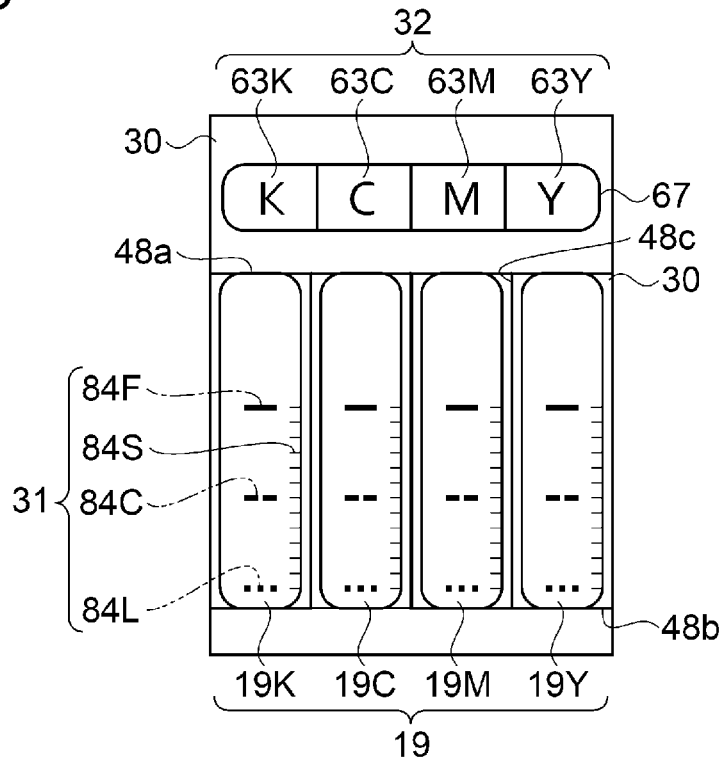
FIG. 23 is a front view illustrating light transmitting portions, gradations, and reference marks according to Example 13.

Light transmitting portions, gradations, and reference marks according to Example 13 will be described with reference to FIG. 23. In Example 13, as illustrated in FIG. 23, the reference mark 32 provided with the marks 63K, 63C, 63M, and 63Y which correspond to each of the light transmitting window portions 19K, 19C, 19M, and 19Y, are provided in each of the regions divided into four by a horizontally long belt-like frame 67. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 13 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, the upper limit gradation 84F illustrated by one horizontally long dot and the lower limit gradation 84L illustrated by three horizontally long dots, and the intermediate gradation 84C illustrated by two horizontally long dots, are arranged. In addition, a subdivided gradation 84S is disposed along one vertical frame of the light transmitting window portions 19K, 19C, 19M, and 19Y. In addition, the upper limit gradation 84F, the lower limit gradation 84L, the intermediate gradation 84C, and the subdivided gradation 84S which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include the marks 63K, 63C, 63M, and 63Y which correspond to each of the light transmitting window portions 19K, 19C, 19M, and 19Y in each of the regions obtained by dividing the horizontally long belt-like frame 67 into four (a shape of which four corners of the rectangular shape are rounded in the example). Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.14. Example 14

Figure 24:
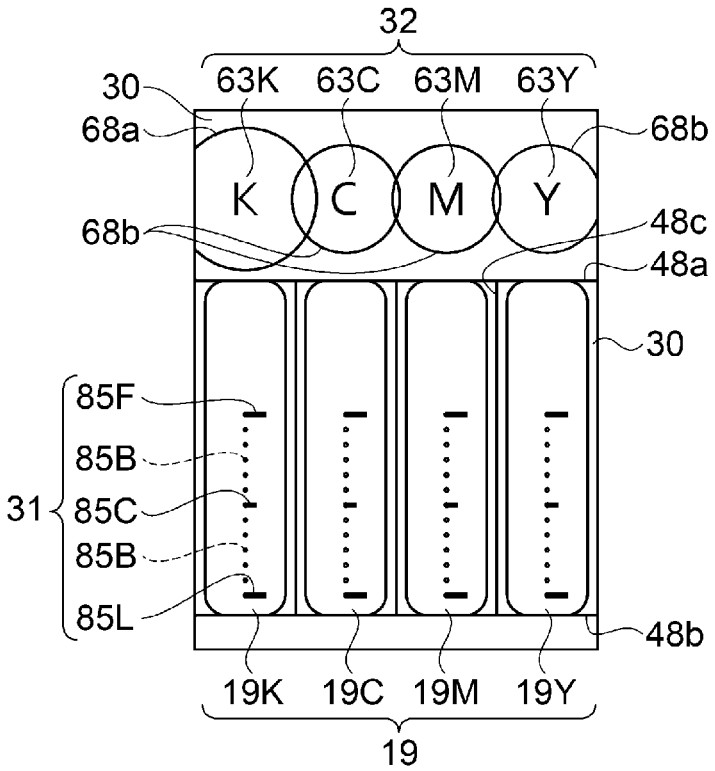
FIG. 24 is a front view illustrating light transmitting portions, gradations, and reference marks according to Example 14.

Light transmitting portions, gradations, and reference marks according to Example 14 will be described with reference to FIG. 24 In Example 14, as illustrated in FIG. 24, the reference mark 32 provided with the marks 63K, 63C, 63M, and 63Y which correspond to each of the light transmitting window portions 19K, 19C, 19M, and 19Y, are provided in each of the frames divided into four by ripple style frame lines 68*a* and 68*b*. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 14 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, an upper limit gradation 85F or a lower limit gradation 85L which is illustrated by a horizontally long solid line, an intermediate gradation 85C illustrated by a solid line which is slightly shorter than the upper limit gradation 85F, and a subdivided gradation 85B provided in a shape of a dot between the intermediate gradation 85C, and the upper limit gradation 85F and the lower limit gradation 85L, are arranged. In addition, the upper limit gradation 85F, the lower limit gradation 85L, and the intermediate gradation 85C are disposed to be shifted from the center in the width direction of the light transmitting window portions 19K, 19C, 19M, and 19Y, that is, to be shifted to the right side in the example. In addition, the upper limit gradation 85F, the lower limit gradation 85L, the intermediate gradation 85C, and the subdivided gradation 85B, which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, the mark 63K which corresponds to the light transmitting window portion 19K is disposed in the large frame divided by the frame line 68*a*, and the marks 63C, 63M, and 63Y which correspond to each of the light transmitting window portions 19C, 19M, and 19Y are disposed in the three relatively small frames divided by the frame line 68*b*. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.15. Example 15

Figure 25:
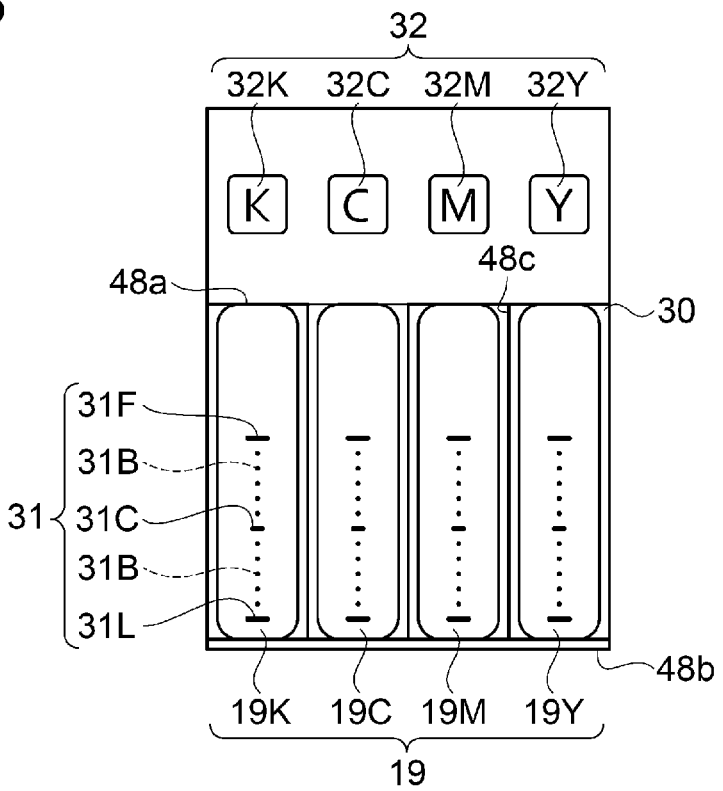
FIG. 25 is a front view illustrating light transmitting portions, gradations, and reference marks according to Example 15.

Light transmitting portions, gradations, and reference marks according to Example 15 will be described with reference to FIG. 25. In Example 15, as illustrated in FIG. 25, for example, the reference mark 32 including a mark 32K provided with "K" in the square and round outlined □, or the like, is provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 15 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, the upper gradation 31F or the lower limit gradation 31L which is illustrated by a horizontally long solid line, the intermediate gradation 31C illustrated by a solid line which is slightly shorter than the upper gradation 31F, and the subdivided gradation 31B provided in a shape a dot between the intermediate gradation 31C, and the upper gradation 31F and the lower limit gradation 31L, are arranged. In addition, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include the mark 32K of "K in the square and round outlined □" that indicates the black ink, the mark 32C of "C in a square and round outlined □" that indicates the cyan ink, the mark 32M of "M in a square and round outlined □" that indicates the magenta ink, and the mark 32Y of "Y in a square and round outlined □" that indicates the yellow ink. In addition, the marks 32K, 32C, 32M, and 32Y may be any color tone, such as individual colors which correspond to each of the ink colors, unified black color, or an outlined character.

5.16. Example 16

Figure 26:
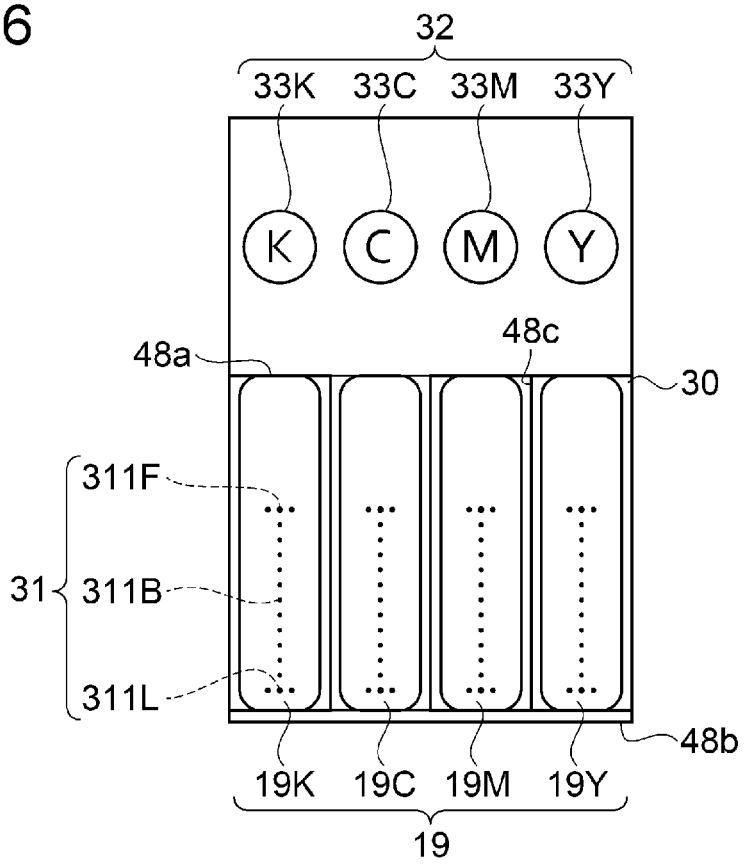
FIG. 26 is a front view illustrating light transmitting portions, gradations, and reference marks according to Example 16.

Light transmitting portions, gradations, and reference marks according to Example 16 will be described with reference to FIG. 26. In Example 16, as illustrated in FIG. 26, for example, the reference mark 32 including a mark 33K provided with "K" in the outlined ○, or the like, is provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 16 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, an upper limit gradation 311F or a lower limit gradation 311L which is illustrated by a horizontally aligned three dots, and a subdivided gradation 311B disposed in a shape of a dot between the upper limit gradation 311F and the lower limit gradation 311L, are arranged. In addition, the upper limit gradation 311F, the lower limit gradation 311L, and the subdivided gradation 311B which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.17. Example 17

Figure 27:
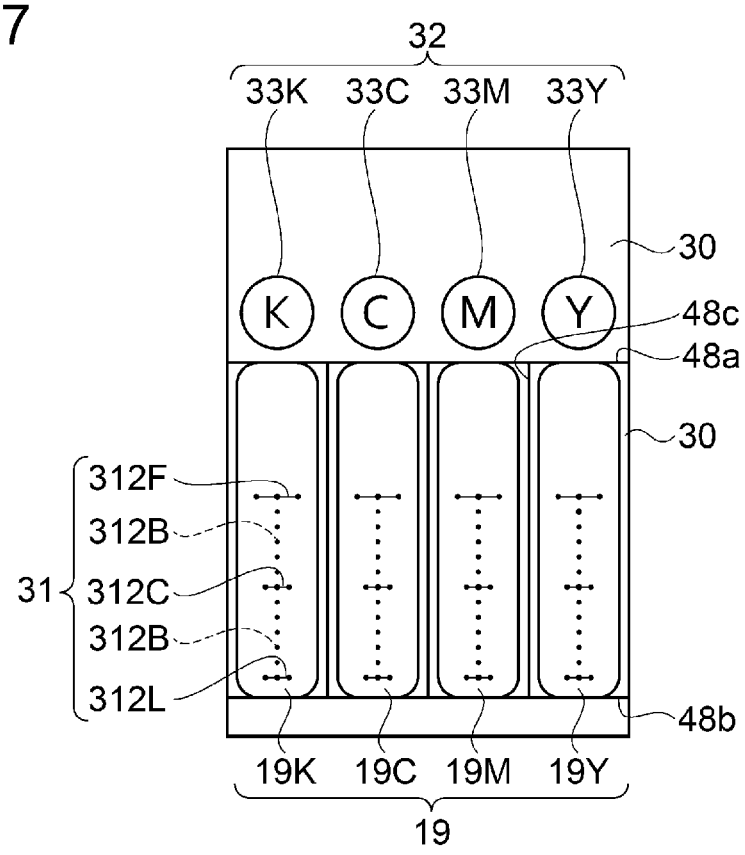
FIG. 27 is a front view illustrating light transmitting portions, gradations, and reference marks according to Example 17.

Light transmitting portions, gradations, and reference marks according to Example 17 will be described with reference to FIG. 27. In Example 17, as illustrated in FIG. 27, for example, the reference mark 32 including the mark 33K provided with "K" in the outlined ○, or the like, and the gradation 31 in which the horizontally aligned dot marks provided in the light transmitting window portions 19K, 19C, 19M, and 19Y are linked to each other by a solid line, and includes, for example, an upper limit gradation 312F, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 17 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, for example, the upper limit gradation 312F, a lower limit gradation 312L, and an intermediate gradation 312C in which the horizontally aligned dot marks are linked to each other by a solid line, and a subdivided gradation 312B disposed between the intermediate gradation 312C and each of the upper limit gradation 312F and the lower limit gradation 312L, are arranged. In addition, the upper limit gradation 312F, the lower limit gradation 312L, and the intermediate gradation 312C or the subdivided gradation 312B which configure the gradation 31, may be a color tone, such as individual colors which correspond to each of the ink colors, unified black color, or an outlined character.

The reference marks 32 provided above the first division line 48*a* illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.18. Example 18

Figure 28:
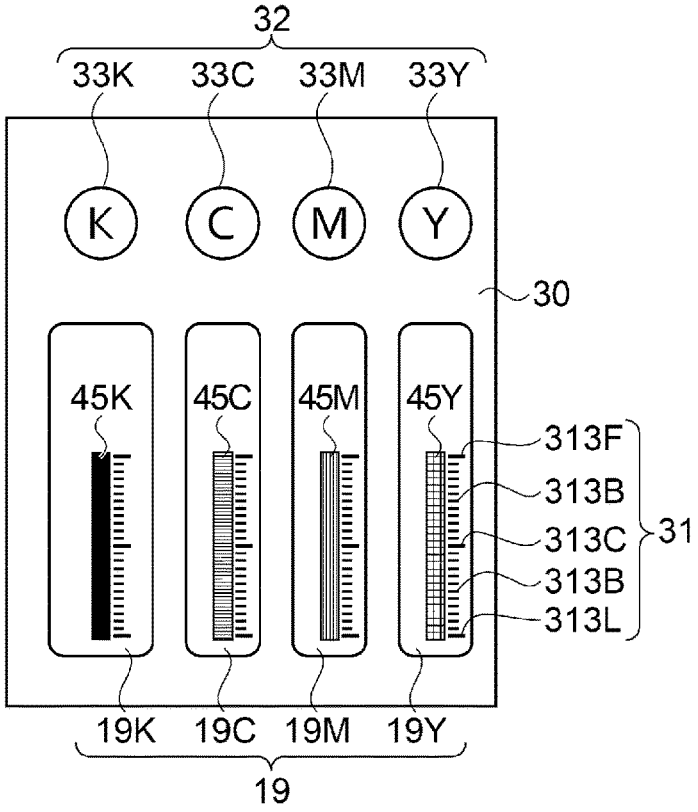
FIG. 28 is a front view illustrating light transmitting portions, gradations, and reference marks according to Example 18.

Light transmitting portions, gradations, and reference marks according to Example 18 will be described with reference to FIG. 28. In Example 18, as illustrated in FIG. 28, for example, the reference mark 32 including the mark 33K provided with "K" in the outlined ○, or the like, and color columns 45K, 45C, 45M, and 45Y which are arranged in the gradations 31 provided in the light transmitting window portions 19K, 19C, 19M, and 19Y, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 18 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape.

In each of the light transmitting window portions 19K, 19C, 19M, and 19Y, an upper limit gradation 313F, a lower limit gradation 313L, an intermediate gradation 313C, and a subdivided gradation 313B disposed between the intermediate gradation 313C and each of the upper limit gradation 313F and the lower limit gradation 313L, are arranged as the gradation 31. In addition, the upper limit gradation 313F, the lower limit gradation 313L, the intermediate gradation 313C, and the subdivided gradation 313B which configure the gradation 31, may be a color tone, such as individual colors which correspond to each of the ink colors, unified black color, or an outlined character.

In each of the light transmitting window portions 19K, 19C, 19M, and 19Y, the vertically long color columns 45K, 45C, 45M, and 45Y which are horizontally aligned in the gradations 31 provided in each of the light transmitting window portions, are provided. The color columns 45K, 45C, 45M, and 45Y are configured of colors that correspond to the types of the ink, and for example, the color column 45K of the light transmitting window portion 19K is configured of the black-based color, the color column 45C of the light transmitting window portion 19C is configured of the blue-based color, the color column 45M of the light transmitting window portion 19M is configured of the red-based color, and the color column 45Y of the light transmitting window portion 19Y is configured of the yellow-based color.

The reference marks 32 provided above the light transmitting window portions 19K, 19C, 19M, and 19Y illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.19. Example 19

Figure 29:
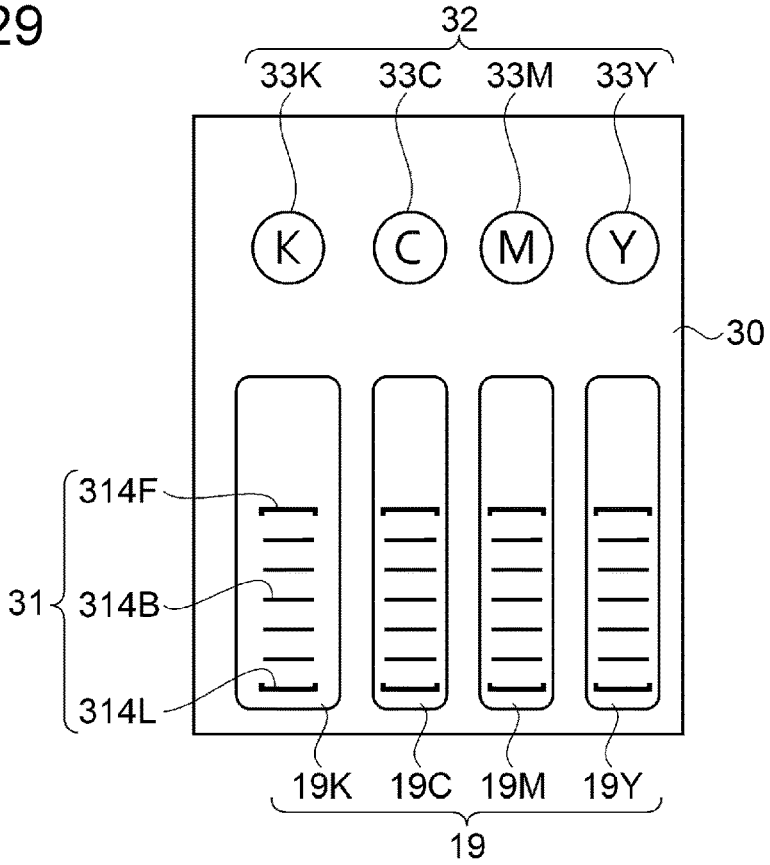
FIG. 29 is a front view illustrating light transmitting portions, gradations, and reference marks according to Example 19.

Light transmitting portions, gradations, and reference marks according to Example 19 will be described with reference to FIG. 29. In Example 19, as illustrated in FIG. 29, for example, the reference mark 32 including the mark 33K provided with "K" in the outlined ○, or the like, and the gradation 31 including an upper limit gradation 314F, a lower limit gradation 314L, and a subdivided gradation 314B which have a shape of a bracket and are provided in the light transmitting window portions 19K, 19C, 19M, and 19Y, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 19 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape.

In each of the light transmitting window portions 19K, 19C, 19M, and 19Y, the upper limit gradation 314F having a shape in which one part of the bracket is disposed to be oriented downward, the lower limit gradation 314L having a shape of which one part of the bracket is disposed to be oriented upward, and the subdivided gradation 314B which is disposed between the upper limit gradation 314F and the lower limit gradation 314L and is illustrated by a horizontally long solid line, are arranged as the gradation 31. In addition, the upper limit gradation 314F, the lower limit gradation 314L, and the subdivided gradation 314B which configure the gradation 31, may be a color tone, such as individual colors which correspond to each of the ink colors, unified black color, or an outlined character.

The reference marks 32 provided above the light transmitting window portions 19K, 19C, 19M, and 19Y illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.20. Example 20

Figure 30:
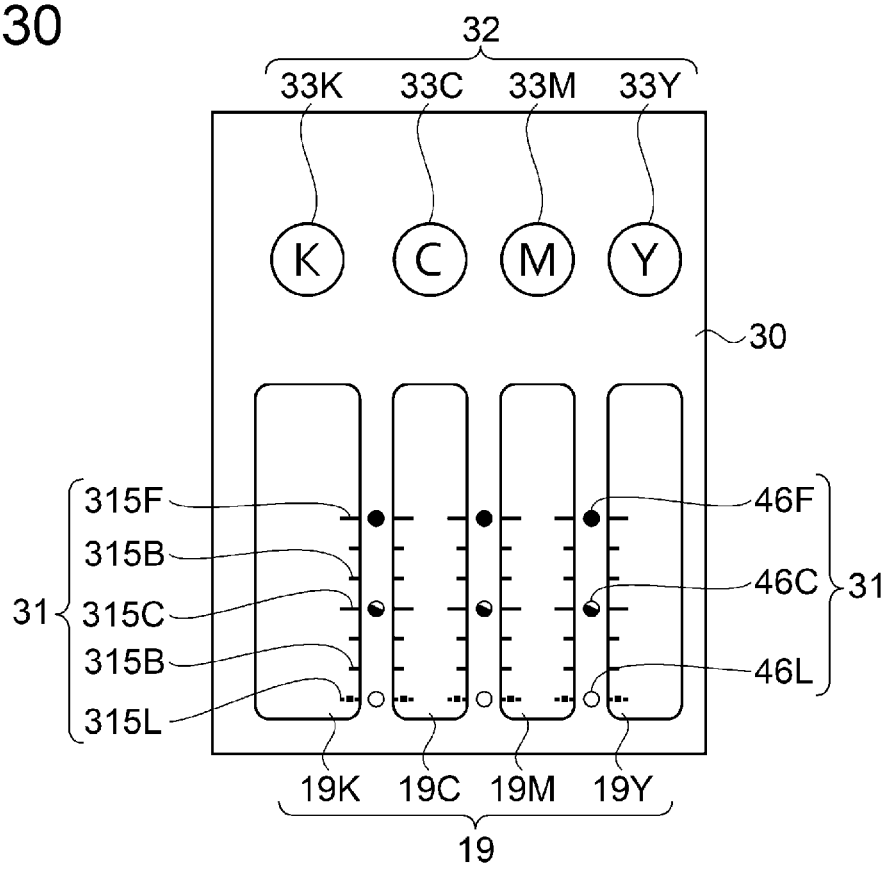
FIG. 30 is a front view illustrating light transmitting portions, gradations, and reference marks according to Example 20.

Light transmitting portions, gradations, and reference marks according to Example 20 will be described with reference to FIG. 30. In Example 20, as illustrated in FIG. 30, for example, the reference mark 32 including the mark 33K provided with "K" in the outlined ○, or the like, and the gradation 31 including an upper limit gradation 315F, an intermediate gradation 315C, and a lower limit gradation 315L which are provided in the light transmitting window portions 19K, 19C, 19M, and 19Y, and circular icons 46F, 46L, and 46C which are provided in the outer edge portion 30 between the light transmitting window portions adjacent to each other, such as the light transmitting window portion 19K and the light transmitting window portion 19C, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 20 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape.

In the light transmitting window portion 19K, along the outer edge on the light transmitting window portion 19C side adjacent thereto, the upper limit gradation 315F, the intermediate gradation 315C, and the lower limit gradation 315L are provided. In the light transmitting window portion 19C and the light transmitting window portion 19M, on both sides along the outer edge in the width direction, the upper limit gradation 315F, the intermediate gradation 315C, and the lower limit gradation 315L are provided. In the light transmitting window portion 19Y, along the outer edge on the light transmitting window portion 19M side adjacent thereto, the upper limit gradation 315F, the intermediate gradation 315C, and the lower limit gradation 315L are provided. In addition, a subdivided gradation 315B disposed between the intermediate gradation 315C and each of the upper limit gradation 315F and the lower limit gradation 315L is provided.

In the outer edge portion 30, at three locations between the upper limit gradation 315F, the intermediate gradation 315C, and the lower limit gradation 315L, and the adjacent upper limit gradation 315F, the intermediate gradation 315C, and the lower limit gradation 315L, the circular icons 46F, 46L, and 46C are provided. The circular icons 46F are disposed at positions horizontally aligned next to the upper limit gradations 315F, and are configured of colored circular marks that indicate a state where the inside of the tank 21 is fully filled with the ink. The circular icons 46L are disposed at positions horizontally aligned next to the lower limit gradations 315L, and are configured of uncolored circular marks that indicate a substantially ink empty state of the inside of the tank 21. The circular icons 46C are disposed at positions horizontally aligned next to the intermediate gradations 315C, and are configured of half-colored circular marks that indicate a state where a substantially half of the inside of the tank 21 is filled with the ink.

In addition, the upper limit gradation 315F, the intermediate gradation 315C, the lower limit gradation 315L, and the subdivided gradation 315B which configure the gradation 31, and the circular icons 46F, 46L, and 46C may be any color tone, such as individual colors which correspond to each of the ink colors, unified black color, or an outlined character.

The reference marks 32 provided above the light transmitting window portions 19K, 19C, 19M, and 19Y illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.21. Example 21

Figure 31:
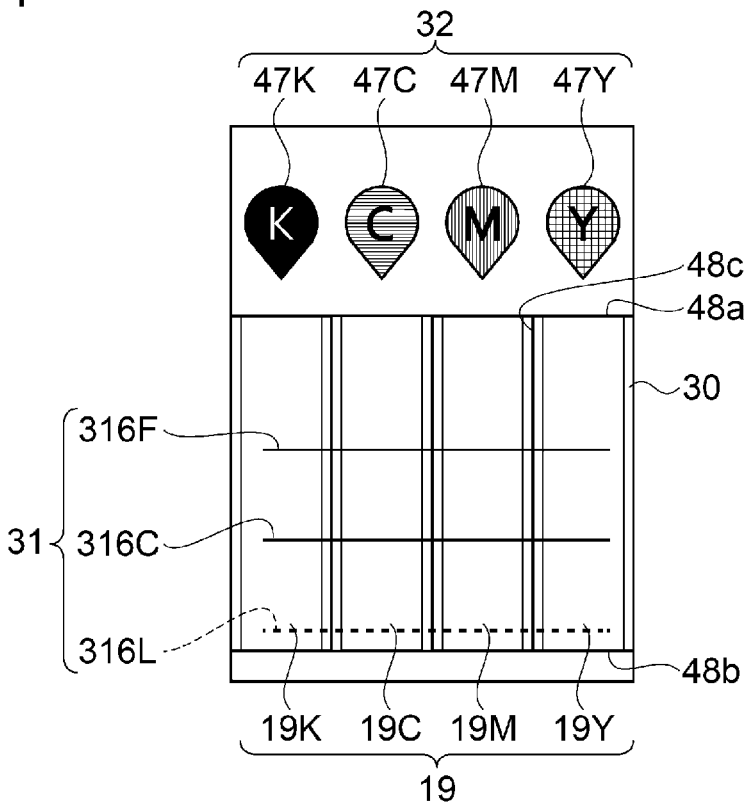
FIG. 31 is a front view illustrating light transmitting portions, gradations, and reference marks according to Example 21.

Light transmitting portions, gradations, and reference marks according to Example 21 will be described with reference to FIG. 31. In Example 21, as illustrated in FIG. 31, for example, the reference mark 32 including a mark 47K that has an arc on an upper side and an angle portion made as extending from the arc and intersecting on a lower side, and is provided with a character, for example, "K", that indicates the type of the ink in a so-called balloon style frame, and the gradation 31 including an upper limit gradation 316F or the like which goes across the light transmitting window portions 19K, 19C, 19M, and 19Y, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 21 have light transmission properties, and have a substantially rectangular shape which is vertically long from the upper side to the lower side. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 316F illustrated by a solid line that goes across the light transmitting window portions 19K, 19C, 19M, and 19Y to be horizontally long, a lower limit gradation 316L illustrated by a dotted line that similarly goes across the light transmitting window portions to be horizontally long, and an intermediate gradation 316C illustrated by a solid line that similarly goes across the light transmitting window portions to be horizontally long, are arranged. In addition, the upper limit gradation 316F, the lower limit gradation 316L, and the intermediate gradation 316C which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include the marks 47K, 47C, 47M, and 47Y configured to have an arc on the upper side and an angle portion made as extending from the arc and intersecting on the lower side, and to be provided with a character that indicates the type of the ink in a so-called balloon style frame. Specifically, the mark 47K in which the character "K" is written in the balloon style frame having the black-based color that indicates the black ink, the mark 47C in which the character "C" is written in the balloon style frame having the blue-based color that indicates the cyan ink, the mark 47M in which the character "M" is written in the balloon style frame having the red-based color that indicates the magenta ink, and the mark 47Y in which the character "Y" is written in the balloon style frame having the yellow-based color that indicates the yellow ink, are provided. In addition, the colors of the characters used in the marks 47K, 47C, 47M, and 47Y may be any color tone, such as unified black color, or an outlined character.

5.22. Example 22

Figure 32:
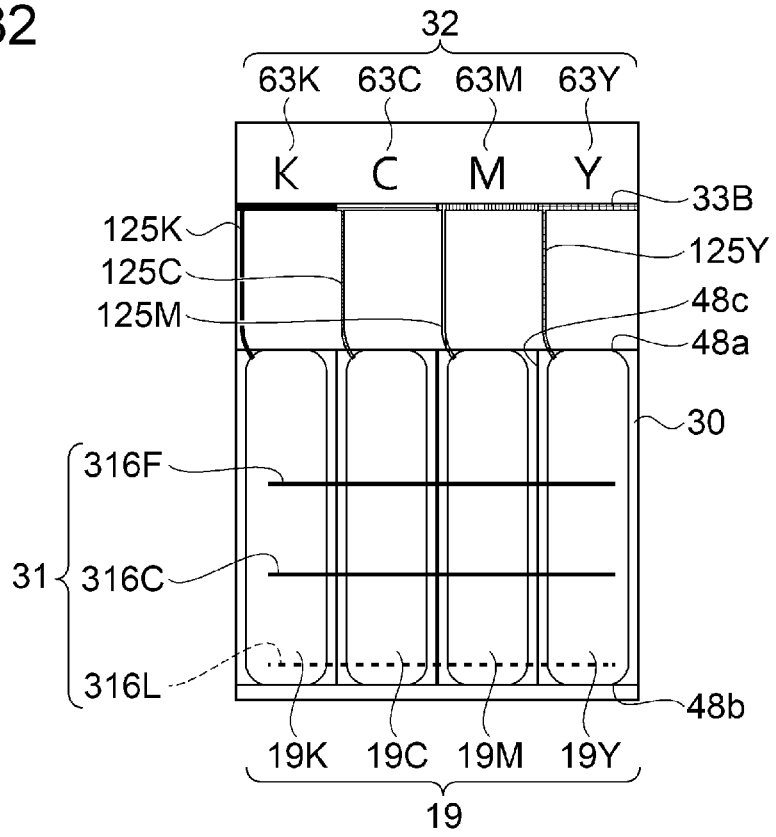
FIG. 32 is a front view illustrating light transmitting portions, gradations, and reference marks according to Example 22.

Light transmitting portions, gradations, and reference marks according to Example 22 will be described with reference to FIG. 32. In Example 22, as illustrated in FIG. 32, the reference mark 32 including the marks 63K, 63C, 63M, and 63Y which illustrate the types of the ink corresponding to each of the light transmitting window portions 19K, 19C, 19M, and 19Y, a color line 33B disposed below the marks 63K, 63C, 63M, and 63Y, and vertically long lines 125K, 125C, 125M, and 125Y which extend downward from the color line 33B, and are built over the light transmitting window portions 19K, 19C, 19M, and 19Y while being curved, is provided. Furthermore, in Example 22, the gradation 31 including the upper limit gradation 316F or the like which goes across the light transmitting window portions 19K, 19C, 19M, and 19Y is provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 22 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 316F illustrated by a solid line that goes across the light transmitting window portions 19K, 19C, 19M, and 19Y to be horizontally long, the lower limit gradation 316L illustrated by a dotted line that similarly goes across to be horizontally long, and the intermediate gradation 316C illustrated by a solid line that similarly goes across to be horizontally long, are arranged. In addition, the upper limit gradation 316F, the lower limit gradation 316L, and the intermediate gradation 316C which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include the marks 63K, 63C, 63M, and 63Y which are disposed to be horizontally aligned corresponding to each of the light transmitting window portions 19K, 19C, 19M, and 19Y, the color line 33B, and the vertically long lines 125K, 125C, 125M, and 125Y. Hereinafter, this will be described in detail.

"K" that indicates the black ink is disposed in the mark 63K, "C" that indicates the cyan ink is disposed in the mark 63C, "M" that indicates the magenta ink is disposed in the mark 63M, and "Y" that indicates the yellow ink is disposed in the mark 63Y. In addition, the marks 63K, 63C, 63M, and 63Y may be any color tone, such as individual colors which correspond to each of the ink colors, unified black color, or an outlined character.

The color line 33B is disposed to be horizontally long below the marks 63K, 63C, 63M, and 63Y. The color line 33B is divided into regions that correspond to the mark 63K, the mark 63C, the mark 63M, and the mark 63Y, and is divided by colors having the same base as the colors of the ink to which each of the regions correspond. In the example, the colors are arranged in an order of the black-based color which corresponds to the mark 63K, the blue-based color which corresponds to the mark 63C, the red-based color which corresponds to the mark 63M, and the yellow-based color which corresponds to the mark 63Y.

The vertically long lines 125K, 125C, 125M, and 125Y extend toward each of the light transmitting window portions 19K, 19C, 19M, and 19Y in each of the regions divided by the colors, in the color line 33B. The extending vertically long lines 125K, 125C, 125M, and 125Y are built over the light transmitting window portions 19K, 19C, 19M, and 19Y while being curved in an open end portion. The vertically long lines 125K, 125C, 125M, and 125Y are colored by the colors having the same base as the colors of the regions divided by the colors, in the color line 33B. Specifically, the vertically long line 125K is colored by the black-based color, the vertically long line 125C is colored by the blue-based color, the vertically long line 125M is colored by the red-based color, and the vertically long line 125Y is colored by the yellow-based color.

By providing the vertically long lines 125K, 125C, 125M, and 125Y, since the reference mark 32 is connected to the light transmitting window portions 19K, 19C, 19M, and 19Y, the connection between the type of the ink and the amount of the ink (residual amount of the ink) becomes apparent, and visibility of the user can be improved.

5.23. Example 23

Figure 33:
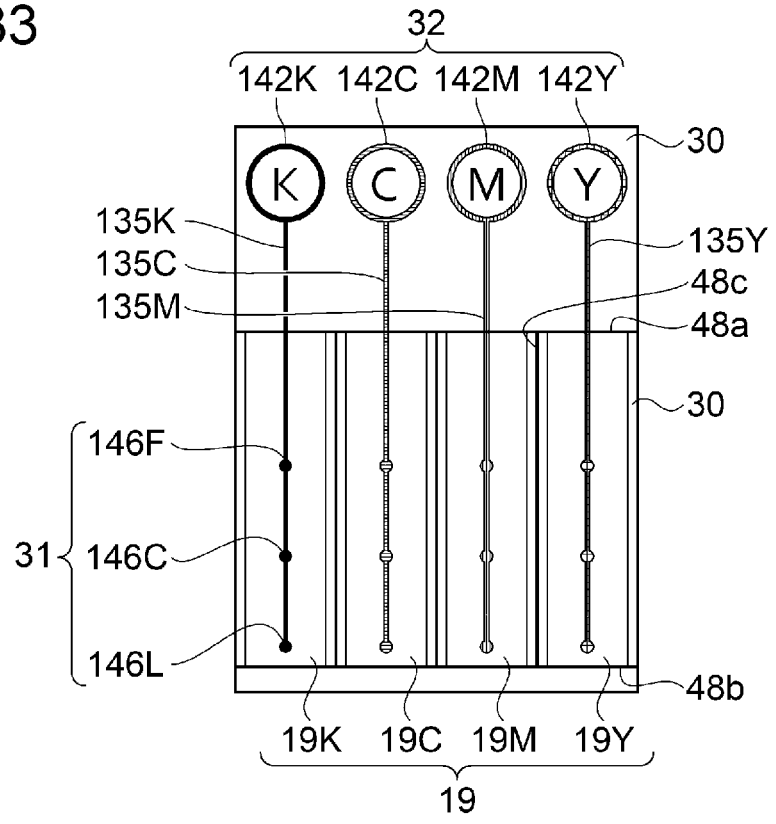
FIG. 33 is a front view illustrating light transmitting portions, gradations, and reference marks according to Example 23.

Light transmitting portions, gradations, and reference marks according to Example 23 will be described with reference to FIG. 33. In Example 23, as illustrated in FIG. 33, for example, the reference mark 32 including a mark 142K provided with "K" in a circular color frame, or the like, the gradation 31 including an upper limit gradation 146F or a lower limit gradation 146L which is illustrated by a dot provided in the light transmitting window portions 19K, 19C, 19M, and 19Y, and vertically long lines 135K, 135C, 135M, and 135Y which extend from the circular color frame, and are connected to the upper limit gradation 146F or the lower limit gradation 146L which is illustrated by a dot, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 23 have light transmission properties, and have a substantially rectangular shape which is vertically long from the upper side to the lower side. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 146F illustrated by a dot, the lower limit gradation 146L similarly illustrated by a dot, and an intermediate gradation 146C similarly illustrated by a dot, are arranged. In addition, the upper limit gradation 146F, the lower limit gradation 146L, and the intermediate gradation 146C which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include symbols illustrating the types of the ink in the circular color frame. Specifically, the mark 142K in which the character "K" is written in the circular color frame having the black-based color that indicates the black ink, the mark 142C in which the character "C" is written in the circular color frame having the blue-based color that indicates the cyan ink, the mark 142M in which the character "M" is written in the circular color frame having the red-based color that indicates the magenta ink, and the mark 142Y in which the character "Y" is written in the circular color frame having the yellow-based color that indicates the yellow ink, are provided. In addition, the colors of the characters used in the marks 142K, 142C, 142M, and 142Y may be any color tone, such as unified black color, or an outlined character.

The vertically long lines 135K, 135C, 135M, and 135Y extend toward the light transmitting window portions 19K, 19C, 19M, and 19Y from each of the marks 142K, 142C, 142M, and 142Y. The extending vertically long line 135K, 135C, 135M, and 135Y are connected to the upper limit gradation 146F, the lower limit gradation 146L, and the intermediate gradation 146C. The vertically long lines 135K, 135C, 135M, and 135Y are colored by the colors having the same base as the colors of the marks 142K, 142C, 142M, and 142Y which serve as an origin of the extension. Specifically, the vertically long line 135K is colored by the black-based color, the vertically long line 135C is colored by the blue-based color, the vertically long line 135M is colored by the red-based color, and the vertically long line 135Y is colored by the yellow-based color.

By providing the vertically long lines 135K, 135C, 135M, and 135Y, since the reference mark 32 is connected to the upper limit gradation 146F, the lower limit gradation 146L, and the intermediate gradation 146C of the light transmitting window portions 19K, 19C, 19M, and 19Y, the connection between the type of the ink and the amount of the ink (residual amount of the ink) becomes apparent, and visibility of the user can be improved.

5.24. Example 24

Figure 34:
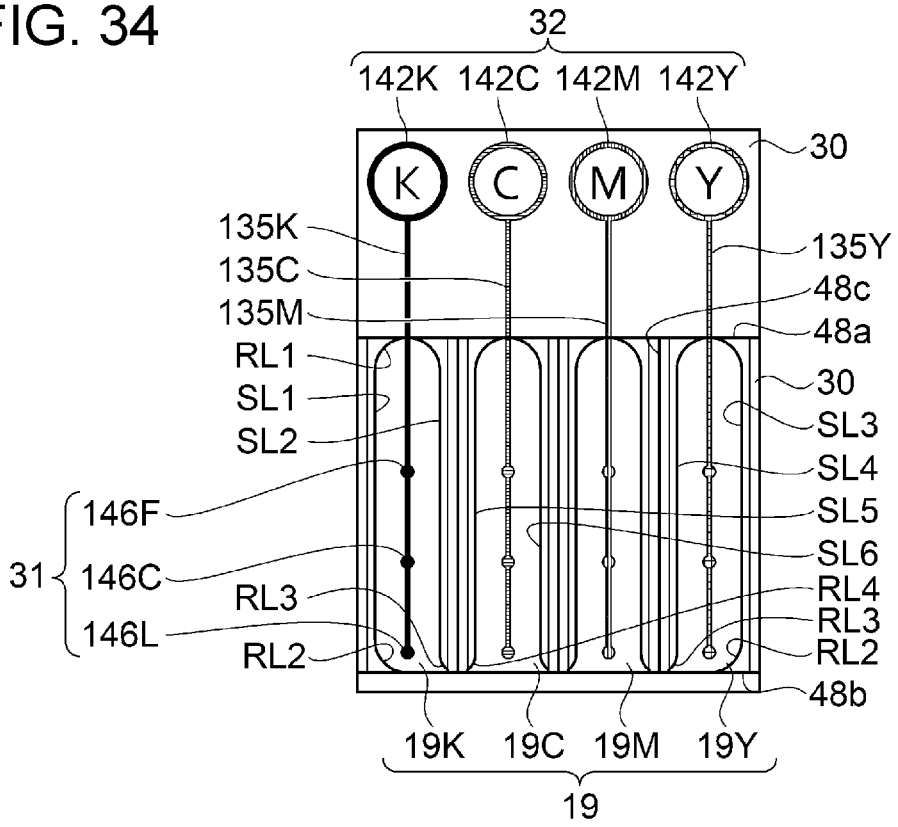
FIG. 34 is a front view illustrating light transmitting portions, gradations, and reference marks according to Example 24.

Light transmitting portions, gradations, and reference marks according to Example 24 will be described with reference to FIG. 34. In Example 24, as illustrated in FIG. 34, for example, the reference mark 32 including the mark 142K provided with "K" in a circular color frame, or the like, the gradation 31 including the upper limit gradation 146F or the lower limit gradation 146L which is illustrated by a dot provided in the light transmitting window portions 19K, 19C, 19M, and 19Y, and vertically long lines 135K, 135C, 135M, and 135Y which extend from the circular color frames and are connected to the upper limit gradation 146F or the lower limit gradation 146L which is illustrated by a dot, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 24 have light transmission properties, and have a substantially rectangular shape which is vertically long from the upper side to the lower side. The end above the light transmitting window portions 19K, 19C, 19M, and 19Y are rounded in a semicircular shape RL1. The light transmitting window portion 19K has long sides SL1 and SL2 which oppose each other. The end below the long side SL1 has a curve portion RL2 which is curved on the inner side, and the end below the long side SL2 has a curve portion RL3 which is curved on the outer side. The light transmitting window portion 19C and the light transmitting window portion 19M have long sides SL5 and SL6 which oppose each other. The end below the long sides SL5 and SL6 respectively has a curve portion RL4 which is curved on the outer side. The light transmitting window portion 19Y has long sides SL3 and SL4 which oppose each other. The end below the long side SL3 has the curve portion RL2 which is curved on the inner side, and the end below the long side SL4 has the curve portion RL3 which is curved on the outer side.

The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 146F illustrated by a dot, the lower limit gradation 146L similarly illustrated by a dot, and the intermediate gradation 146C similarly illustrated by a dot, are arranged. In addition, the upper limit gradation 146F, the lower limit gradation 146L, and the intermediate gradation 146C which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include symbols illustrating the types of the ink in the circular color frame. Specifically, the mark 142K in which the character "K" is written in the circular color frame having the black-based color that indicates the black ink, the mark 142C in which the character "C" is written in the circular color frame having the blue-based color that indicates the cyan ink, the mark 142M in which the character "M" is written in the circular color frame having the red-based color that indicates the magenta ink, and the mark 142Y in which the character "Y" is written in the circular color frame having the yellow-based color that indicates the yellow ink, are provided. In addition, the colors of the characters used in the marks 142K, 142C, 142M, and 142Y may be any color tone, such as unified black color, or an outlined character.

The vertically long lines 135K, 135C, 135M, and 135Y extend toward the light transmitting window portions 19K, 19C, 19M, and 19Y from each of the marks 142K, 142C, 142M, and 142Y. The extending vertically long line 135K, 135C, 135M, and 135Y are connected to the upper limit gradation 146F, the lower limit gradation 146L, and the intermediate gradation 146C. The vertically long lines 135K, 135C, 135M, and 135Y are colored by the colors having the same base as the colors of the marks 142K, 142C, 142M, and 142Y which serve as an origin of the extension. Specifically, the vertically long line 135K is colored by the black-based color, the vertically long line 135C is colored by the blue-based color, the vertically long line 135M is colored by the red-based color, and the vertically long line 135Y is colored by the yellow-based color.

5.25. Example 25

Figure 35:
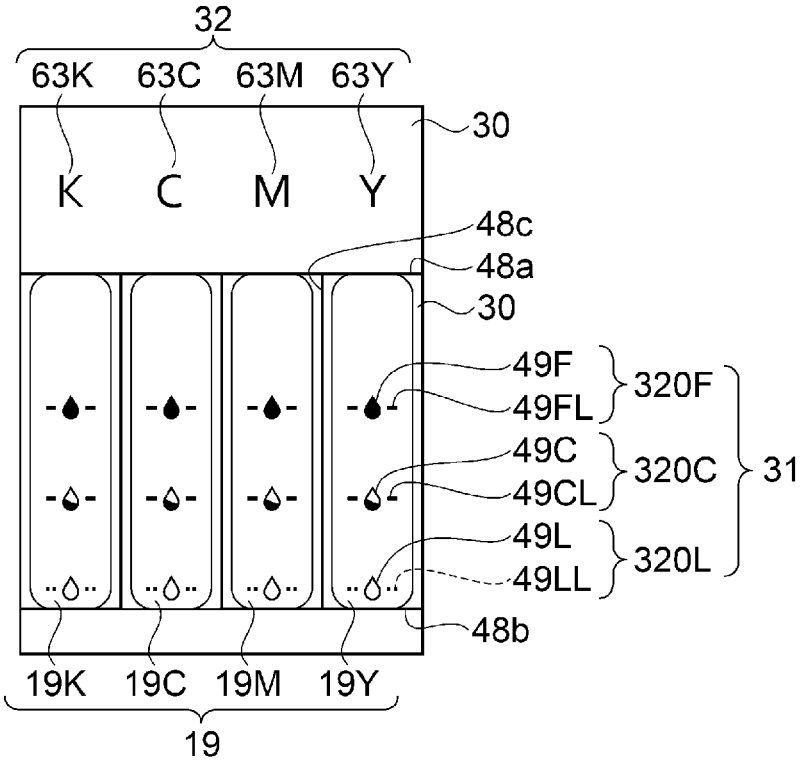
FIG. 35 is a front view illustrating light transmitting portions, gradations, and reference marks according to Example 25.

Light transmitting portions, gradations, and reference marks according to Example 25 will be described with reference to FIG. 35. In Example 25, as illustrated in FIG. 35, the reference mark 32 provided in the outer edge portion 30, and the gradation 31 including an upper limit gradation 320F or the like configured of a water droplet mark style icon 49F and a horizontal line 49FL that serve as a standard of the residual amount of the ink provided in the light transmitting window portions 19K, 19C, 19M, and 19Y, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 25 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 320F configured of the water droplet mark style icon 49F and the horizontal lines 49FL disposed on both sides of the icon 49F, a lower limit gradation 320L configured of a water droplet mark style icon 49L and a horizontal lines 49LL disposed on both sides of the icon 49L, and an intermediate gradation 320C configured of a water droplet mark style icon 49C and a horizontal lines 49CL disposed on both sides of the water droplet mark style icon 49C, are arranged. All of the water droplet mark style icons 49F are configured to be colored to indicate a state where the inside of the tank 21 is fully filled with the ink. The icons 49L is configured not to be colored to indicate a substantially ink empty state of the inside of the tank 21. The icons 49C is configured to be half-colored to indicate a state where a substantially half of the inside of the tank 21 is filled with the ink. In addition, the upper limit gradation 320F, the lower limit gradation 320L, and the intermediate gradation 320C which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include the marks 63K, 63C, 63M, and 63Y which correspond to each of the light transmitting window portions 19K, 19C, 19M, and 19Y. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.26. Example 26

Figure 36:
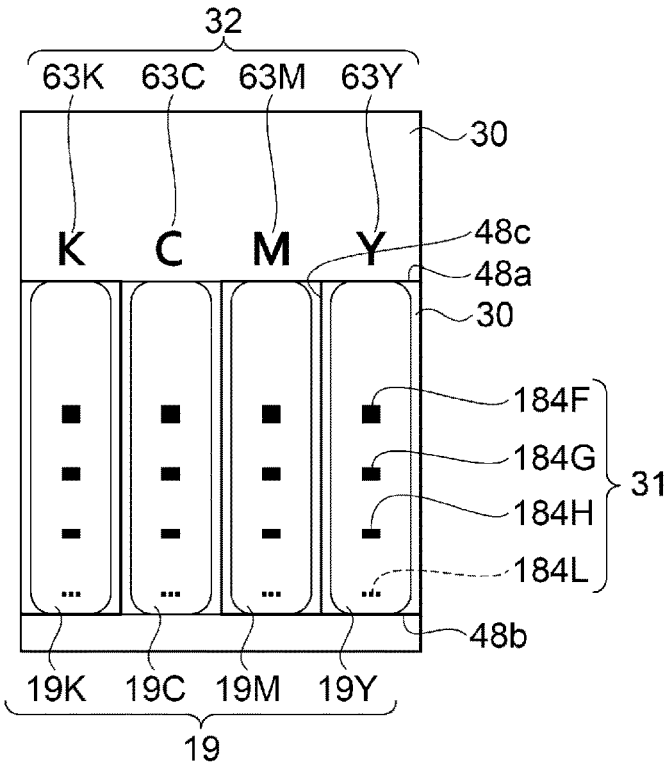
FIG. 36 is a front view illustrating light transmitting portions, gradations, and reference marks according to Example 26.

Light transmitting portions, gradations, and reference marks according to Example 26 will be described with reference to FIG. 36. In Example 26, as illustrated in FIG. 36, the reference mark 32 provided in the outer edge portion 30, and the gradation 31 including an upper limit gradation 184F configured of a quadrangular icon which functions as the standard of the residual amount of the ink provided in the light transmitting window portions 19K, 19C, 19M, and 19Y. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 26 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. The light transmitting window portions 19K, 19C, 19M, and 19Y are divided by the first division line 48*a* which binds the outer edge on the upper side of each of the light transmitting window portions, the second division line 48*b* which binds the outer edge on the lower side of each of the light transmitting window portions, and the third division line 48*c* which links the first division line 48*a* and the second division line 48*b* between the light transmitting window portions adjacent to each other, such as the light transmitting window portion 19K and the light transmitting window portion 19C.

In each of the light transmitting window portions 19K, 19C, 19M, and 19Y, as the gradation 31, the upper limit gradation 184F, an intermediate gradation 184G, and an intermediate gradation 184H which are configured of a colored quadrangular icon, and a lower limit gradation 184L configured of horizontally aligned dots, are provided. In addition, the quadrangular icons which used here are expressed to gradually become smaller in order of the upper limit gradation 184F, the intermediate gradation 184G, and the intermediate gradation 184H. In addition, the upper limit gradation 184F, the lower limit gradation 184L, and the intermediate gradations 184G and 184H which configure the gradation 31, may be a color tone, such as individual colors which correspond to each of the ink colors, unified black color, or an outlined character.

The reference marks 32 provided in the outer edge portion 30 above the first division line 48*a* illustrate the types of the ink accommodated in each of the four tanks 21, and include the marks 63K, 63C, 63M, and 63Y which correspond to each of the light transmitting window portions 19K, 19C, 19M, and 19Y. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.27. Example 27

Light transmitting portions, gradations, and reference marks according to Example 27 will be described with reference to FIG. 37. The gradations according to Example 27 have a so-called indicator lamp style disposition design, and the residual amount of the ink is visible by the multiple track shape.

Figure 37:
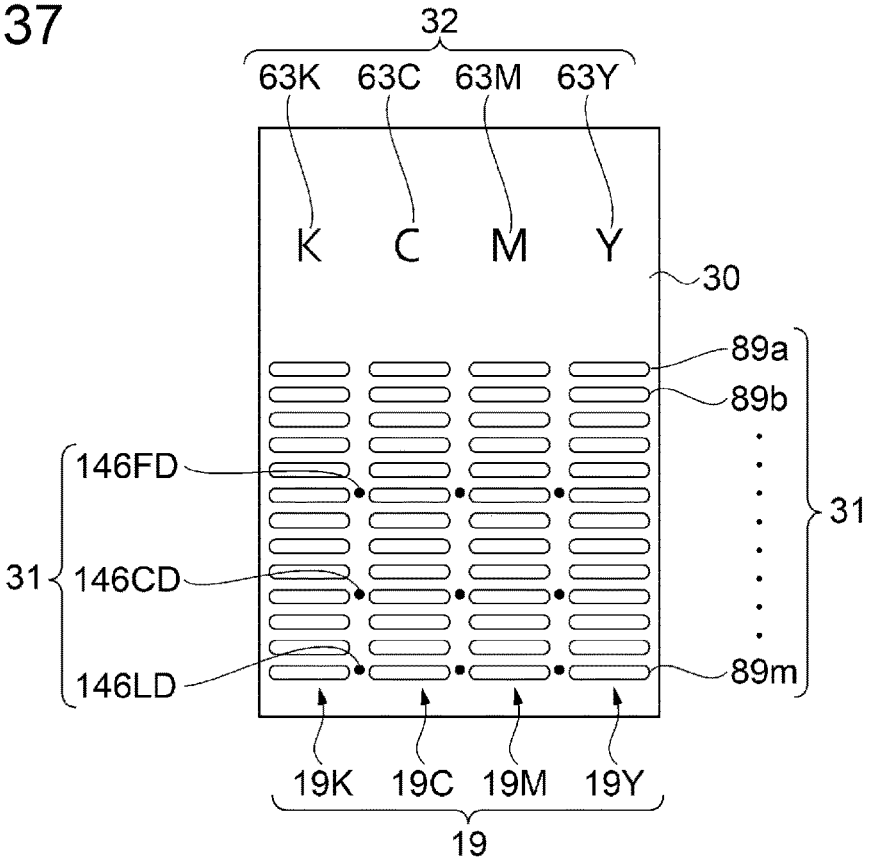
FIG. 37 is a front view illustrating light transmitting portions, gradations, and reference marks according to Example 27.

As illustrated in FIG. 37, in the light transmitting window portions 19K, 19C, 19M, and 19Y according to Example 27, a plurality of slit windows 89*a*, 89*b*, . . . , and 89*m* having light transmission properties and a horizontally long round shape (track shape), are configured to be arranged in a shape of a belt from the upper side to the lower side. Further on the outer side than the outer edge of the slit windows 89*a*, 89*b*, . . . , and 89*m*, by coating the surface with the coloring coating material, by attaching the coloring film, or by performing emboss (wrinkle) processing, the outer edge portion 30 divided into the slit windows 89*a*, 89*b*, . . . , and 89*m* is provided. In addition, in the outer edge portion 30 between the light transmitting window portion 19K and the light transmitting window portion 19C, between the light transmitting window portion 19C and the light transmitting window portion 19M, and between the light transmitting window portion 19M and the light transmitting window portion 19Y, gradation marks 146FD, 146CD, and 146LD which are illustrated by black dots are provided. The gradation marks 146FD, 146CD, and 146LD can be used, for example, as marks that illustrate the upper limit of the amount of the ink.

The reference marks 32 provided in the outer edge portion 30 above the light transmitting window portions 19K, 19C, 19M, and 19Y, illustrate the types of the ink accommodated in each of the four tanks 21, and include the marks 63K, 63C, 63M, and 63Y which correspond to each of the light transmitting window portions 19K, 19C, 19M, and 19Y. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be a color tone, such as individual colors which correspond to each of the ink colors, unified black color, or an outlined character.

5.28. Example 28

Light transmitting portions, gradations, and reference marks according to Example 28 will be described with reference to FIGS. 38A and 38B. The gradations according to Example 28 have a so-called disposition design in which small windows are arranged in a shape of a matrix, and the residual amount of the ink is visible by the multiple small windows.

Figure 38A:
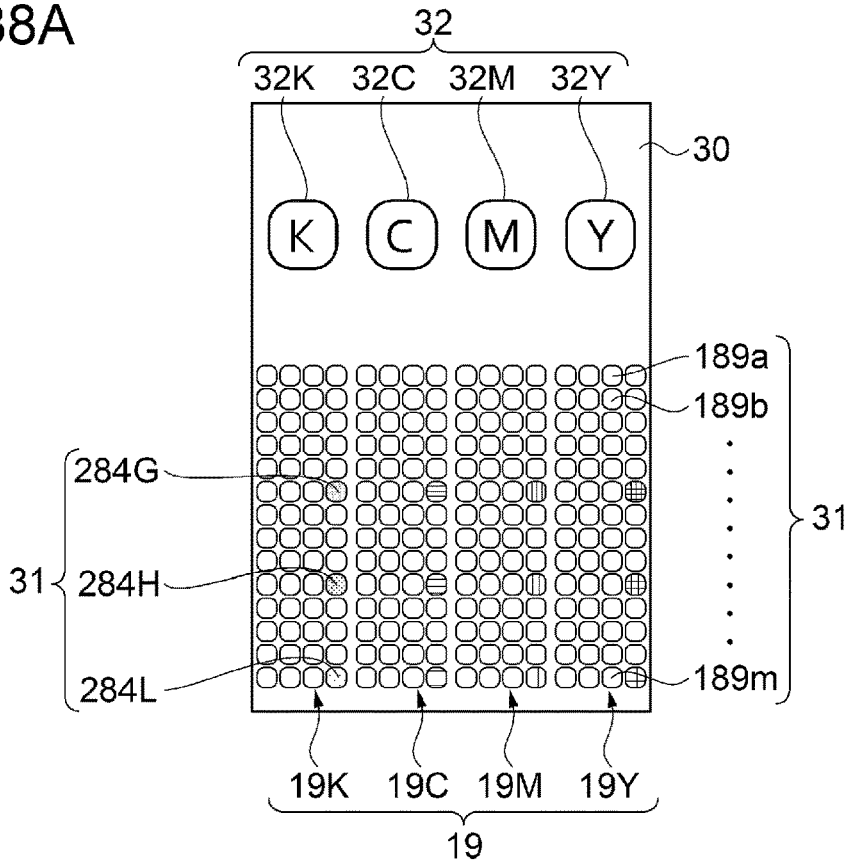
FIG. 38A is a front view illustrating light transmitting portions, gradations, and reference marks according to Example 28.

As illustrated in FIG. 38A, in the light transmitting window portions 19K, 19C, 19M, and 19Y according to Example 28, a plurality of slit windows 189*a*, 189*b*, . . . , and 189*m* having a small round shape or a small four-sided shape are arranged in a shape of a matrix having four horizontal rows. One row (one row of a rightmost wing in the example) therein has non-light transmitting windows, and other three rows have light transmission properties. Further on the outer side than the outer edge of the slit windows 189*a*, 189*b*, . . . , and 189*m*, by coating the surface with the coloring coating material, by attaching the coloring film, or by performing emboss (wrinkle) processing, the outer edge portion 30 divided from the slit windows 189*a*, 189*b*, . . . , and 189*m* is provided. In addition, at a predetermined position of one row of the rightmost wing, as the gradation 31, gradation marks 284G, 284H, and 284L which are colored by the colors that correspond to the colors of the ink, are provided. The gradation marks 284G, 284H, and 284L are displayed by light colors as approaching the lower side. The gradation marks 284G, 284H, and 284L can be used as marks that illustrate the residual amount of the ink.

The reference marks 32 disposed in the outer edge portion 30 above the light transmitting window portions 19K, 19C, 19M, and 19Y, illustrate the types of the ink accommodated in each of the four tanks 21, and include, for example, the mark 32K of "K in the square and round outlined □" that indicates the black ink, the mark 32C of "C in a square and round outlined □" that indicates the cyan ink, the mark 32M of "M in a square and round outlined □" that indicates the magenta ink, and the mark 32Y of "Y in a square and round outlined □" that indicates the yellow ink. In addition, the marks 32K, 32C, 32M, and 32Y may be any color tone, such as individual colors which correspond to each of the ink colors, unified black color, or an outlined character.

Figure 38B:
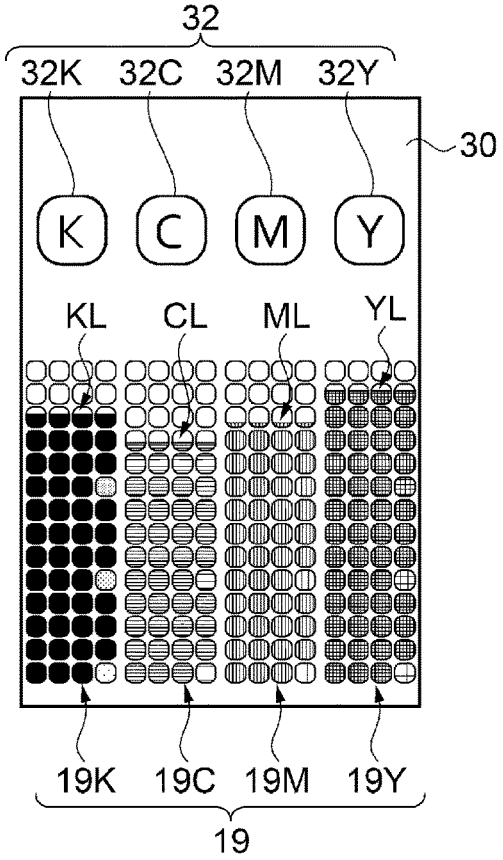
FIG. 38B is a front view illustrating a visually confirmed example of a residual amount of ink in the light transmitting portion, the gradations, and the reference marks according to Example 28.

Here, with reference to FIG. 38B, a visual example of the residual amount of the ink in a case of using the light transmitting portion, the gradations, and the reference marks according to Example 28, is illustrated. As illustrated in FIG. 38B, it is possible to see through the ink accommodated in the tanks 21 (refer to FIG. 4) in the light transmitting window portions 19K, 19C, 19M, and 19Y which are configured of the matrix-like slit windows 189*a*, 189*b*, . . . , and 189*m* in which the gradation marks 284G, 284H, and 284L are not provided. A residual amount KL of the black ink can be visually confirmed in the light transmitting window portion 19K, a residual amount CL of the cyan ink can be visually confirmed in the light transmitting window portion 19C, a residual amount ML of the magenta ink can be visually confirmed in the light transmitting window portion 19M, and a residual amount YL of the yellow ink is visually confirmed in the light transmitting window portion 19Y, respectively.

5.29 Example 29

Figure 39:
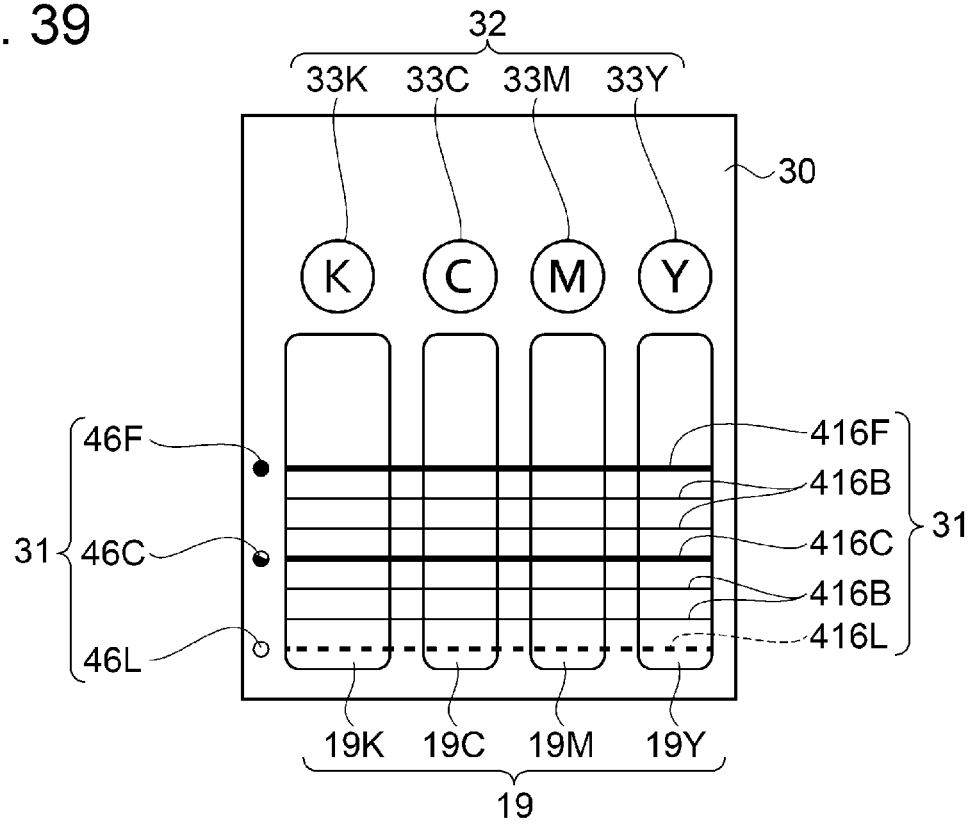
FIG. 39 is a front view illustrating light transmitting portions, gradations, and reference marks according to Example 29.

Light transmitting portions, gradations, and reference marks according to Example 29 will be described with reference to FIG. 39. In Example 29, as illustrated in FIG. 39, for example, the reference mark 32 including the mark 33K provided with "K" in the outlined ○, or the like, and the gradation 31 including an upper limit gradation 416F, an intermediate gradation 416C, and a lower limit gradation 416L which are provided in the light transmitting window portions 19K, 19C, 19M, and 19Y, and circular icons 46F, 46L, and 46C provided in the outer edge portion 30 on a side opposite to the light transmitting window portion 19C with respect to the light transmitting window portion 19K, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 29 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. In addition, the light transmitting window portion 19K is configured such that the horizontal width thereof is wider than those of other light transmitting window portions 19C, 19M, and 19Y.

In each of the light transmitting window portions 19K, 19C, 19M, and 19Y, as the gradation 31, the upper limit gradation 416F illustrated by a solid line that goes across the light transmitting window portions 19K, 19C, 19M, and 19Y to be horizontally long, the lower limit gradation 416L illustrated by a dotted line that goes across the light transmitting window portions to be horizontally long, the intermediate gradation 416C illustrated by a solid line that similarly goes across the light transmitting window portions to be horizontally long, and a subdivided gradation 416B which is horizontally long between each of the upper limit gradation 416F, the lower limit gradation 416L, and the intermediate gradation 416C, are provided. In addition, the upper limit gradation 416F, the lower limit gradation 416L, and the intermediate gradation 416C or the subdivided gradation 416B which configure the gradation 31, may be a color tone, such as individual colors which correspond to each of the ink colors, unified black color, or an outlined character.

In the outer edge portion 30 positioned on the side opposite to the light transmitting window portion 19C with respect to the light transmitting window portion 19K, the circular icons 46F, 46L, and 46C are provided. The circular icon 46F is disposed at a position horizontally aligned next to the upper limit gradation 416F, and is configured of a colored circular mark that indicates a state where the inside of the tank 21 is fully filled with the ink. The circular icon 46L is disposed at a position horizontally aligned next to the lower limit gradations 416L, and is configured of an uncolored circular mark that indicates a substantially ink empty state of the inside of the tank 21. The circular icon 46C is disposed at a position horizontally aligned next to the intermediate gradations 416C, and is configured of a half-colored circular mark that indicates a state where a substantially half of the inside of the tank 21 is filled with the ink.

In addition, the upper limit gradation 416F, the intermediate gradation 416C, the lower limit gradation 416L, and the subdivided gradation 416B which configure the gradation 31, and the circular icons 46F, 46L, and 46C may be any color tone, such as individual colors which correspond to each of the ink colors, unified black color, or an outlined character.

The reference marks 32 provided above the light transmitting window portions 19K, 19C, 19M, and 19Y illustrate the types of the ink accommodated in each of the four tanks 21, and include, for example, the mark 33K of "K in the outlined ○" that indicates the black ink, the mark 33C of "C in the outlined ○" that indicates the cyan ink, the mark 33M of "M in the outlined ○" that indicates the magenta ink, and the mark 33Y of "Y in the outlined ○" that indicates the yellow ink. In addition, the marks 33K, 33C, 33M, and 33Y may be any color tone, such as individual colors which correspond to each of the ink colors, unified black color, or an outlined character.

5.30. Example 30

Figure 40:
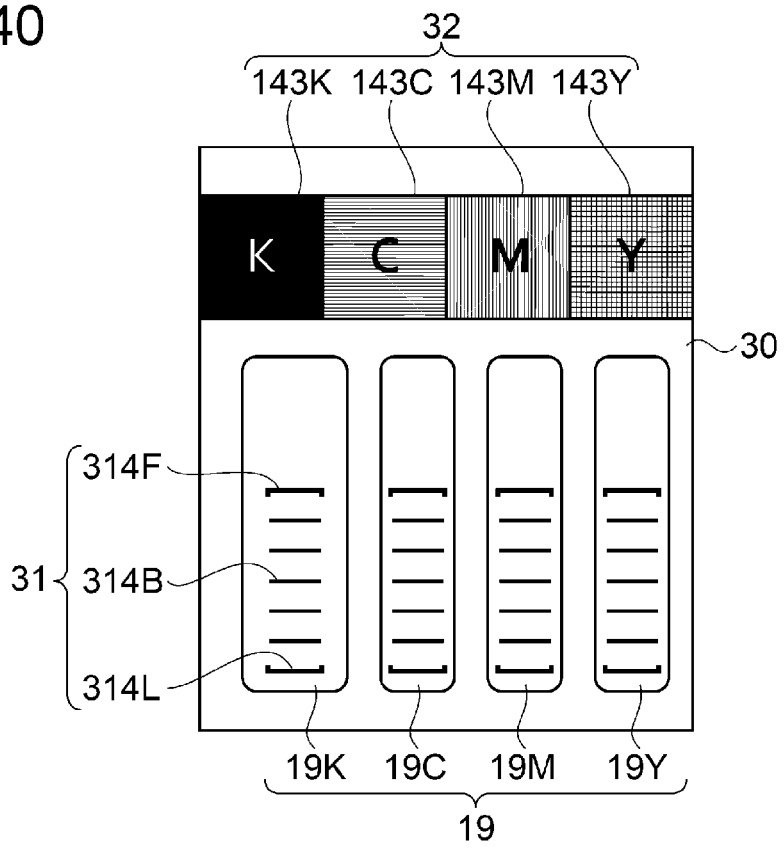
FIG. 40 is a front view illustrating light transmitting portions, gradations, and reference marks according to Example 30.

Light transmitting portions, gradations, and reference marks according to Example 30 will be described with reference to FIG. 40. In Example 30, as illustrated in FIG. 40, the reference mark 32 including a mark 143K that illustrates the types of the ink in each of the regions obtained by dividing the horizontally long belt-like frame into four, and for example, in which the character "K" is disposed, and the gradation 31 including the upper limit gradation 314F, the lower limit gradation 314L, and the subdivided gradation 314B which have a shape of a bracket and are provided in the light transmitting window portions 19K, 19C, 19M, and 19Y. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 30 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. In addition, the light transmitting window portion 19K is configured such that the horizontal width thereof is wider than those of other light transmitting window portions 19C, 19M, and 19Y.

In each of the light transmitting window portions 19K, 19C, 19M, and 19Y, as the gradation 31, the upper limit gradation 314F having a shape of which one part of the bracket is disposed to be oriented downward, the lower limit gradation 314L having a shape of which one part of the bracket is oriented upward, and the subdivided gradation 314B which is disposed between the upper limit gradation 314F and the lower limit gradation 314L and illustrated by a horizontally long solid line, are arranged. In addition, the upper limit gradation 314F, the lower limit gradation 314L, and the subdivided gradation 314B which configure the gradation 31, may be a color tone, such as individual colors which correspond to each of the ink colors, unified black color, or an outlined character.

The reference marks 32 provided in the outer edge portion 30 above the light transmitting window portions 19K, 19C, 19M, and 19Y, illustrate the types of the ink accommodated in each of the four tanks 21, and include the color marks 143K, 143C, 143M, and 143Y which correspond to each of the light transmitting window portions 19K, 19C, 19M, and 19Y. The reference mark 32 has four regions obtained by dividing the horizontally long belt-like (horizontally long rectangular shape in the example) frame into four, each of the regions is colored by the colors that correspond to the types of the ink, and symbols (alphabets) that indicate the types of the ink are written in the middle of the regions. Specifically, the color mark 143K in which the mark of "K" that indicates the blank ink is written on the background having the black-based color corresponding to the light transmitting window portion 19K, the color mark 143C in which the mark of "C" that indicates the cyan ink is written on the background having the blue-based color corresponding to the light transmitting window portion 19C, the color mark 143M in which the mark of "M" that indicates the magenta ink is written on the background having the red-based color corresponding to the light transmitting window portion 19M, and the color mark 143Y in which the mark of "Y" that indicates the yellow ink is written on the background having the yellow-based color corresponding to the light transmitting window portion 19Y, are disposed.

5.31. Example 31

Figure 41:
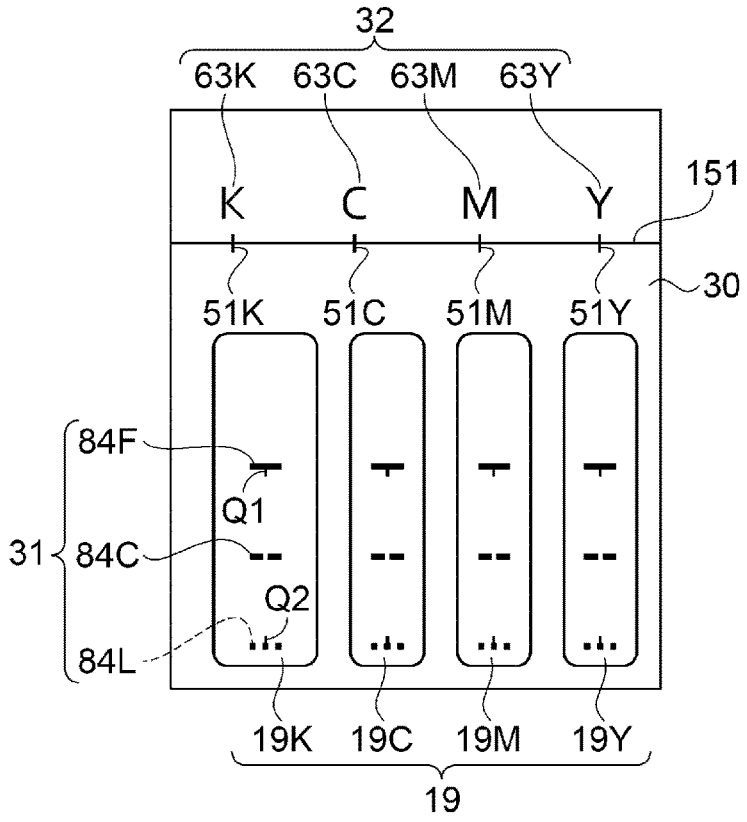
FIG. 41 is a front view illustrating light transmitting portions, gradations, and reference marks according to Example 31.

Light transmitting portions, gradations, and reference marks according to Example 31 will be described with reference to FIG. 41. In Example 31, as illustrated in FIG. 41, separation lines 51K, 51C, 51M, and 51Y which correspond to each of the light transmitting window portions 19K, 19C, 19M, and 19Y are provided on a horizontally long solid line 151, and the reference mark 32 provided with the marks 63K, 63C, 63M, and 63Y is provided above the separation lines 51K, 51C, 51M, and 51Y. In addition, the gradation 31 including the upper limit gradation 84F illustrated by a horizontally long solid line, the lower limit gradation 84L illustrated by three dots, and the intermediate gradation 84C illustrated by two dots, which are provided in the light transmitting window portions 19K, 19C, 19M, and 19Y, is provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 31 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. In addition, the light transmitting window portion 19K is configured such that the horizontal width thereof is wider than those of other light transmitting window portions 19C, 19M, and 19Y.

In each of the light transmitting window portions 19K, 19C, 19M, and 19Y, as the gradation 31, for example, the upper limit gradation 84F illustrated by a horizontally long solid line, the lower limit gradation 84L illustrated by three horizontally long dots, and the intermediate gradation 84C illustrated by two horizontally long dots, are arranged. In addition, a point Q1 oriented downward is provided in the upper limit gradation 84F, and a point Q2 oriented upward is provided in the lower limit gradation 84L. In addition, the upper limit gradation 84F, the lower limit gradation 84L, and the intermediate gradation 84C which configure the gradation 31, may be a color tone, such as individual colors which correspond to each of the ink colors, unified black color, or an outlined character.

The reference mark 32 provided in the outer edge portion 30 above the light transmitting window portions 19K, 19C, 19M, and 19Y include the horizontally long solid line 151 disposed above the light transmitting window portions 19K, 19C, 19M, and 19Y, and the marks 63K, 63C, 63M, and 63Y provided above the horizontally long solid line 151. On the horizontally long solid line 151, the separation lines 51K, 51C, 51M, and 51Y which correspond to each of the light transmitting window portions 19K, 19C, 19M, and 19Y, are provided. In addition, the marks 63K, 63C, 63M, and 63Y are provided above each of the separation lines 51K, 51C, 51M, and 51Y. The marks 63K, 63C, 63M, and 63Y illustrate the types of the ink accommodated in each of the four tanks 21. Specifically, the mark 63K of "K" that indicates the black ink, the mark 63C of "C" that indicates the cyan ink, the mark 63M of "M" that indicates the magenta ink, and the mark 63Y of "Y" that indicates the yellow ink, are disposed. In addition, the marks 63K, 63C, 63M, and 63Y may be any color tone, such as individual colors which correspond to each of the ink colors, unified black color, or an outlined character.

5.32. Example 32

Figure 42:
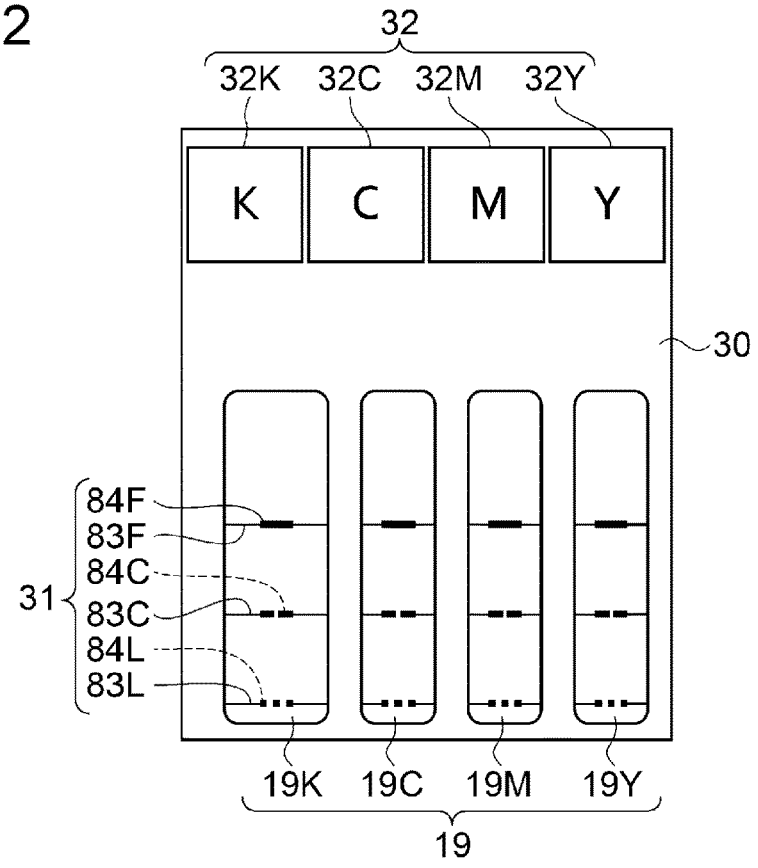
FIG. 42 is a front view illustrating light transmitting portions, gradations, and reference marks according to Example 32.

Light transmitting portions, gradations, and reference marks according to Example 32 will be described with reference to FIG. 42. In Example 32, as illustrated in FIG. 42, the reference mark 32 which is disposed above the outer edge portion 30 and includes the mark 32K provided with "K" in a relatively large outlined □, or the like, and the gradation 31 including the upper limit gradation 84F illustrated by a horizontally long solid line, the lower limit gradation 84L illustrated by three dots, and the intermediate gradation 84C illustrated by two dots, which are provided in the light transmitting window portions 19K, 19C, 19M, and 19Y, are provided. In addition, in the example, the light transmitting window portion 19K, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19K, 19C, 19M, and 19Y, the outer edge portion 30 is provided.

The light transmitting window portions 19K, 19C, 19M, and 19Y which configure the light transmitting portion 19 according to Example 32 have light transmission properties, and have a substantially rectangular shape which is vertically long from the upper side to the lower side. In addition, four corners of the light transmitting window portions 19K, 19C, 19M, and 19Y having a substantially rectangular shape are rounded in an arc shape. In addition, the light transmitting window portion 19K is configured such that the horizontal width thereof is wider than those of other light transmitting window portions 19C, 19M, and 19Y.

In each of the light transmitting window portions 19K, 19C, 19M, and 19Y, as the gradation 31, for example, the upper limit gradation 84F illustrated by a horizontally long solid line, the lower limit gradation 84L illustrated by three horizontally long dots, and the intermediate gradation 84C illustrated by two horizontally long dots, are arranged. In addition, in the upper limit gradation 84F, the lower limit gradation 84L, and the intermediate gradation 84C, horizontally long solid lines 83F, 83L, and 83C which are oriented in the width direction of each of the light transmitting window portions 19K, 19C, 19M, and 19Y are provided. In addition, the upper limit gradation 84F, the lower limit gradation 84L, and the intermediate gradation 84C, and the solid lines 83F, 83L, and 83C which configure the gradation 31, may be a color tone, such as individual colors which correspond to each of the ink colors, unified black color, or an outlined character.

The reference mark 32 provided in the outer edge portion 30 above the light transmitting window portions 19K, 19C, 19M, and 19Y illustrate the types of the ink accommodated in each of the four tanks 21, and include, for example, the mark 32K of "K in the outlined □" that indicates the black ink, the mark 32C of "C in the outlined □" that indicates the cyan ink, the mark 32M of "M in the outlined □" that indicates the magenta ink, and the mark 32Y of "Y in the outlined □" that indicates the yellow ink. In addition, the marks 32K, 32C, 32M, and 32Y may be any color tone, such as individual colors which correspond to each of the ink colors, unified black color, or an outlined character.

5.33. Example 33

Figure 43:
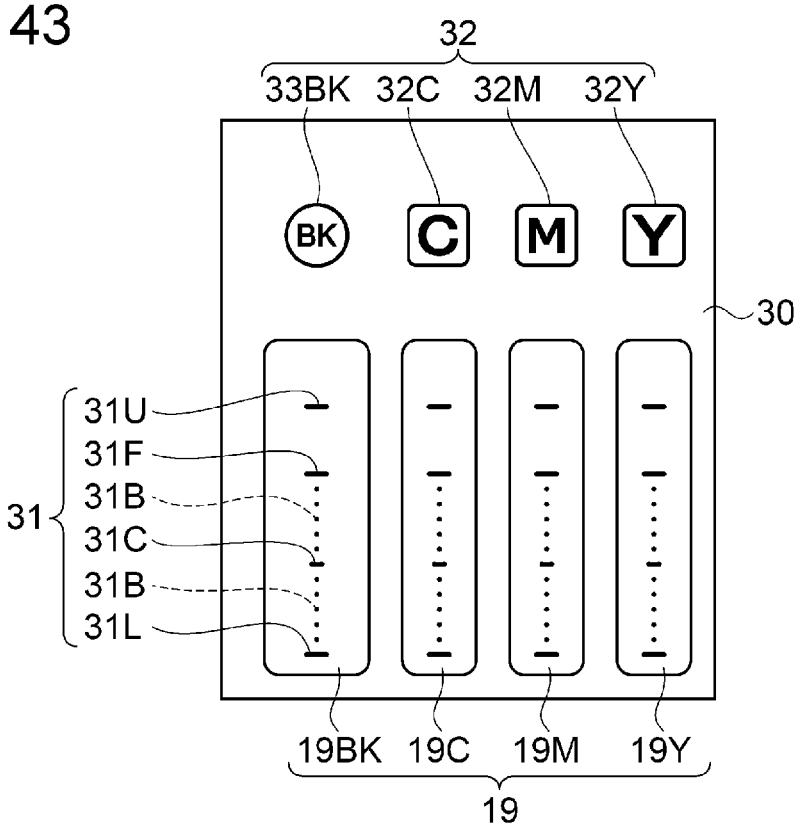
FIG. 43 is a front view illustrating light transmitting portions, gradations, and reference marks according to Example 33.

Light transmitting portions, gradations, and reference marks according to Example 33 will be described with reference to FIG. 43. In Example 33, as illustrated in FIG. 43, the reference mark 32 which is disposed in the outer edge portion 30 and includes the mark 33BK provided with "BK" in the outlined circular frame, the mark 32C provided with "C" in the outlined □ and the like, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 33 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, and the intermediate gradation 31C positioned between the upper gradation 31F and the lower limit gradation 31L and illustrated by a horizontally long solid line that is slightly shorter than the upper gradation 31F, and the subdivided gradation 31B illustrated by a dot between the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21, and include, for example, the mark 33BK of "BK in the outlined circular frame" that indicates the black ink, the mark 32C of "C in the outlined □" that indicates the cyan ink, the mark 32M of "M in the outlined □" that indicates the magenta ink, and the mark 32Y of "Y in the outlined □" that indicates the yellow ink. In addition, the marks 33BK, 32C, 32M, and 32Y may be any color tone, such as individual colors which correspond to each of the ink colors, unified black color, or an outlined character.

5.34. Example 34

Figure 44:
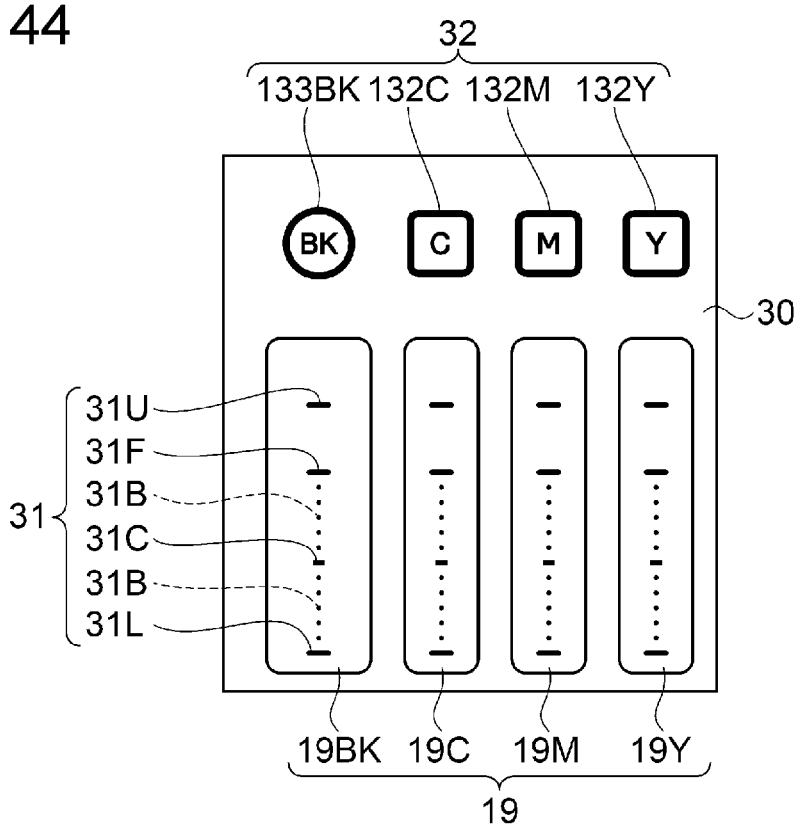
FIG. 44 is a front view illustrating light transmitting portions, gradations, and reference marks according to Example 34.

Light transmitting portions, gradations, and reference marks according to Example 34 will be described with reference to FIG. 44. As illustrated in FIG. 44, Example 34 has a design including a mark 133BK that configures the reference mark 32 of Example 33 described with reference to FIG. 43 and is greater than the frame line of the mark 33BK or the like. Therefore, since the light transmitting window portions 19BK, 19C, 19M, and 19Y or the gradation 31 are similar to those of Example 33, and the description thereof will be omitted.

The reference mark 32 provided in the outer edge portion 30 above the light transmitting window portions 19BK, 19C, 19M, and 19Y illustrate the types of the ink accommodated in each of the four tanks 21, and include, for example, the mark 133BK of "BK in the outlined circular frame surrounded by a thick solid line" that indicates the black ink, the mark 132C of "C in the outlined □ surrounded by a thick solid line" that indicates the cyan ink, the mark 132M of "M in the outlined □ surrounded by a thick solid line" that indicates the magenta ink, and the mark 132Y of "Y in the outlined □ surrounded by a thick solid line" that indicates the yellow ink. In addition, the marks 133BK, 132C, 132M, and 132Y may be any color tone, such as individual colors which correspond to each of the ink colors, unified black color, or an outlined character.

5.35. Example 35

Figure 45:
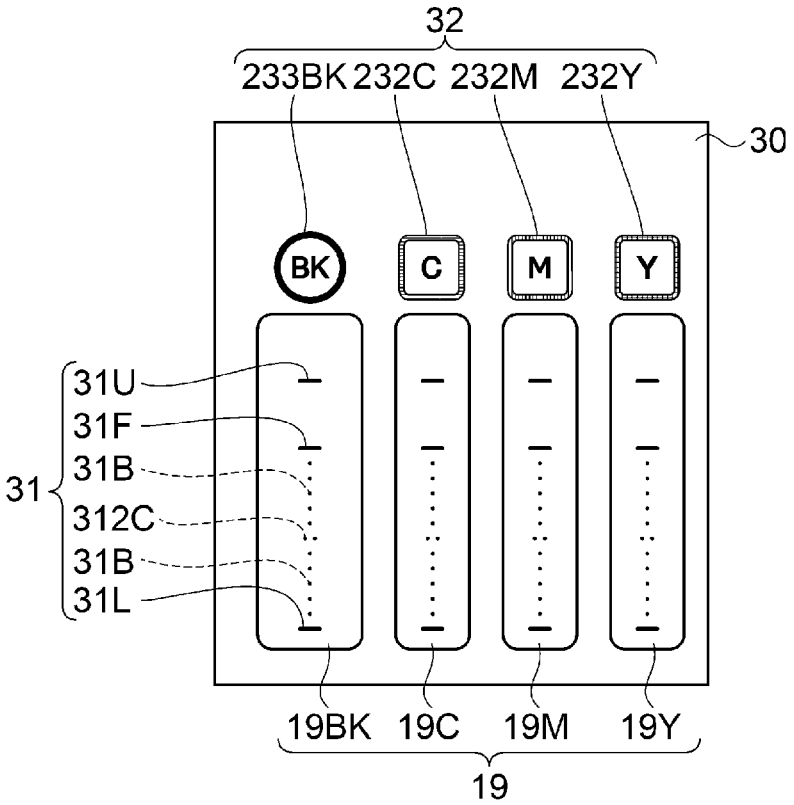
FIG. 45 is a front view illustrating light transmitting portions, gradations, and reference marks according to Example 35.

Light transmitting portions, gradations, and reference marks according to Example 35 will be described with reference to FIG. 45. As illustrated in FIG. 45, Example 35 has a design including a mark 233BK which configures the reference mark 32 of Example 33 described with reference to FIG. 43 and in which the frame line of the mark 33BK or the like, is colored by the color corresponding to the type of the ink. Therefore, in the light transmitting window portions 19BK, 19C, 19M, and 19Y or the gradation 31, the description of similar configurations as those of Example 33 will be omitted.

The reference mark 32 provided in the outer edge portion 30 above the light transmitting window portions 19BK, 19C, 19M, and 19Y illustrate the types of the ink accommodated in each of the four tanks 21, and include, for example, the mark 233BK of "BK in the outlined circular frame surrounded by a solid line having a black-based color" that indicates the black ink, a mark 232C of "C in the outlined □ surrounded by a solid line having a blue-based color" that indicates the cyan ink, a mark 232M of "M in the outlined □ surrounded by a solid line having a red-based color" that indicates the magenta ink, and a mark 232Y of "Y in the outlined □ surrounded by a solid line having a yellow-based color" that indicates the yellow ink. In addition, the symbols (alphabets) of the marks 233BK, 232C, 232M, and 232Y may be any color tone, such as individual colors which correspond to each of the ink colors, unified black color, or an outlined character.

In the gradations 31 which are provided in each of the light transmitting window portions 19BK, 19C, 19M, and 19Y, the intermediate gradation 312C is different from the intermediate gradation 31C of Example 33. The intermediate gradation 312C is positioned between the upper gradation 31F and the lower limit gradation 31L, and is configured of horizontally long two dots which are slightly shorter than the upper gradation 31F.

5.36. Example 36

Figure 46:
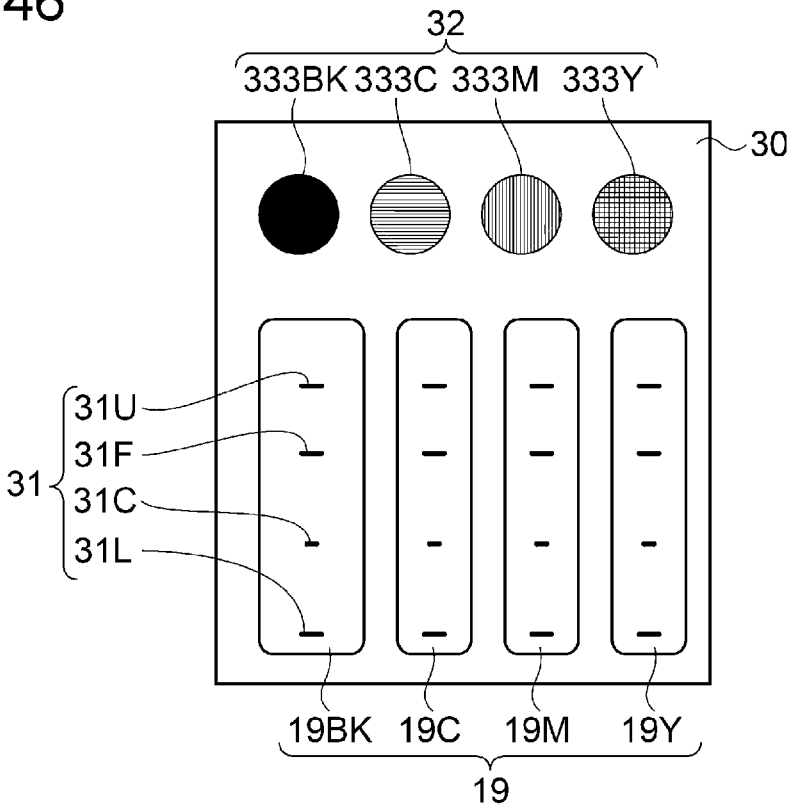
FIG. 46 is a front view illustrating light transmitting portions, gradations, and reference marks according to Example 36.

Light transmitting portions, gradations, and reference marks according to Example 36 will be described with reference to FIG. 46. In Example 36, as illustrated in FIG. 46, the reference mark 32 which is provided in the outer edge portion 30 and includes marks 333BK, 333C, 333M, and 333Y in which the inside of the circular frame is colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 36 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, and the intermediate gradation 31C positioned between the upper gradation 31F and the lower limit gradation 31L and illustrated by a horizontally long solid line that is slightly shorter than the upper gradation 31F. In addition, the upper limit gradation 31U, the upper gradation 31F, the lower limit gradation 31L, and the intermediate gradation 31C which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 333BK in which the inside of the circular frame that indicates the black ink is colored by the black-based color, the mark 333C in which the inside of the circular frame that indicates the cyan ink is colored by the blue-based color, the mark 333M in which the inside of the circular frame that indicates the magenta ink is colored by the red-based color, and the mark 333Y in which the inside of the circular frame that indicates the yellow ink is colored by the yellow-based color. In addition, the marks 333BK, 333C, 333M, and 333Y are arranged to be horizontally aligned.

5.37. Example 37

Figure 47:
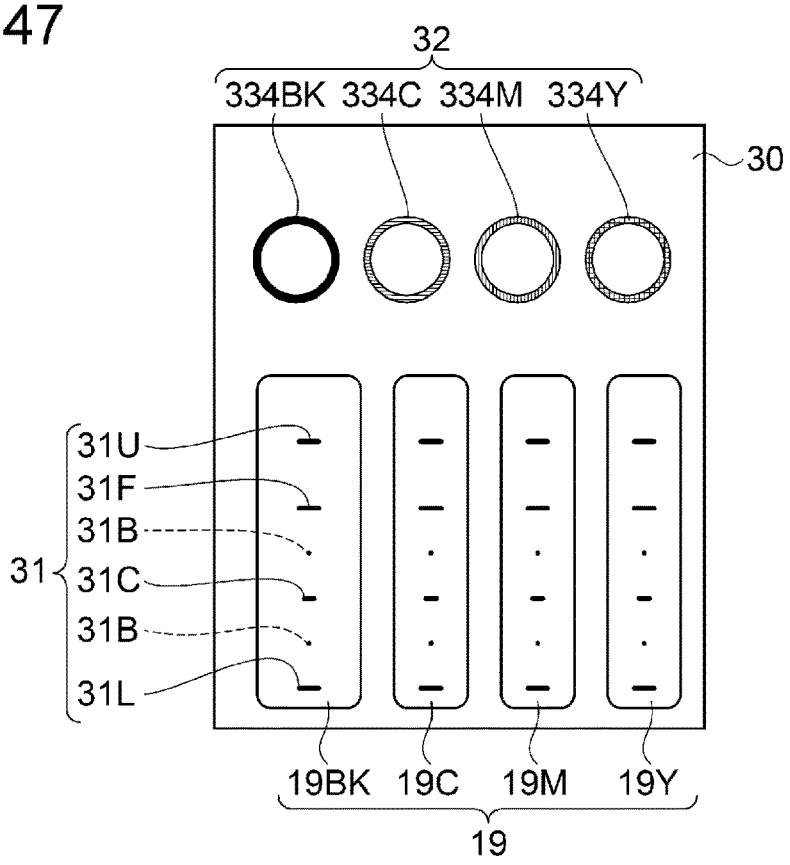
FIG. 47 is a front view illustrating light transmitting portions, gradations, and reference marks according to Example 37.

Light transmitting portions, gradations, and reference marks according to Example 37 will be described with reference to FIG. 47. In Example 37, as illustrated in FIG. 47, the reference mark 32 which is provided in the outer edge portion 30 and includes marks 334BK, 334C, 334M, and 334Y in which the circular frame is colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 37 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C positioned between the upper gradation 31F and the lower limit gradation 31L and illustrated by a horizontally long solid line that is slightly shorter than the upper gradation 31F, and the subdivided gradation 31B illustrated by a dot between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 334BK in which the circular frame that indicates the black ink is colored by the black-based color, the mark 334C in which the circular frame that indicates the cyan ink is colored by the blue-based color, the mark 334M in which the circular frame that indicates the magenta ink is colored by the red-based color, and the mark 334Y in which the circular frame that indicates the yellow ink is colored by the yellow-based color. In addition, the marks 334BK, 334C, 334M, and 334Y are arranged to be horizontally aligned.

5.38. Example 38

Figure 48:
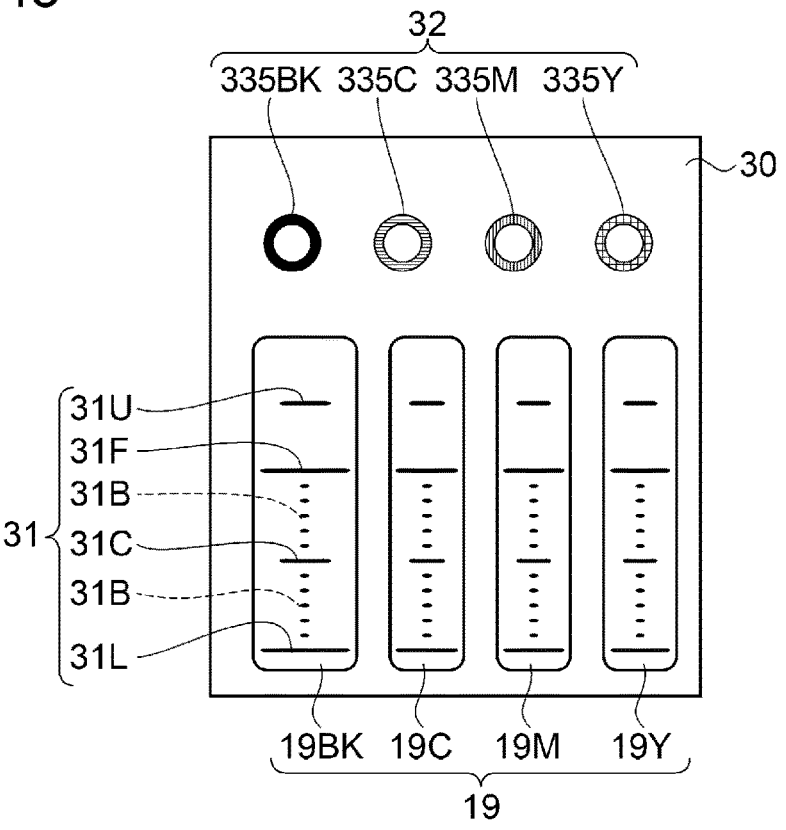
FIG. 48 is a front view illustrating light transmitting portions, gradations, and reference marks according to Example 38.

Light transmitting portions, gradations, and reference marks according to Example 38 will be described with reference to FIG. 48. In Example 38, as illustrated in FIG. 48, the reference mark 32 which is provided in the outer edge portion 30 and includes marks 335BK, 335C, 335M, and 335Y in which the circular frame that is slightly smaller and thicker than that of the above-described Example 37 is colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 38 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U illustrated by a horizontally long solid line, the upper gradation 31F and the lower limit gradation 31L which are illustrated by horizontally long solid lines that are slightly longer than the upper limit gradation 31U, the intermediate gradation 31C which is positioned between the upper gradation 31F and the lower limit gradation 31L and is illustrated by a horizontally long solid line of which the length is substantially the same as the upper limit gradation 31U, and the subdivided gradation 31B illustrated by a dot-like solid line between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The circular frame which is slightly smaller and thicker than that of the above-described Example 37 of the reference mark 32 is colored by the colors that correspond to the types of the ink. The reference mark 32 includes, for example, the mark 335BK in which the circular frame that indicates the black ink is colored by the black-based color, the mark 335C in which the circular frame that indicates the cyan ink is colored by the blue-based color, the mark 335M in which the circular frame that indicates the magenta ink is colored by the red-based color, and the mark 335Y in which the circular frame that indicates the yellow ink is colored by the yellow-based color. In addition, the marks 335BK, 335C, 335M, and 335Y are arranged to be horizontally aligned.

5.39. Example 39

Figure 49:
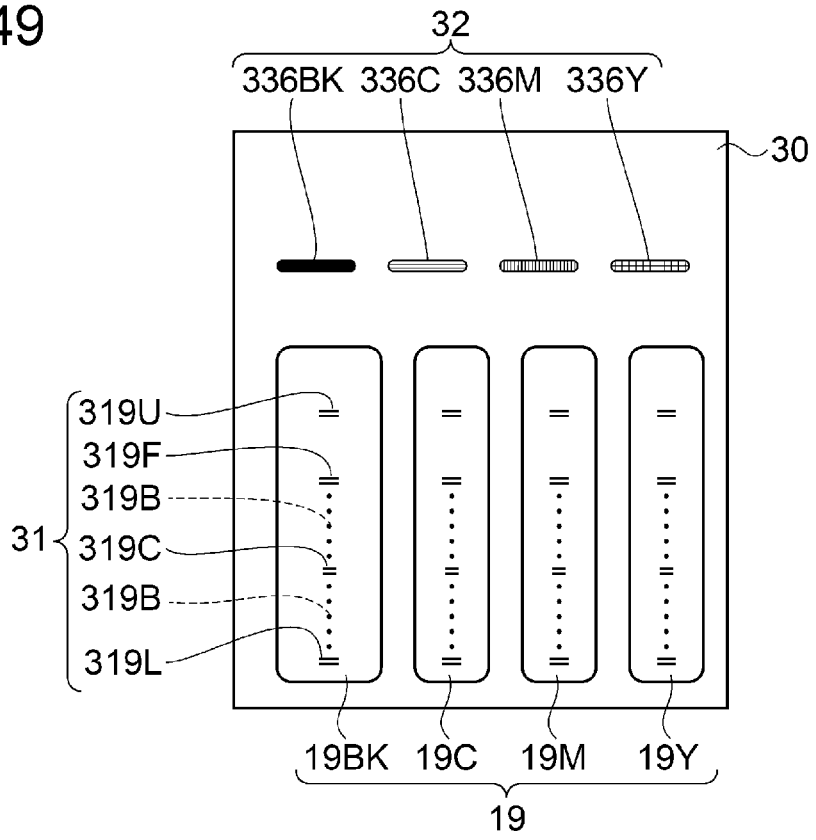
FIG. 49 is a front view illustrating light transmitting portions, gradations, and reference marks according to Example 39.

Light transmitting portions, gradations, and reference marks according to Example 39 will be described with reference to FIG. 49. In Example 39, as illustrated in FIG. 49, the reference mark 32 which is provided in the outer edge portion 30 and includes track-like horizontal line marks 336BK, 336C, 336M, and 336Y which are colored by the colors that correspond to the types of the ink, and the gradation 31 including an upper limit gradation 319U, an upper gradation 319F and the like which are illustrated by horizontally long double lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 39 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 319U, the upper gradation 319F, and the lower limit gradation 319L which are illustrated by horizontally long double lines, the intermediate gradation 319C which is positioned between the upper gradation 319F and the lower limit gradation 319L and is illustrated by a double line that is slightly shorter than the upper gradation 319F, and the subdivided gradation 319B illustrated by a dot-like solid line between the intermediate gradation 319C and each of the upper gradation 319F and the lower limit gradation 319L. In addition, the upper limit gradation 319U, the upper gradation 319F, the lower limit gradation 319L, the intermediate gradation 319C, and the subdivided gradation 319B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the horizontal line marks 336BK, 336C, 336M, and 336Y which have a shape a horizontally long track colored by the colors that correspond to the types of the ink. Specifically, the reference mark 32 includes, for example, the horizontal line mark 336BK colored by the black-based color to indicate the black ink, the horizontal line mark 336C colored by the blue-based color to indicate the cyan ink, the horizontal line mark 336M colored by the red-based color to indicate the magenta ink, and the horizontal line mark 336Y colored by the yellow-based color to indicate the yellow ink. In addition, the horizontal line marks 336BK, 336C, 336M, and 336Y are arranged to be horizontally aligned.

5.40. Example 40

Figure 50:
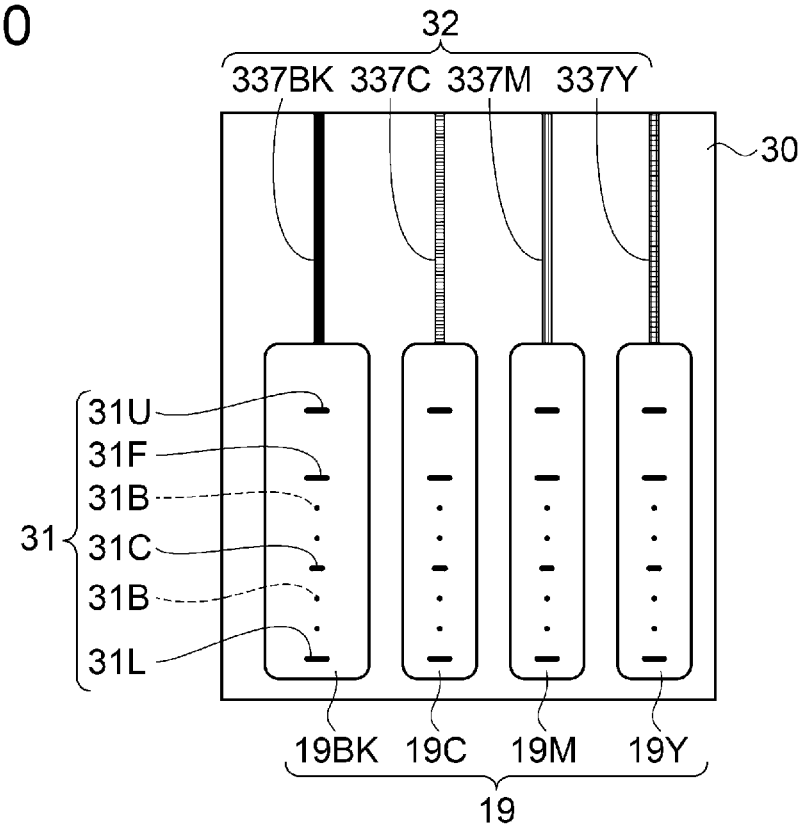
FIG. 50 is a front view illustrating light transmitting portions, gradations, and reference marks according to Example 40.

Light transmitting portions, gradations, and reference marks according to Example 40 will be described with reference to FIG. 50. In Example 40, as illustrated in FIG. 50, the reference mark 32 which is provided in the outer edge portion 30 and includes vertical line marks 337BK, 337C, 337M, and 337Y which are illustrated by vertically long lines colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 40 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line which is slightly shorter than the upper gradation 31F, and the subdivided gradation 31B illustrated by a dot between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the vertical line marks 337BK, 337C, 337M, and 337Y which are provided across the end above the light transmitting window portions 19BK, 19C, 19M, and 19Y from the upper end of the outer edge portion 30, and have a shape of a vertically long line colored by the colors that correspond to the types of the ink. Specifically, the reference mark 32 includes, for example, the vertical line mark 337BK colored by the black-based color to indicate the black ink, the vertical line mark 337C colored by the blue-based color to indicate the cyan ink, the vertical line mark 337M colored by the red-based color to indicate the magenta ink, and the vertical line mark 337Y colored by the yellow-based color to indicate the yellow ink. In addition, the vertical line marks 337BK, 337C, 337M, and 337Y are arranged to be horizontally aligned.

5.41. Example 41

Figure 51:
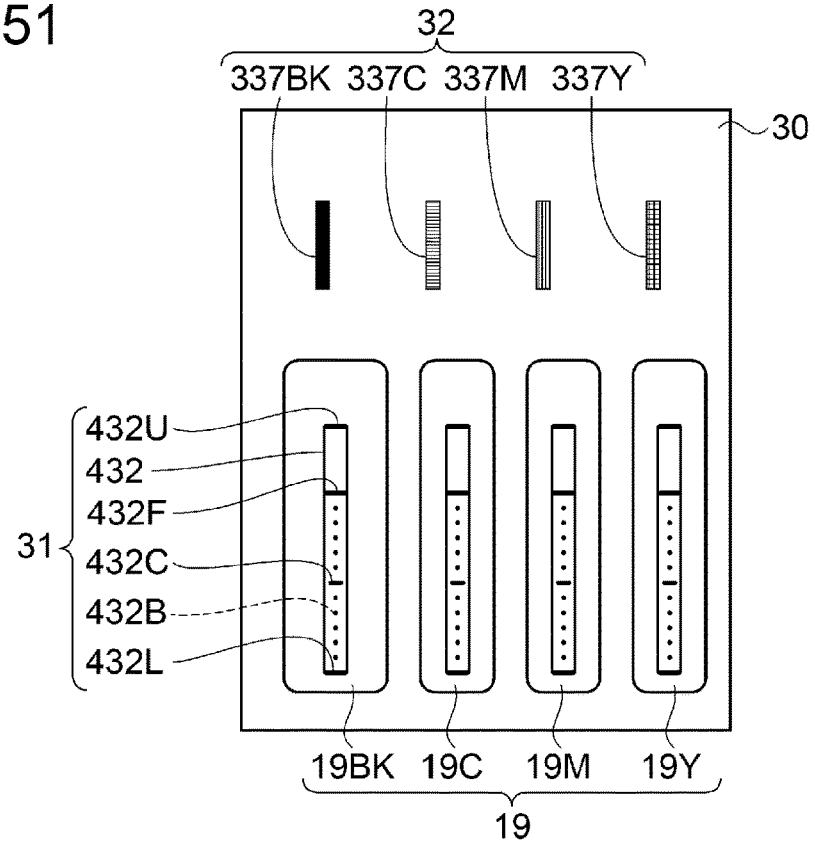
FIG. 51 is a front view illustrating light transmitting portions, gradations, and reference marks according to Example 41.

Light transmitting portions, gradations, and reference marks according to Example 41 will be described with reference to FIG. 51. In Example 41, as illustrated in FIG.

51, the reference mark 32 which is provided in the outer edge portion 30 and includes the vertical line marks 337BK, 337C, 337M, and 337Y which are illustrated by vertically long lines colored by the colors that correspond to the types of the ink, and the gradation 31 in which an upper limit gradations 432U, an upper gradation 432F, a lower limit gradation 432L and the like which are illustrated by horizontally long solid lines provided in the light transmitting window portions 19BK, 19C, 19M, and 19Y are surrounded by a frame line 432, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 41 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The vertically long rectangular frame line 432 is provided in center portions of each of the light transmitting window portions 19BK, 19C, 19M, and 19Y. In addition, the gradation 31 is provided in the frame line 432. The gradation 31 includes the upper limit gradation 432U illustrated by a horizontally long solid line to overlap the upper side of the frame line 432, the lower limit gradation 432L illustrated by a horizontally long solid line to overlap the lower side of the frame line 432, the upper gradation 432F which is below the upper limit gradation 432U and is illustrated by a horizontally long solid line, an intermediate gradation 432C which is between the upper gradation 432F and the lower limit gradation 432L and is illustrated by a horizontally long solid line that is slightly shorter than the upper gradation 432F, and a subdivided gradation 432B illustrated by a dot between the intermediate gradation 432C and each of the upper gradation 432F and the lower limit gradation 432L. In addition, the frame line 432, the upper limit gradation 432U, the upper gradation 432F, the lower limit gradation 432L, the intermediate gradation 432C, and the subdivided gradation 432B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the vertical line marks 337BK, 337C, 337M, and 337Y which are positioned above each of the light transmitting window portions 19BK, 19C, 19M, and 19Y and have a shape of a vertically long line colored by the colors that correspond to the types of the ink. Specifically, the reference mark 32 includes, for example, the vertical line mark 337BK colored by the black-based color to indicate the black ink, the vertical line mark 337C colored by the blue-based color to indicate the cyan ink, the vertical line mark 337M colored by the red-based color to indicate the magenta ink, and the vertical line mark 337Y colored by the yellow-based color to indicate the yellow ink. In addition, the vertical line marks 337BK, 337C, 337M, and 337Y are arranged to be horizontally aligned.

5.42. Example 42

Figure 52:
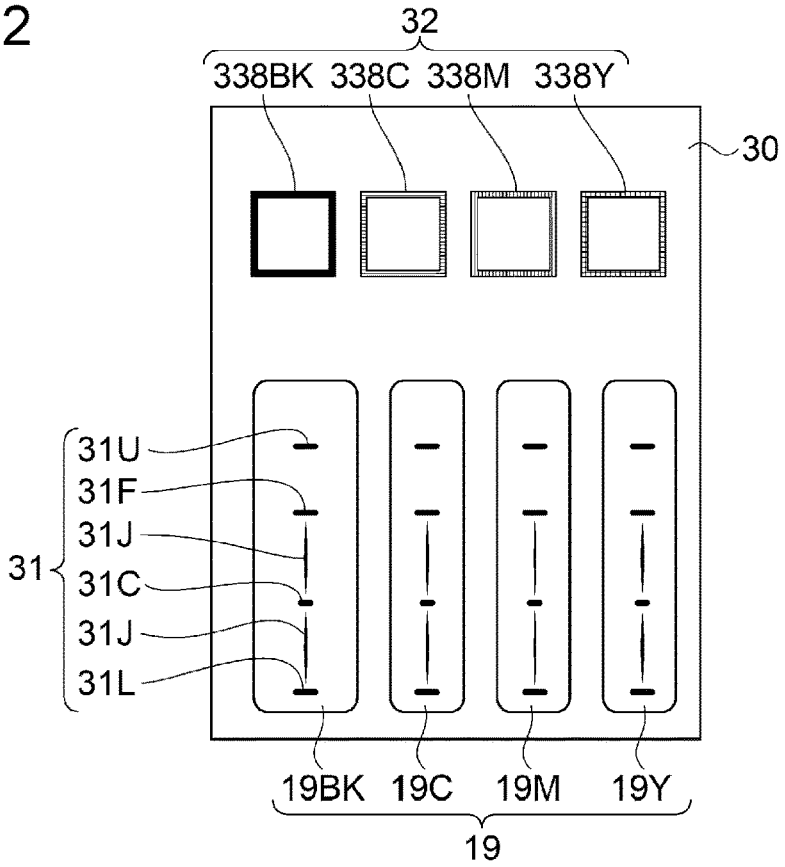
FIG. 52 is a front view illustrating light transmitting portions, gradations, and reference marks according to Example 42.

Light transmitting portions, gradations, and reference marks according to Example 42 will be described with reference to FIG. 52. In Example 42, as illustrated in FIG. 52, the reference mark 32 which is provided in the outer edge portion 30 and includes marks 338BK, 338C, 338M, and 338Y in which frame lines having a shape of a substantial square are colored by the colors that correspond to the types of the ink, and the gradation 31 in which the upper limit gradations 31U, the upper gradation 31F, and a vertically long line 31J and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 42 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line which is slightly shorter than the upper gradation 31F, and the vertically long line 31J of which the width of the center portion provided between the intermediate gradation 31C and each of the upper gradation 31F and the lower limit gradation 31L is wide. In addition, the upper limit gradation 31U, the upper gradation 31F, the lower limit gradation 31L, the intermediate gradation 31C, and the vertically long line 31J which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 338BK in which the frame line having a shape of a substantial square that indicates the black ink is colored by the black-based color, the mark 338C in which the frame line having a shape of a substantial square that indicates the cyan ink is colored by the blue-based color, the mark 338M in which the frame line having a shape of a substantial square that indicates the magenta ink is colored by the red-based color, and the mark 338Y in which the frame line having a shape of a substantial square that indicates the yellow ink is colored by the yellow-based color. In addition, the marks 338BK, 338C, 338M, and 338Y are arranged to be horizontally aligned.

5.43. Example 43

Figure 53:
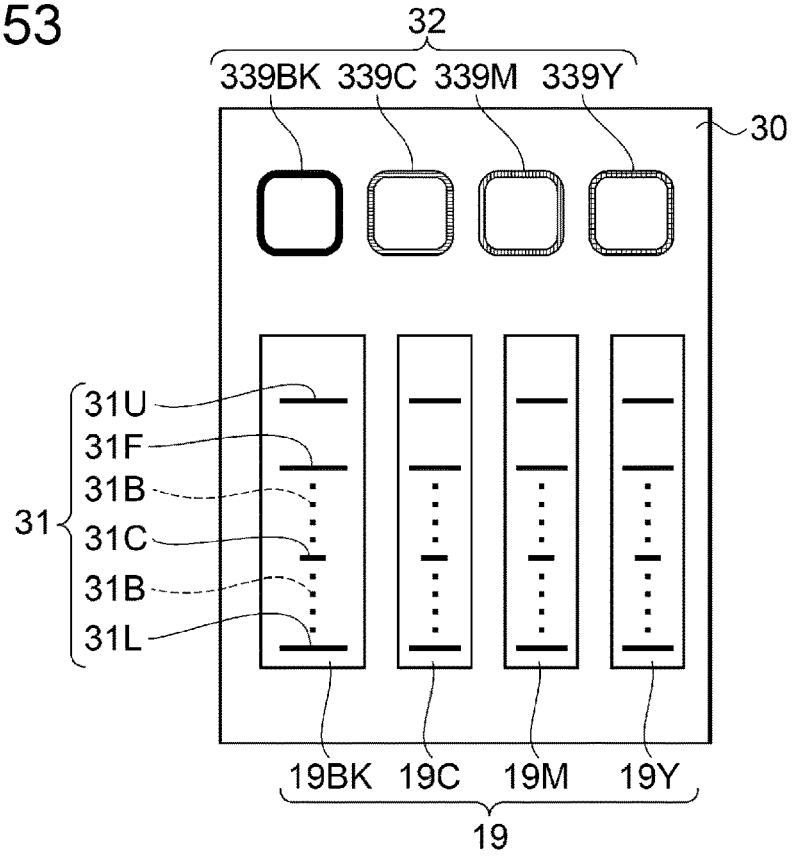
FIG. 53 is a front view illustrating light transmitting portions, gradations, and reference marks according to Example 43.

Light transmitting portions, gradations, and reference marks according to Example 43 will be described with reference to FIG. 53. In Example 43, as illustrated in FIG. 53, the reference mark 32 which is provided in the outer edge portion 30 and includes marks 339BK, 339C, 339M, and 339Y in which square and round frame lines having a shape of a substantial square are colored by the colors that correspond to the types of the ink, and the gradation 31 including the upper limit gradation 31U, the upper gradation 31F, the subdivided gradation 31B and the like which are illustrated by horizontally long solid lines which are longish and are provided in the light transmitting window portions 19BK, 19C, 19M, and 19Y. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 43 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines which are longish, the intermediate gradation 31C which is positioned between the upper gradation 31F and the lower limit gradation 31L and is illustrated by a horizontally long solid line of which the length is approximately a half of the upper gradation 31F, and the subdivided gradation 31B which is illustrated by a plurality of dots between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 339BK in which the square and round frame line having a shape of a substantial square that indicates the black ink is colored by the black-based color, the mark 339C in which the square and round frame line having a shape of a substantial square that indicates the cyan ink is colored by the blue-based color, the mark 339M in which the square and round frame line having a shape of a substantial square that indicates the magenta ink is colored by the red-based color, and the mark 339Y in which the square and round frame line having a shape of a substantial square that indicates the yellow ink is colored by the yellow-based color. In addition, the marks 339BK, 339C, 339M, and 339Y are arranged to be horizontally aligned.

5.44. Example 44

Figure 54:
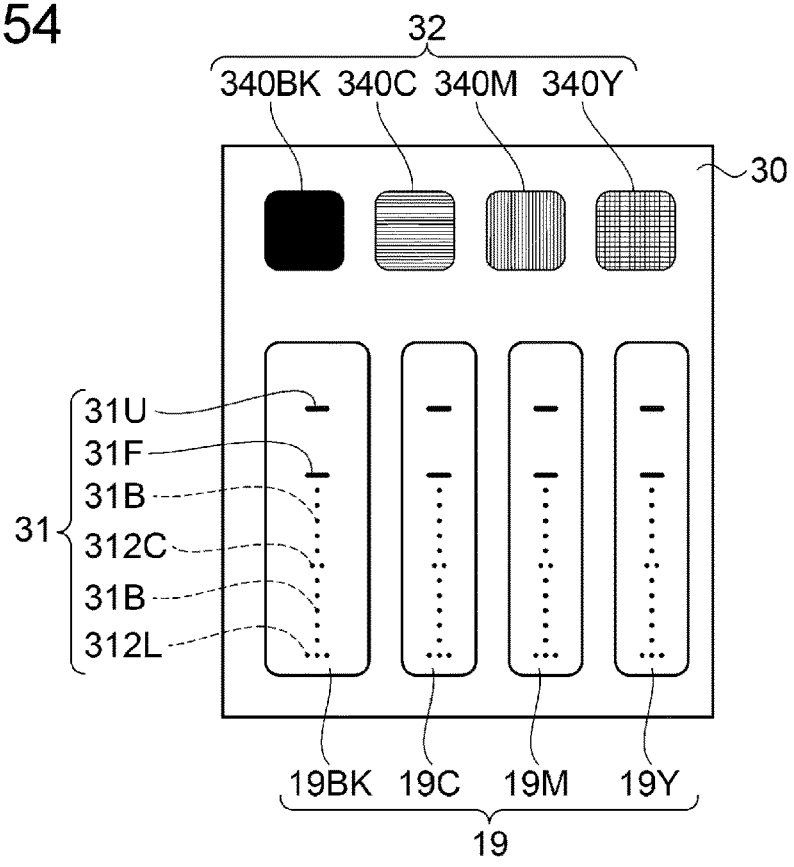
FIG. 54 is a front view illustrating light transmitting portions, gradations, and reference marks according to Example 44.

Light transmitting portions, gradations, and reference marks according to Example 44 will be described with reference to FIG. 54. In Example 44, as illustrated in FIG. 54, the reference mark 32 which is provided in the outer edge portion 30 and includes marks 340BK, 340C, 340M, and 340Y in which the inside of square and round frame lines having a shape of a substantial square is colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 44 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U and the upper gradation 31F which are illustrated by horizontally long solid lines, the lower limit gradation 312L illustrated by a horizontally aligned three dots, the intermediate gradation 312C illustrated by horizontally aligned two dots between the upper gradation 31F and the lower limit gradation 312L, and the subdivided gradation 31B illustrated by a plurality of dots between the intermediate gradation 312C and each of the upper gradation 31F and the lower limit gradation 312L. In addition, the upper limit gradation 31U, the upper gradation 31F, the lower limit gradation 312L, the intermediate gradation 312C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 340BK in which the inside of the square and round frame line having a shape of a substantial square that indicates the black ink is colored by the black-based color, the mark 340C in which the inside of the square and round frame line having a shape of a substantial square that indicates the cyan ink is colored by the blue-based color, the mark 340M in which the inside of the square and round frame line having a shape of a substantial square that indicates the magenta ink is colored by the red-based color, and the mark 340Y in which the inside of the square and round frame line having a shape of a substantial square that indicates the yellow ink is colored by the yellow-based color. In addition, the marks 340BK, 340C, 340M, and 340Y are arranged to be horizontally aligned.

5.45. Example 45

Figure 55:
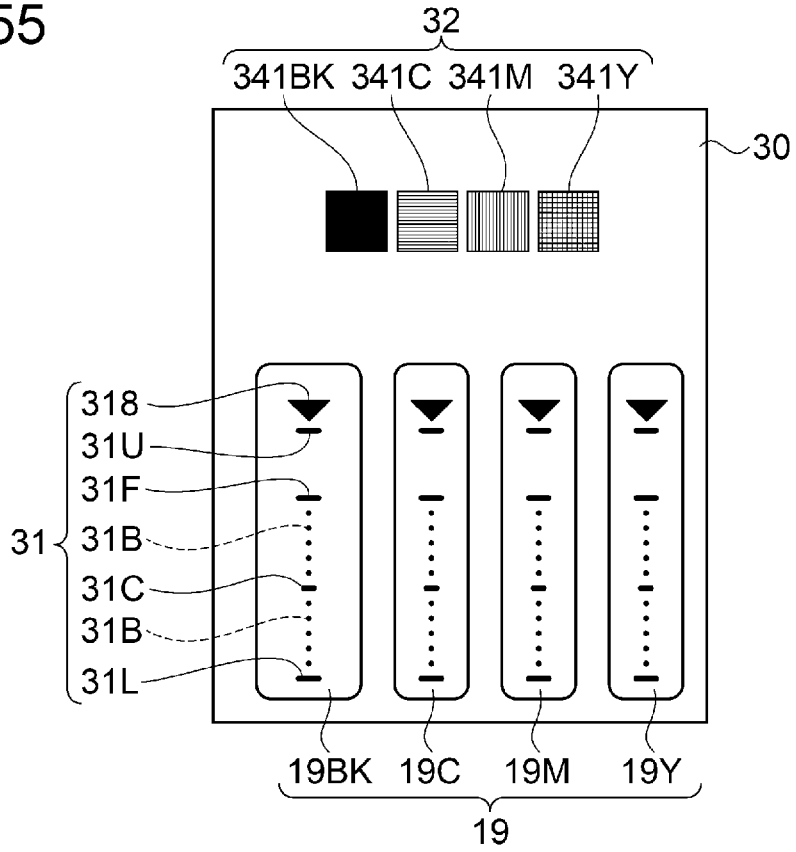
FIG. 55 is a front view illustrating light transmitting portions, gradations, and reference marks according to Example 45.

Light transmitting portions, gradations, and reference marks according to Example 45 will be described with reference to FIG. 55. In Example 45, as illustrated in FIG. 55, the reference mark 32 which is provided in the outer edge portion 30 and includes marks 341BK, 341C, 341M, and 341Y in which the inside of frame lines having a shape of a substantial square that is slightly small is colored by the colors that correspond to the types of the ink, and which are disposed to be horizontally aligned, and the gradation 31 including the upper limit gradation 31U, the upper gradation 31F, a triangular mark 318 above the upper limit gradation 31U, which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 45 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line which is slightly shorter than the upper gradation 31F, and the subdivided gradation 31B illustrated by a plurality of dots between the intermediate gradation 31C and each of the upper gradation 31F and the lower limit gradation 31L. Furthermore, the gradation 31 includes the triangular mark 318 which is above the upper limit gradation 31U and of which one top is oriented downward. In addition, the upper limit gradation 31U, the upper gradation 31F, the lower limit gradation 31L, the intermediate gradation 31C, the subdivided gradation 31B, and the triangular mark 318 which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 341BK in which the inside of the frame line having a shape of a substantial square that indicates the black ink is colored by the black-based color, the mark 341C in which the inside of the frame line having a shape of a substantial square that indicates the cyan ink is colored by the blue-based color, the mark 341M in which the inside of the frame line having a shape of a substantial square that indicates the magenta ink is colored by the red-based color, and the mark 341Y in which the inside of the frame line having a shape of a substantial square that indicates the yellow ink is colored by the yellow-based color. In addition, the marks 341BK, 341C, 341M, and 341Y are arranged to be horizontally aligned.

5.46. Example 46

Figure 56:
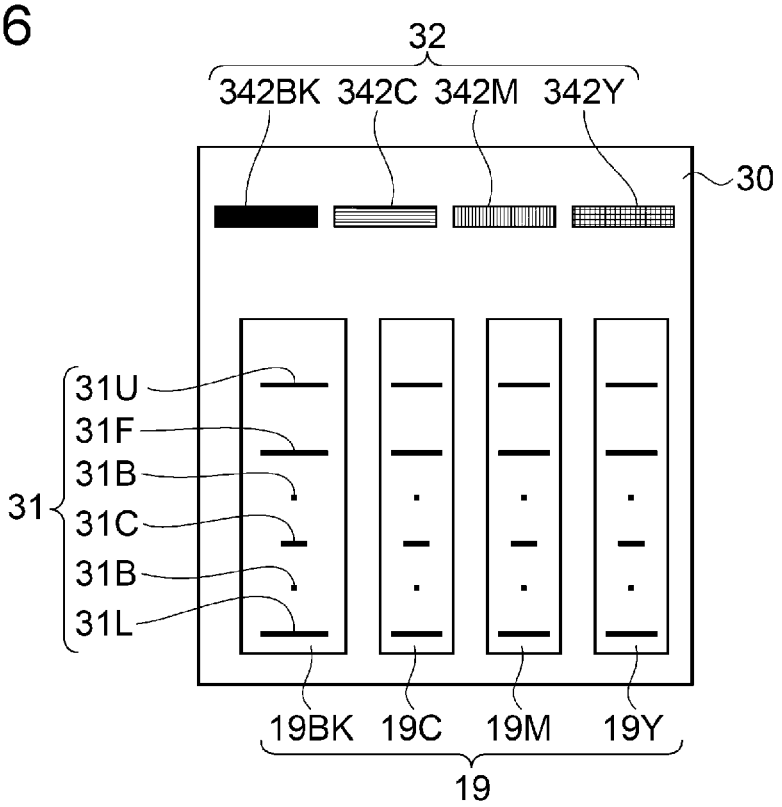
FIG. 56 is a front view illustrating light transmitting portions, gradations, and reference marks according to Example 46.

Light transmitting portions, gradations, and reference marks according to Example 46 will be described with reference to FIG. 56. In Example 46, as illustrated in FIG. 56, the reference mark 32 which is provided in the outer edge portion 30 and includes marks 342BK, 342C, 342M, and 342Y in which the inside of substantially long rectangular frame lines is colored by the colors that correspond to the types of the ink, and which are disposed to be horizontally aligned, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 46 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line of which the length is approximately a half of the upper gradation 31F, and the subdivided gradation 31B illustrated by a dot between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 342BK in which the inside of the horizontally long rectangular frame line that indicates the black ink is colored by the black-based color, the mark 342C in which the inside of the horizontally long rectangular frame line that indicates the cyan ink is colored by the blue-based color, the mark 342M in which the inside of the horizontally long rectangular frame line that indicates the magenta ink is colored by the red-based color, and the mark 342Y in which the inside of the horizontally long rectangular frame line that indicates the yellow ink is colored by the yellow-based color. In addition, the marks 342BK, 342C, 342M, and 342Y are arranged to be horizontally aligned.

5.47. Example 47

Figure 57:
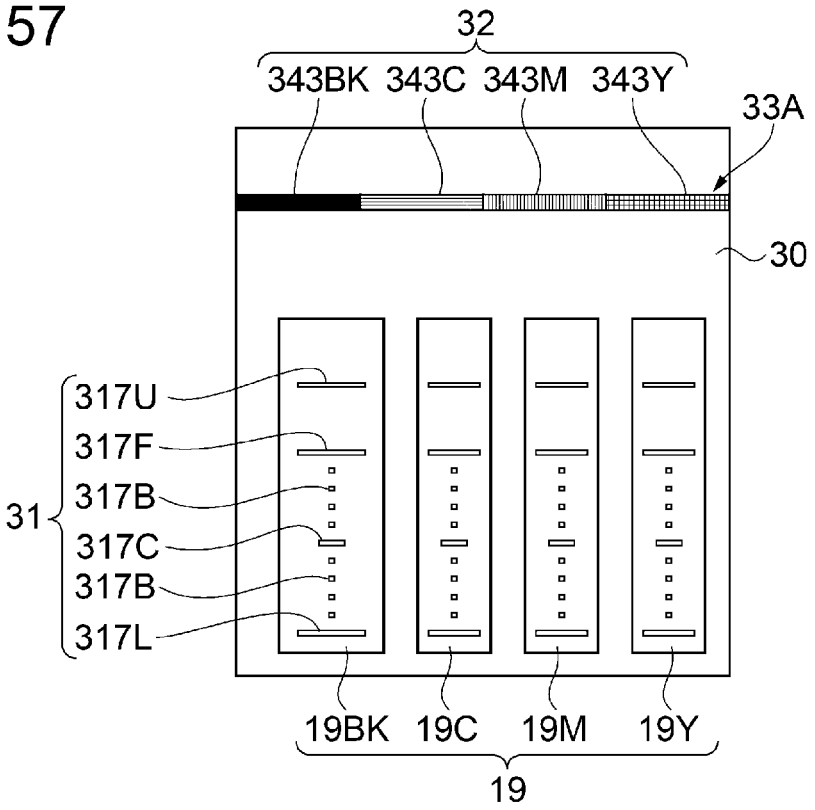
FIG. 57 is a front view illustrating light transmitting portions, gradations, and reference marks according to Example 47.

Light transmitting portions, gradations, and reference marks according to Example 47 will be described with reference to FIG. 57. In Example 47, as illustrated in FIG. 57, the reference mark 32 including color marks 343BK, 343C, 343M, and 343Y in which the inside of each of the regions obtained by dividing the frame of the horizontally long fine belt-like color line 33A into four, and are colored by the colors that illustrate the types of the ink, and the gradation 31 including an upper limit gradation 317U, an upper gradation 317F, a lower limit gradation 317L, an intermediate gradation 317C, and a subdivided gradation 317B which are illustrated by an outlined line provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 47 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 317U, the upper gradation 317F, and the lower limit gradation 317L which are illustrated by a horizontally long outlined lines that is longish, the intermediate gradation 317C which is positioned between the upper gradation 317F and the lower limit gradation 317L and is illustrated by a horizontally long outlined line of which the length is approximately a half of the upper gradation 317F, and the subdivided gradation 317B illustrated by a plurality of outlined dots between the intermediate gradation 317C and each of the upper gradation 317F and the lower limit gradation 317L. In addition, the upper limit gradation 317U, the upper gradation 317F, the lower limit gradation 317L, the intermediate gradation 317C, and the subdivided gradation 317B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21, and include the color marks 343BK, 343C, 343M, and 343Y which correspond to each of the light transmitting window portions 19BK, 19C, 19M, and 19Y. The reference mark 32 includes horizontally long belt-like (horizontally long rectangular shape in the example) regions obtained by dividing the frame of the horizontally long fine belt-like color line 33A into four, and each of the regions are colored by the colors that correspond to the types of the ink. Specifically, the color mark 343BK which corresponds to the light transmitting window portion 19BK, is colored by the black-based color, and indicates the black ink, the color mark 343C which corresponds to the light transmitting window portion 19C, is colored by the blue-based color, and indicates the cyan ink, the color mark 343M which corresponds to the light transmitting window portion 19M, is colored by the red-based color, and indicates the magenta ink, and the color mark 343Y which corresponds to the light transmitting window portion 19Y, is colored by the yellow-based color, and indicates the yellow ink.

5.48. Example 48

Figure 58:
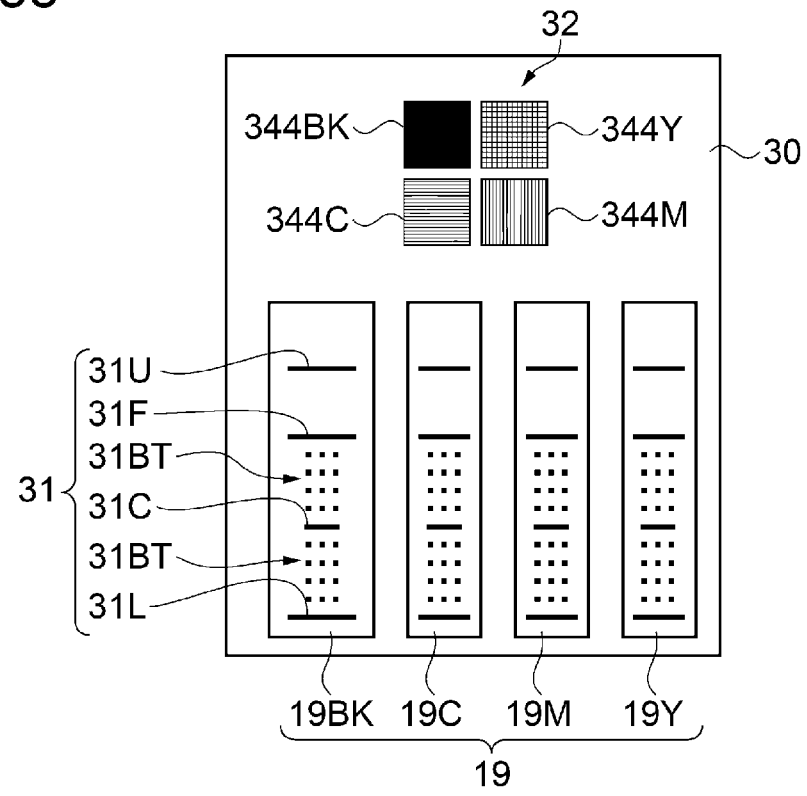
FIG. 58 is a front view illustrating light transmitting portions, gradations, and reference marks according to Example 48.

Light transmitting portions, gradations, and reference marks according to Example 48 will be described with reference to FIG. 58. In Example 48, as illustrated in FIG. 58, the reference mark 32 in which marks 344BK, 344C, 344M, and 344Y in which the inside of the frame lines having a shape of a substantial square is colored by the colors that correspond to the types of the ink are disposed in a shape of a matrix having two rows and two lines, and the gradation 31 including the upper limit gradation 31U, the upper gradation 31F, the lower limit gradation 31L, and the intermediate gradation 31C which are illustrated by horizontally long solid lines provided in the light transmitting window portions 19BK, 19C, 19M, and 19Y, and a subdivided gradation 31BT in which the dots are disposed in the shape of the matrix. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 48 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines which are longish, the intermediate gradation 31C which is positioned between the upper gradation 31F and the lower limit gradation 31L and is illustrated by a horizontally long solid line which is shorter than the upper gradation 31F, and the subdivided gradation 31BT in which a plurality of dots are disposed in a shape of a matrix between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31BT which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes, for example, the mark 344BK in which the inside of the frame line having a shape of a substantial square that indicates the black ink is colored by the black-based color, the mark 344C in which the inside of the frame line having a shape of a substantial square that indicates the cyan ink is colored by the blue-based color, the mark 344M in which the inside of the frame line having a shape of a substantial square that indicates the magenta ink is colored by the red-based color, and the mark 344Y in which the inside of the frame line having a shape of a substantial square that indicates the yellow ink is colored by the yellow-based color. In addition, the mark 344BK and the mark 344Y are aligned in the upper row, and the mark 344C and the mark 344M are aligned in the lower row. In other words, the four marks 344BK, 344C, 344M, and 344Y are disposed to make a quadrangle in which the marks are disposed in a shape of a matrix having two rows and two lines.

5.49. Example 49

Figure 59:
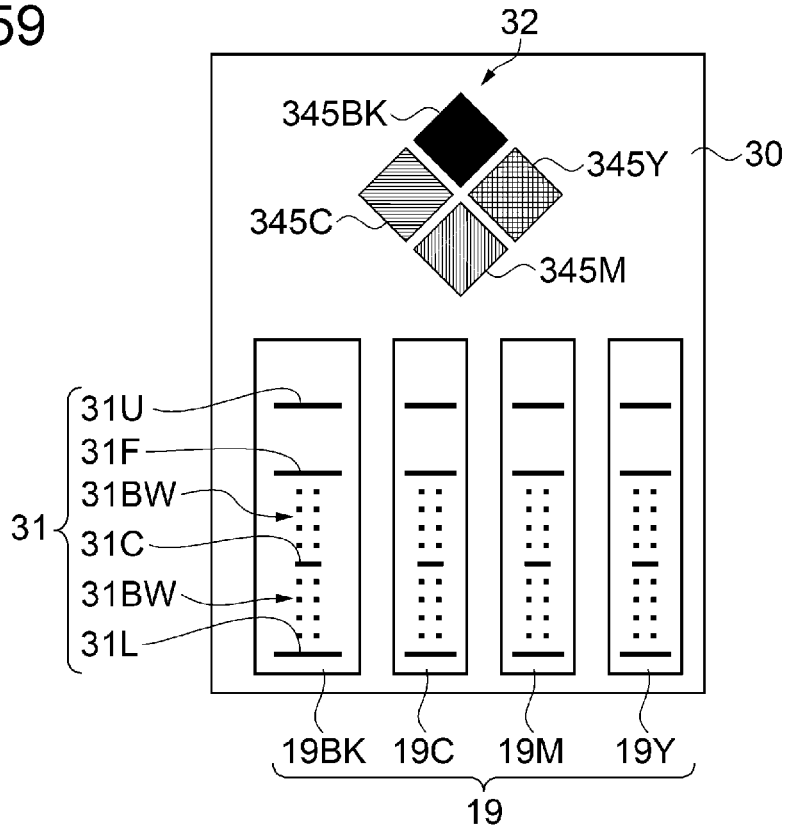
FIG. 59 is a front view illustrating light transmitting portions, gradations, and reference marks according to Example 49.

Light transmitting portions, gradations, and reference marks according to Example 49 will be described with reference to FIG. 59. In Example 49, as illustrated in FIG. 59, the reference mark 32 which makes a so-called diamond shape in which marks 345BK, 345C, 345M, and 345Y in which the inside of the frame line having a shape of a substantial square is colored by the colors that correspond to the types of the ink are respectively inclined by 45 degrees, and the mark 345BK, the mark 345M, the mark 345C, and the mark 345Y are respectively disposed in the upper top portion, in the lower top portion, in the left top portion, and in the right top portion, is provided. The configuration of the light transmitting window portions 19BK, 19C, 19M, and 19Y, and the gradation 31 including the upper limit gradation 31U, the upper gradation 31F, the lower limit gradation 31L, the intermediate gradation 31C, and a subdivided gradation 31BW which are provided in the light transmitting window portions 19BK, 19C, 19M, and 19Y, are similar to that of the above-described Example 48, and the description thereof will be omitted.

The reference mark 32 provided in the outer edge portion 30 above the light transmitting window portions 19BK, 19C, 19M, and 19Y illustrate the types of the ink accommodated in each of the four tanks 21. The reference mark 32 includes, for example, the mark 345BK in which the inside of the frame line having a shape of a substantial square that indicates the black ink is colored by the black-based color, the mark 345C in which the inside of the frame line having a shape of a substantial square that indicates the cyan ink is colored by the blue-based color, the mark 345M in which the inside of the frame line having a shape of a substantial square that indicates the magenta ink is colored by the red-based color, and the mark 345Y in which the inside of the frame line having a shape of a substantial square that indicates the yellow ink is colored by the yellow-based color. In addition, the mark 345BK, the mark 345M, the mark 345C, and the mark 345Y are disposed making a so-called diamond shape while being respectively considered as the upper top portion, the lower top portion, the left top portion, and the right top portion.

5.50. Example 50

Figure 60:
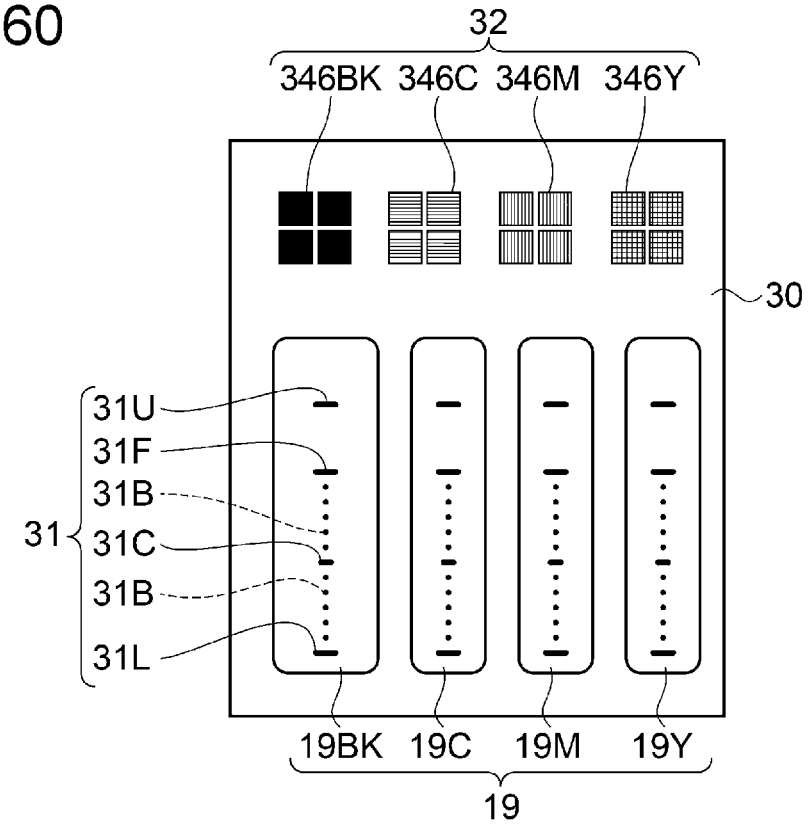
FIG. 60 is a front view illustrating light transmitting portions, gradations, and reference marks according to Example 50.

Light transmitting portions, gradations, and reference marks according to Example 50 will be described with reference to FIG. 60. In Example 50, as illustrated in FIG. 60, the reference mark 32 in which four marks 346BK, 346C, 346M, and 346Y in which small marks in which the inside of the frame line having a shape of a substantial square is colored by the colors that correspond to the types of the ink are disposed in a shape of a matrix having two rows and two lines, are arranged to be horizontally aligned, and the gradation 31 including the upper limit gradation 31U, the upper gradation 31F, the lower limit gradation 31L and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 50 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line which is slightly shorter than the upper gradation 31F, and the subdivided gradation 31B illustrated by a plurality of dots between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the mark 346BK in which four small marks in which the inside of the frame line having a shape of a substantial square that indicates the black ink is colored by the black-based color are aligned in a shape of a square matrix, the mark 346C in which four small marks in which the inside of the frame line having a shape of a substantial square that indicates the cyan ink is colored by the blue-based color are aligned in a shape of a square matrix, the mark 346M in which four small marks in which the inside of the frame line having a shape of a substantial square that indicates the magenta ink is colored by the red-based color are aligned in a shape of a square matrix, and the mark 346Y in which four small marks in which the inside of the frame line having a shape of a substantial square that indicates the yellow ink is colored by the yellow-based color are aligned in a shape of a square matrix. In addition, the reference mark 32 in which four marks 346BK, 346C, 346M, and 346Y are arranged to be horizontally aligned, is configured.

5.51. Example 51

Figure 61:
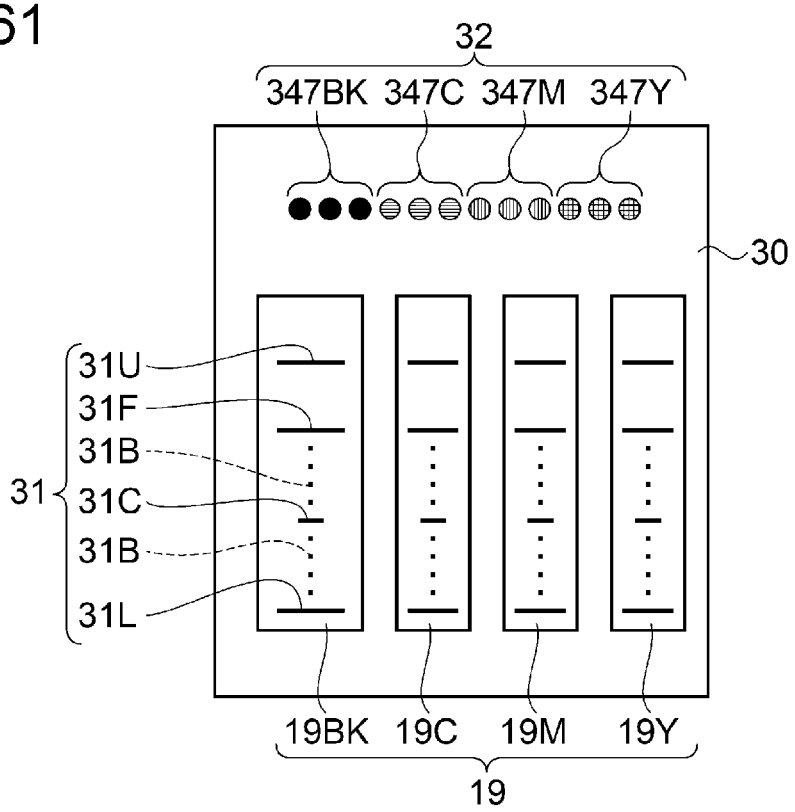
FIG. 61 is a front view illustrating light transmitting portions, gradations, and reference marks according to Example 51.

Light transmitting portions, gradations, and reference marks according to Example 51 will be described with reference to FIG. 61. In Example 51, as illustrated in FIG. 61, the reference mark 32 in which marks 347BK, 347C, 347M, and 347Y in which three small marks in which the inside of the circular frame line is colored by the colors that correspond to the types of the ink are respectively disposed to be horizontally aligned, are arranged to be horizontally aligned, and the gradation 31 including the upper limit gradation 31U, the upper gradation 31F, the lower limit gradation 31L and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 51 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line of which the length is approximately a half of the upper gradation 31F, and the subdivided gradation 31B illustrated by a plurality of dots between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the mark 347BK in which three small marks in which the inside of the circular frame line that indicates the black ink is colored by the black-based color are disposed to be horizontally aligned, the mark 347C in which three small marks in which the inside of the circular frame line that indicates the cyan ink is colored by the blue-based color are disposed to be horizontally aligned, the mark 347M in which three small marks in which the inside of the circular frame line that indicates the magenta ink is colored by the red-based color are disposed to be horizontally aligned, and the mark 347Y in which three small marks in which the inside of the circular frame line that indicates the yellow ink is colored by the yellow-based color are disposed to be horizontally aligned. In addition, the reference mark 32 in which four marks 347BK, 347C, 347M, and 347Y are arranged to be horizontally aligned, is configured.

5.52. Example 52

Figure 62:
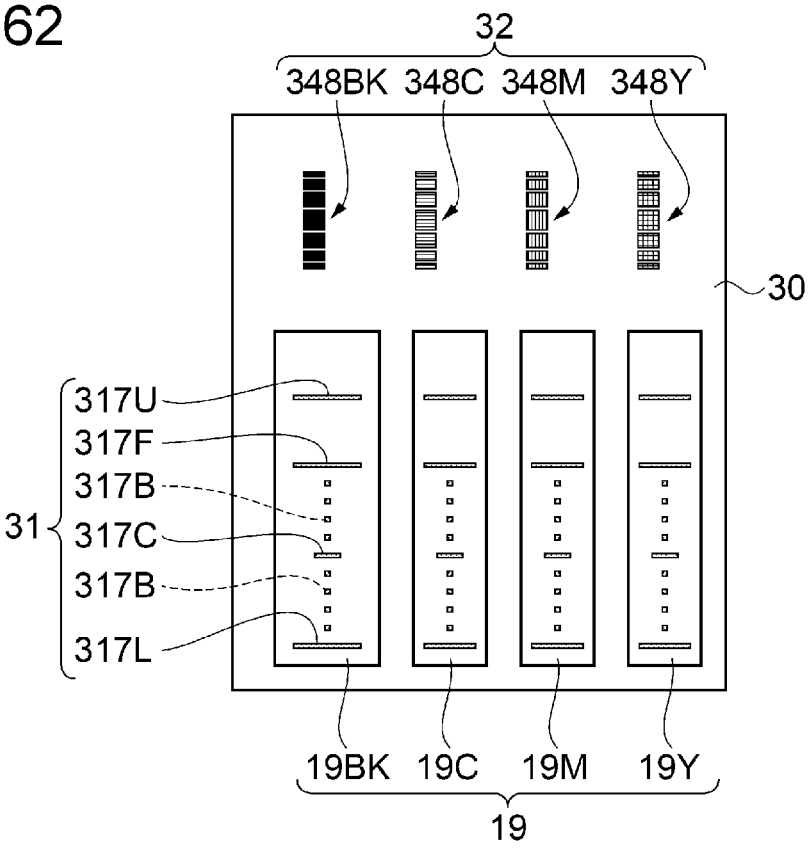
FIG. 62 is a front view illustrating light transmitting portions, gradations, and reference marks according to Example 52.

Light transmitting portions, gradations, and reference marks according to Example 52 will be described with reference to FIG. 62. In Example 52, as illustrated in FIG. 62, the reference mark 32 in which marks 348BK, 348C, 348M, and 348Y in which seven small marks in which the inside of quadrangular frame lines is colored by the colors that correspond to the types of the ink are respectively disposed to be horizontally aligned, are arranged to be horizontally aligned, and the gradation 31 including the upper limit gradation 317U, the upper gradation 317F, the lower limit gradation 317L and the like which are illustrated by a horizontally long lines with a frame provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 52 have light transmission properties, and have a substantially rectangular shape which is vertically long from the upper side to the lower side. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 317U, the upper gradation 317F, and the lower limit gradation 317L which are illustrated by a horizontally long outlined lines, the intermediate gradation 317C which is positioned between the upper gradation 317F and the lower limit gradation 317L and is illustrated by a horizontally long outlined line of which the length is approximately a half of the upper gradation 317F, and the subdivided gradation 317B illustrated by a plurality of dots with a frame between the intermediate gradation 317C and each of the upper gradation 317F and the lower limit gradation 317L. In addition, the upper limit gradation 317U, the upper gradation 317F, the lower limit gradation 317L, the intermediate gradation 317C, and the subdivided gradation 317B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes the mark 348BK in which seven small marks in which the inside of quadrangular frame lines is colored by the black-based color that indicates the black ink are respectively disposed to be vertically aligned, the mark 348C in which seven small marks in which the inside of quadrangular frame lines is colored by the blue-based color that indicates the cyan ink are respectively disposed to be vertically aligned, the mark 348M in which seven small marks in which the inside of quadrangular frame lines is colored by the red-based color that indicates the magenta ink are respectively disposed to be vertically aligned, and the mark 348Y in which seven small marks in which the inside of quadrangular frame lines is colored by the yellow-based color that indicates the yellow ink are respectively disposed to be vertically aligned. In addition, each of the small marks that configure the marks 348BK, 348C, 348M, and 348Y formed such that the height of the small mark in the center portion is the largest, and the height of the small marks decreases as approaching both ends. In addition, the reference mark 32 in which the four marks 348BK, 348C, 348M, and 348Y are arranged to be horizontally aligned, is configured.

5.53. Example 53

Figure 63:
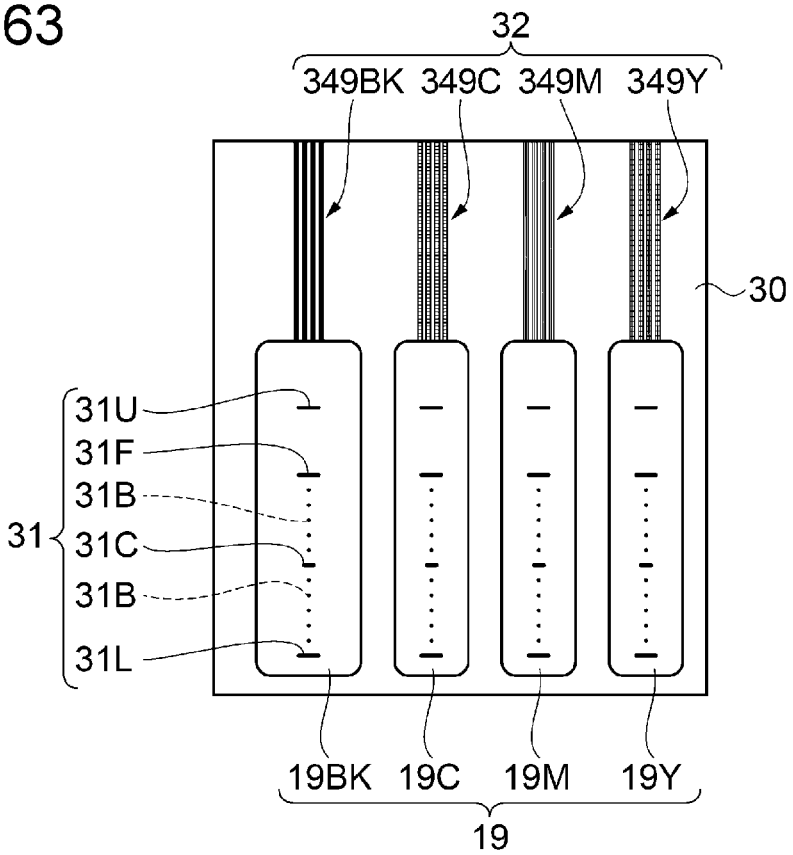
FIG. 63 is a front view illustrating light transmitting portions, gradations, and reference marks according to Example 53.

Light transmitting portions, gradations, and reference marks according to Example 53 will be described with reference to FIG. 63. In Example 53, as illustrated in FIG. 63, the reference mark 32 which is provided in the outer edge portion 30 and includes vertical line marks 349BK, 349C, 349M, and 349Y in which a plurality of vertically long lines colored by the colors that correspond to the types of the ink are disposed to be horizontally aligned, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 53 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by a horizontally long solid lines, the intermediate gradation 31C which is positioned between the upper gradation 31F and the lower limit gradation 31L and is illustrated by a horizontally long solid line which is slightly shorter than the upper gradation 31F, and the subdivided gradation 31B illustrated by a plurality of dots between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes vertical line marks 349BK, 349C, 349M, and 349Y which are provided from the upper end of the outer edge portion 30 to the end above the light transmitting window portions 19BK, 19C, 19M, and 19Y, and in which a plurality of vertically long lines colored by the colors that correspond to the types of the ink are disposed to be horizontally aligned. Specifically, the reference mark 32 includes, for example, the vertical line mark 349BK in which the plurality of vertically long lines colored by the black-based color to indicate the black ink are disposed to be horizontally aligned, the vertical line mark 349C in which the plurality of vertically long lines colored by the blue-based color to indicate the cyan ink are disposed to be horizontally aligned, the vertical line mark 349M in which the plurality of vertically long lines colored by the red-based color to indicate the magenta ink are disposed to be horizontally aligned, and the vertical line mark 349Y in which the plurality of vertically long lines colored by the yellow-based color to indicate the yellow ink are disposed to be horizontally aligned. In addition, the vertical line marks 349BK, 349C, 349M, and 349Y are arranged to be horizontally aligned.

5.54. Example 54

Figure 64:
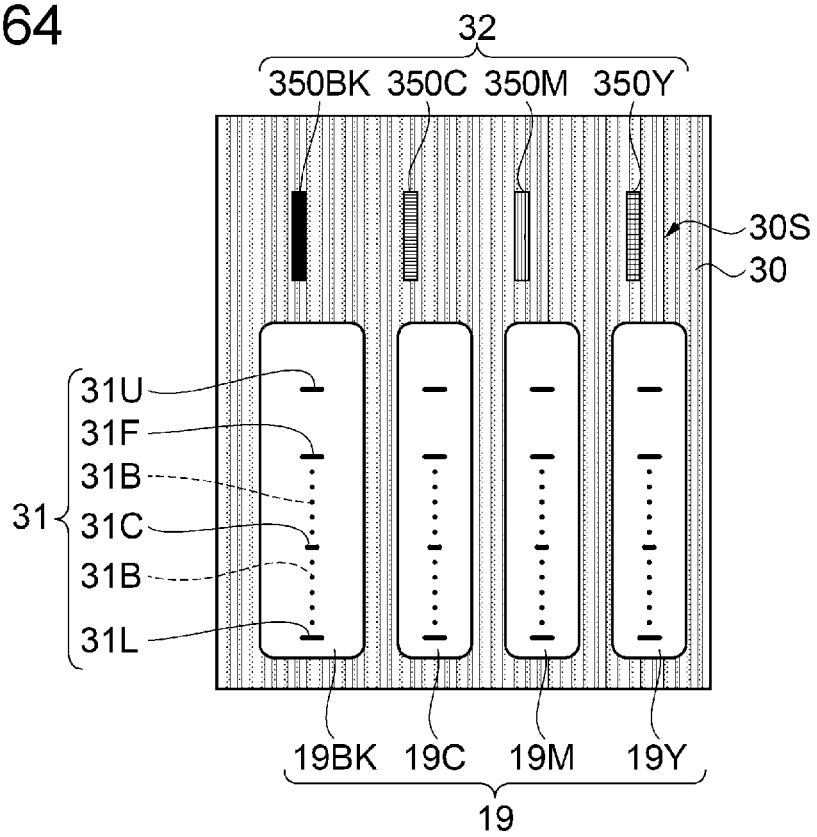
FIG. 64 is a front view illustrating light transmitting portions, gradations, and reference marks according to Example 54.

Light transmitting portions, gradations, and reference marks according to Example 54 will be described with reference to FIG. 64. In Example 54, as illustrated in FIG. 64, the reference mark 32 which is provided in the outer edge portion 30 and includes vertical line marks 350BK, 350C, 350M, and 350Y illustrated by vertically long lines colored by the colors that correspond to the types of the ink, and the gradation 31 including the upper limit gradation 31U, the upper gradation 31F and the like which are illustrated by horizontally long solid lines provided in the light transmitting window portions 19BK, 19C, 19M, and 19Y, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided. In addition, in the outer edge portion 30, a stripe pattern having a shape of a vertical stripe is provided.

The light transmitting window portions 19BK, 19C, 19M, and 19Y which configure the light transmitting portion 19 according to Example 54 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y include, for example, the upper limit gradation 31U, the upper gradation 31F, and the lower limit gradation 31L which are illustrated by horizontally long solid lines, the intermediate gradation 31C which is positioned between the upper gradation 31F and the lower limit gradation 31L and is illustrated by a horizontally long solid line which is slightly shorter than the upper gradation 31F, and the subdivided gradation 31B illustrated by a plurality of dots between the intermediate gradation 31C and each of the upper gradation 31F and the lower limit gradation 31L. In addition, the upper limit gradation 31U, the upper gradation 31F, the lower limit gradation 31L, the intermediate gradation 31C, and the subdivided gradation 31B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21. The reference mark 32 includes vertical line marks 350BK, 350C, 350M, and 350Y having a shape of a vertically long line which are positioned above each of the light transmitting window portions 19BK, 19C, 19M, and 19Y, and are colored by the colors that correspond to the types of the ink. Specifically, the reference mark 32 includes, for example, the vertical line mark 350BK colored by the black-based color to indicate the black ink, the vertical line mark 350C colored by the blue-based color to indicate the cyan ink, the vertical line mark 350M colored by the red-based color to indicate the magenta ink, and the vertical line mark 350Y colored by the yellow-based color to indicate the yellow ink. In addition, the vertical line marks 350BK, 350C, 350M, and 350Y are arranged to be horizontally aligned.

5.55. Example 55

Figure 65:
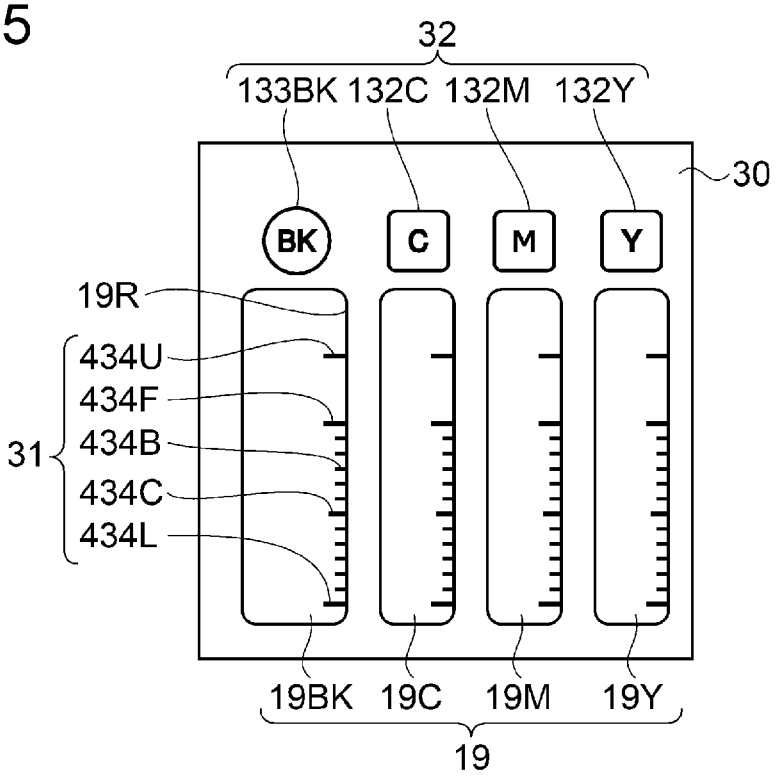
FIG. 65 is a front view illustrating light transmitting portions, gradations, and reference marks according to Example 55.

Light transmitting portions, gradations, and reference marks according to Example 55 will be described with reference to FIG. 65. In Example 55, as illustrated in FIG. 65, the reference mark 32 which is provided in the outer edge portion 30 and includes the mark 133BK provided with "BK" in the outlined circular frame, the mark 132C provided with "C" in the outlined □, and the like, and the gradation 31 including an upper limit gradation 434U, an upper gradation 434F and the like which are illustrated by horizontally long solid lines provided along one horizontal frame 19R of the light transmitting window portions 19BK, 19C, 19M, and 19Y. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided.

The light transmitting window portions 19BK, 19C, 19M, and 19Y which configure the light transmitting portion 19 according to Example 55 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y are provided along one horizontal frame 19R of each of the light transmitting window portions 19BK, 19C, 19M, and 19Y. The gradation 31 includes the upper limit gradation 434U, the upper gradation 434F, and a lower limit gradation 434L which are illustrated by horizontally long solid lines of which one end is connected to the horizontal frame 19R, an intermediate gradation 434C illustrated by a horizontally long solid line which is slightly shorter than the upper gradation 434F of which one end is connected to the horizontal frame 19R between the upper gradation 434F and the lower limit gradation 434L, and a subdivided gradation 434B of which one end is connected to the horizontal frame 19R between the upper gradation 434F and the lower limit gradation 434L and is illustrated by a horizontally long solid line that is slightly shorter than the intermediate gradation 434C. In addition, the upper limit gradation 434U, the upper gradation 434F, the lower limit gradation 434L, the intermediate gradation 434C, and the subdivided gradation 434B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21, and include, for example, a mark 132BK of "BK in the outlined circular frame" that indicates the black ink, the mark 132C of "C in the outlined □" that indicates the cyan ink, the mark 132M of "M in the outlined □" that indicates the magenta ink, and the mark 132Y of "Y in the outlined □" that indicates the yellow ink. In addition, the marks 132BK, 132C, 132M, and 132Y may be any color tone, such as individual colors which correspond to each of the ink colors, unified black color, or an outlined character.

5.56. Example 56

Figure 66:
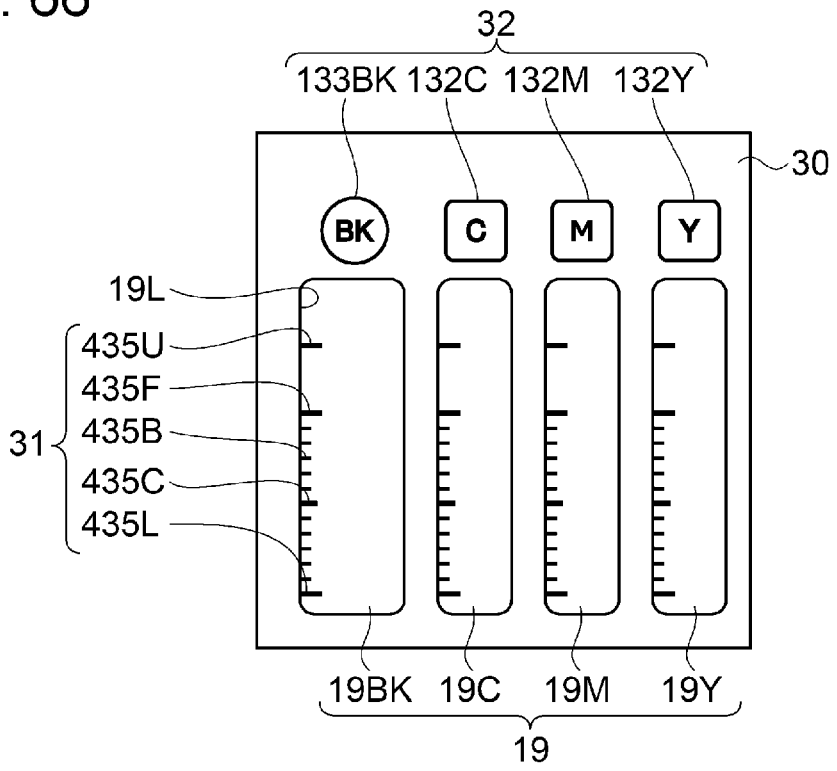
FIG. 66 is a front view illustrating light transmitting portions, gradations, and reference marks according to Example 56.

Light transmitting portions, gradations, and reference marks according to Example 56 will be described with reference to FIG. 66. In Example 56, as illustrated in FIG. 66, the reference mark 32 disposed in the outer edge portion 30 similar to the above-described Example 55, and the gradation 31 including an upper limit gradation 435U, an upper gradation 435F and the like which are illustrated by horizontally long solid lines provided along the horizontal frame 19L other than the light transmitting window portions 19BK, 19C, 19M, and 19Y. In addition, since the light transmitting window portions 19BK, 19C, 19M, and 19Y and the reference mark 32 of the example are similar to those of Example 55, the description thereof will be omitted.

The gradations 31 provided in each of the light transmitting window portions 19BK, 19C, 19M, and 19Y are provided along the horizontal frame 19L other than each of the light transmitting window portions 19BK, 19C, 19M, and 19Y. The gradation 31 includes the upper limit gradation 435U, the upper gradation 435F, and a lower limit gradation 435L which are illustrated by horizontally long solid lines of which one end is connected to the horizontal frame 19L, an intermediate gradation 435C illustrated by a horizontally long solid line which is slightly shorter than the upper gradation 435F of which one end is connected to the horizontal frame 19L between the upper gradation 435F and the lower limit gradation 435L, and a subdivided gradation 435B of which one end is connected to the horizontal frame 19L between the upper gradation 435F and the lower limit gradation 435L and is illustrated by a horizontally long solid line that is slightly shorter than the intermediate gradation 435C. In addition, the upper limit gradation 435U, the upper gradation 435F, the lower limit gradation 435L, the intermediate gradation 435C, and the subdivided gradation 435B which configure the gradation 31, may be a color tone, such as individual colors which correspond to each of the ink colors, unified black color, or an outlined character.

5.57. Example 57

Figure 67:
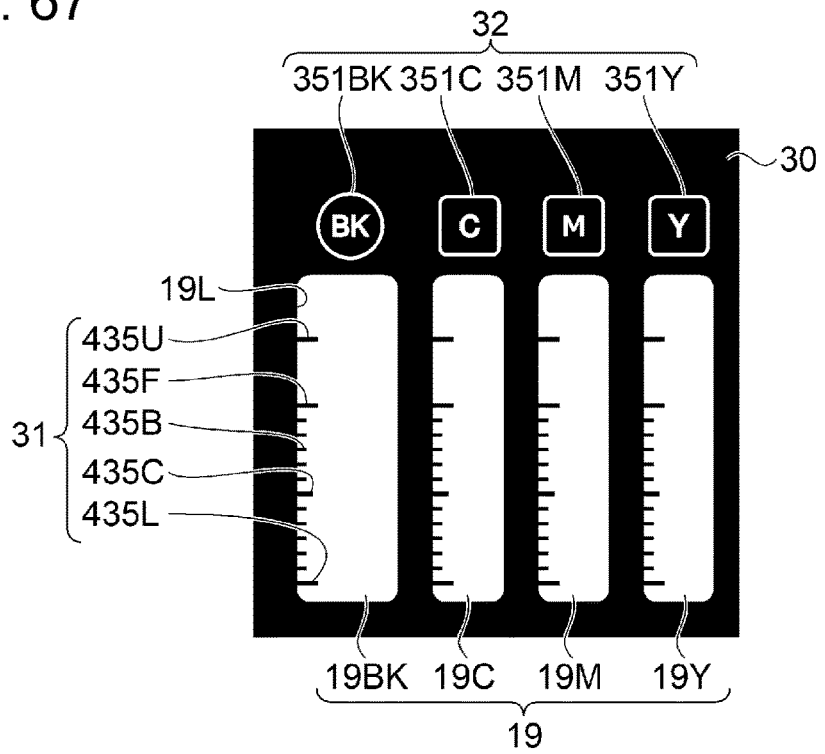
FIG. 67 is a front view illustrating light transmitting portions, gradations, and reference marks according to Example 57.

Light transmitting portions, gradations, and reference marks according to Example 57 will be described with reference to FIG. 67. Example 57 is a black and white inverted design example of Example 56 described with reference FIG. 66. As illustrated in FIG. 67, the reference mark 32 which is disposed in the outer edge portion 30 and includes mark 351BK provided with "outlined character BK" on the black background in a white circular frame, a mark 351C provided with "outlined character C" on the black background in a white quadrangular frame and the like, and the gradation 31 including the upper limit gradation 435U, the upper gradation 435F and the like illustrated by horizontally long solid lines provided along the horizontal frame 19L other than the light transmitting window portions 19BK, 19C, 19M, and 19Y. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein. In addition, on the outer side of the light transmitting window portions 19BK, 19C, 19M, and 19Y, the outer edge portion 30 is provided, and is colored by the black-based color.

The light transmitting window portions 19BK, 19C, 19M, and 19Y which configure the light transmitting portion 19 according to Example 57 have light transmission properties, and have a substantially rectangular shape which is vertically long from the upper side to the lower side. In addition, four corners of the light transmitting window portions 19BK, 19C, 19M, and 19Y having a substantially rectangular shape are rounded in an arc shape. In addition, the light transmitting window portion 19BK is configured such that the horizontal width thereof is wider than those of other light transmitting window portions 19C, 19M, and 19Y.

The gradations 31 provided in each of the light transmitting window portions 19BK, 19C, 19M, and 19Y are provided along the horizontal frame 19L other than each of the light transmitting window portions 19BK, 19C, 19M, and 19Y. The gradation 31 includes the upper limit gradation 435U, the upper gradation 435F, and the lower limit gradation 435L which are illustrated by horizontally long solid lines of which one end is connected to the horizontal frame 19L, the intermediate gradation 435C illustrated by a horizontally long solid line which is slightly shorter than the upper gradation 435F of which one end is connected to the horizontal frame 19L between the upper gradation 435F and the lower limit gradation 435L, and the subdivided gradation 435B of which one end is connected to the horizontal frame 19L between the upper gradation 435F and the lower limit gradation 435L and is illustrated by a horizontally long solid line that is slightly shorter than the intermediate gradation 435C. In addition, the upper limit gradation 435U, the upper gradation 435F, the lower limit gradation 435L, the intermediate gradation 435C, and the subdivided gradation 435B which configure the gradation 31, may be a color tone, such as individual colors which correspond to each of the ink colors, unified black color, or an outlined character.

The reference marks 32 provided in the outer edge portion 30 above the light transmitting window portions 19BK, 19C, 19M, and 19Y illustrate the types of the ink accommodated in each of the four tanks 21, and include, for example, the mark 351BK provided with "outlined character BK" on the black background in the white circular frame to indicate the black ink, the mark 351C provided with "outlined character C" on the black background in the white quadrangular frame to indicate the cyan ink, the mark 351M provided with "outlined character M" on the black background in the white quadrangular frame to indicate the magenta ink, and the mark 351Y provided with "outlined character Y" on the black background in the white quadrangular frame to indicate the yellow ink. In addition, the marks 351BK, 351C, 351M, and 351Y may be any color tone, such as individual colors which correspond to each of the ink colors, unified black color, or an outlined character.

In addition, the black and white inverted design described in Example 57 can also be employed in design described in other examples or embodiments.

5.58. Example 58

Figure 68:
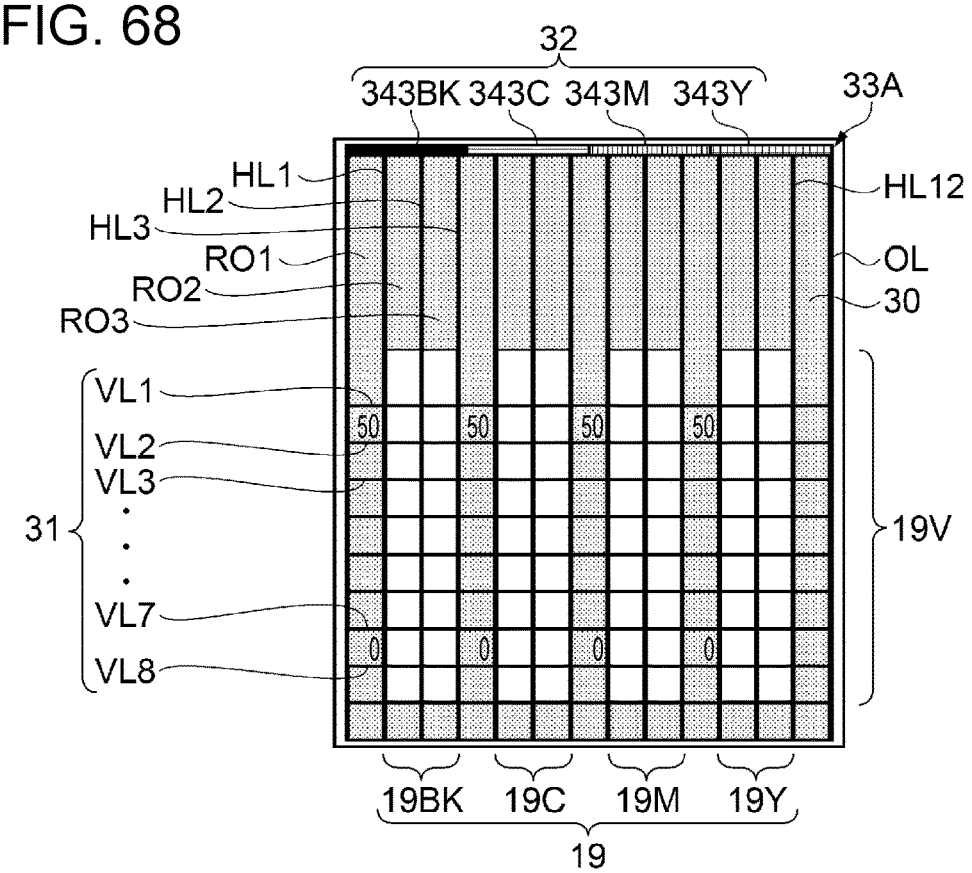
FIG. 68 is a front view illustrating light transmitting portions, gradations, and reference marks according to Example 58.

Light transmitting portions, gradations, and reference marks according to Example 58 will be described with reference to FIG. 68. In the light transmitting portion, the gradations, and the reference marks according to Example 58, as illustrated in FIG. 68, the reference mark 32 including the color line 33A is provided in the end portion above the outer edge portion 30, and small windows divided in a shape of a lattice by vertical lines HL1, HL2, HL3, . . . , and HL12 and horizontal lines VL1, VL2, VL3, . . . and VL8 which penetrate the outer edge portion 30 other than the disposition portions of the light transmitting window portions 19BK, 19C, 19M, and 19Y and the color line 33A, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein.

In Example 58, as illustrated in FIG. 68, one light transmitting window portion region is configured of three rows including a first row RO1, a second row RO2, and a third row RO3 that are aligned from the left side in the drawing, a outlined portion 19V illustrated in the drawing of the second row RO2 and the third row RO3 corresponds to the light transmitting window portion 19BK, and the first row RO1 corresponds to a gradation recording portion of the light transmitting window portion 19BK. Similarly, the light transmitting window portion 19C, the light transmitting window portion 19M, and the light transmitting window portion 19Y are configured in rows following a fourth row.

The light transmitting window portions 19BK, 19C, 19M, and 19Y according to Example 58 have light transmission properties, and are divided into a shape of a lattice by the vertical lines HL1, HL2, HL3, . . . , and HL12 and the horizontal lines VL1, VL2, VL3, . . . and VL8. In each of the gradation recording portions adjacent to the light transmitting window portions 19BK, 19C, 19M, and 19Y, numbers, such as "50" and "0", which become a standard of the residual amount of the ink are written.

The outer edge portion 30 is provided on the outer side of the light transmitting window portions 19BK, 19C, 19M, and 19Y, and is a region illustrated by hatching in FIG. 68. In addition, an outer circumferential frame OL is provided at an outer circumferential edge of the outer edge portion 30. The outer edge portion 30 is configured as a region having non-light transmission properties or low light transmittance by coating the surface with the coloring coating material, by attaching the coloring film, or by performing emboss (wrinkle) processing.

The reference mark 32 includes the color line 33A provided in the end portion above the outer edge portion 30. The color line 33A is positioned on the upper side that correspond to the row of the light transmitting window portions 19BK, 19C, 19M, and 19Y, and includes the color mark 343BK, the color mark 343C, the color mark 343M, and the color mark 343Y which divide the reference mark 32 in a horizontally long rectangular shape that goes across the outer edge portion 30. The color marks 343BK, 343C, 343M, and 343Y are colored by the colors that correspond to the light transmitting window portions 19BK, 19C, 19M, and 19Y. Specifically, the color mark 343BK corresponds to the light transmitting window portion 19BK, and is colored by the black-based color that indicates the black ink. The color mark 343C corresponds to the light transmitting window portion 19C, and is colored by the blue-based color that indicates the cyan ink. The color mark 343M corresponds to the light transmitting window portion 19M, and is colored by the red-based color that indicates the magenta ink. The color mark 343Y corresponds to the light transmitting window portion 19Y, and is colored by the yellow-based color that indicates the yellow ink.

5.59. Example 59

Figure 69:
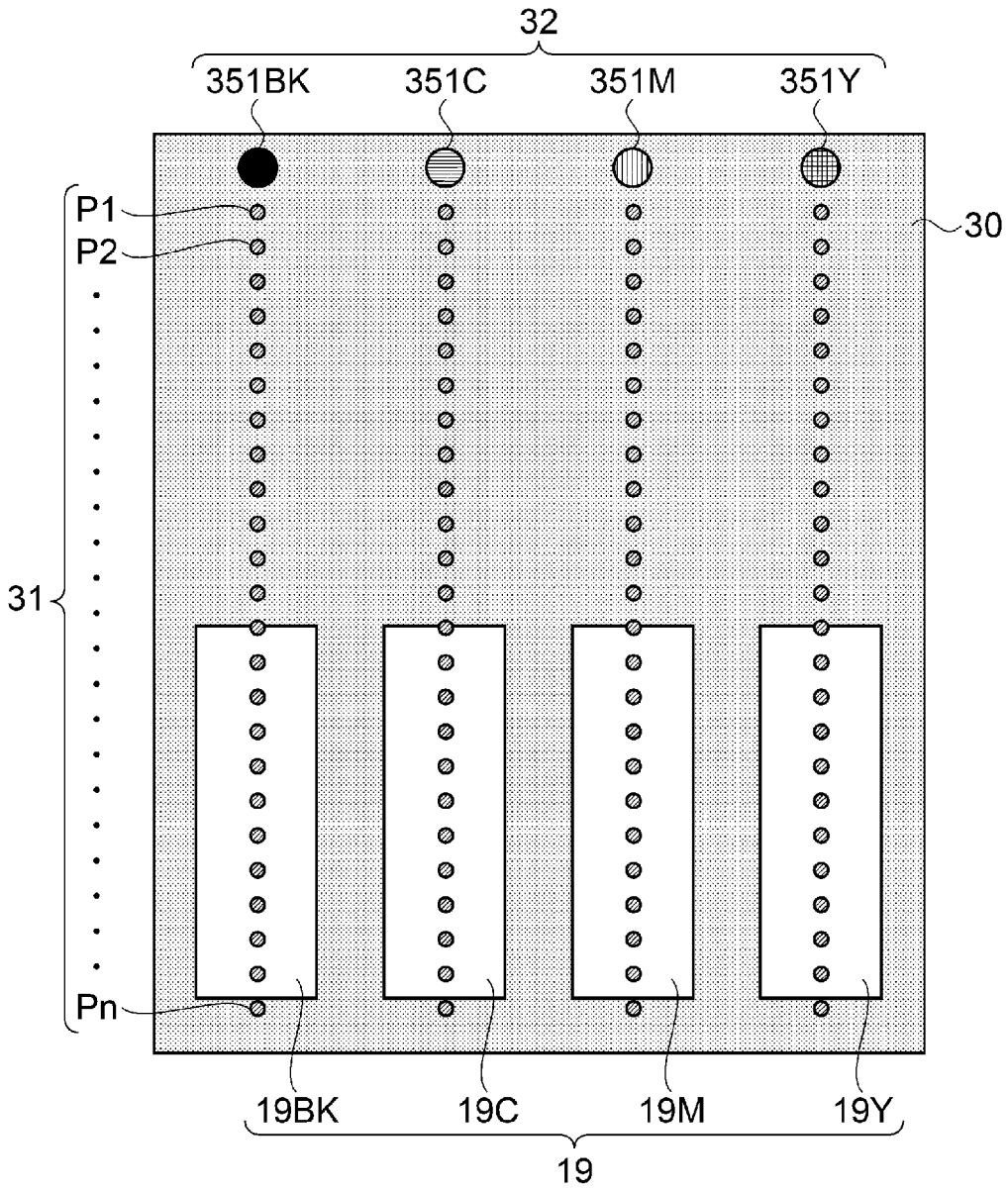
FIG. 69 is a front view illustrating light transmitting portions, gradations, and reference marks according to Example 59.

Light transmitting portions, gradations, and reference marks according to Example 59 will be described with reference to FIG. 69. In the light transmitting portion, the gradations, and the reference marks according to Example 59, as illustrated in FIG. 69, the reference mark 32 which is on the inner side of the end above the outer edge portion 30, and in which the marks 351BK, 351C, 351M, and 351Y in which the inside of circular frame lines is colored by the colors that correspond to the types of the ink are arranged to be horizontally aligned, and dots P1 to Pn which are continuously disposed from each of the marks 351BK, 351C, 351M, and 351Y to the position that exceeds the light transmitting window portions 19BK, 19C, 19M, and 19Y that configure the light transmitting portion 19, are provided. In addition, in the example, the light transmitting window portion 19BK, the light transmitting window portion 19C, the light transmitting window portion 19M, and the light transmitting window portion 19Y, oppose the tanks 21 (refer to FIG. 4) which respectively accommodate the black ink, the cyan ink, the magenta ink, and the yellow ink therein.

The light transmitting window portions 19BK, 19C, 19M, and 19Y which configure the light transmitting portion 19 according to Example 59 have light transmission properties, and have a substantially rectangular shape which is vertically long from the upper side to the lower side. The outer edge portion 30 is a region which is provided on the outer side of the light transmitting window portions 19BK, 19C, 19M, and 19Y, and is illustrated by hatching in FIG. 69. The outer edge portion 30 is configured as a region having non-light transmission properties or low light transmittance by coating the surface with the coloring coating material, by attaching the coloring film, or by performing emboss (wrinkle) processing.

The reference marks 32 provided in the outer edge portion 30 above the light transmitting window portions 19BK, 19C, 19M, and 19Y illustrate the types of the ink accommodated in each of the four tanks 21. The reference mark 32 includes the mark 351BK in which the inside of the circular frame line that indicates the black ink is colored by the black-based color, the mark 351C in which the inside of the circular frame line that indicates the cyan ink is colored by the blue-based color, the mark 351M in which the inside of the circular frame line that indicates the magenta ink is colored by the red-based color, and the mark 351Y in which the inside of the circular frame line that indicates the yellow ink is colored by the yellow-based color. In addition, the reference mark 32 in which four marks 351BK, 351C, 351M, and 351Y are arranged to be horizontally aligned, is configured.

Below each of the marks 351BK, 351C, 351M, and 351Y, the dots P1 to Pn which are continuously disposed to the position which exceeds each of the light transmitting window portions 19BK, 19C, 19M, and 19Y that configure the light transmitting portion 19, are provided. In other words, the marks 351BK, 351C, 351M, and 351Y and the light transmitting window portions 19BK, 19C, 19M, and 19Y that correspond thereto are connected to each other by the dots P1 to Pn. In addition, the color of the dots P1 to Pn does not matter.

5.60. Example 60

Light transmitting portions, gradations, and reference marks according to Example 60 will be described with reference to FIG. 70. In the light transmitting portion, the gradations, and the reference marks according to Example 60, as illustrated in FIG. 70, the reference mark 32 which is on the inner side of the end above the outer edge portion 30, and in which the marks 352BK, 352C, 352M, and 352Y in which the inside of horizontally long belt-like frame (rectangular shape) is colored by the colors that correspond to the types of the ink are arranged to be horizontally aligned, and horizontal bars L1 to Ln which are continuously disposed from below each of the marks 352BK, 352C, 352M, and 352Y to the position that exceeds the light transmitting window portions 19BK, 19C, 19M, and 19Y that configure the light transmitting portion 19, are provided. In addition, in the example, the light transmitting window portion 19BK, the light transmitting window portion 19C, the light transmitting window portion 19M, and the light transmitting window portion 19Y, oppose the tanks 21 (refer to FIG. 4)

which respectively accommodate the black ink, the cyan ink, the magenta ink, and the yellow ink therein.

The light transmitting window portions 19BK, 19C, 19M, and 19Y which configure the light transmitting portion 19 according to Example 60 have light transmission properties, and have a substantially rectangular shape which is vertically long from the upper side to the lower side. The outer edge portion 30 is a region which is provided on the outer side of the light transmitting window portions 19BK, 19C, 19M, and 19Y, and is illustrated by hatching in FIG. 70. The outer edge portion 30 is configured as a region having non-light transmission properties or low light transmittance by coating the surface with the coloring coating material, by attaching the coloring film, or by performing emboss (wrinkle) processing.

The reference marks 32 provided in the outer edge portion 30 above the light transmitting window portions 19BK, 19C, 19M, and 19Y illustrate the types of the ink accommodated in each of the four tanks 21. The reference mark 32 includes the mark 352BK in which the inside of the horizontally long belt-like frame (rectangular shape) that indicates the black ink is colored by the black-based color, the mark 352C in which the inside of the horizontally long belt-like frame (rectangular shape) that indicates the cyan ink is colored by the blue-based color, the mark 352M in which the inside of the horizontally long belt-like frame (rectangular shape) that indicates the magenta ink is colored by the red-based color, and the mark 352Y in which the inside of the horizontally long belt-like frame (rectangular shape) that indicates the yellow ink is colored by the yellow-based color. In addition, the reference mark 32 in which four marks 352BK, 352C, 352M, and 352Y are arranged to be horizontally aligned, is configured.

Below each of the marks 352BK, 352C, 352M, and 352Y, the horizontal bars L1 to Ln which are continuously disposed to the position which exceeds each of the light transmitting window portions 19BK, 19C, 19M, and 19Y that configure the light transmitting portion 19, are provided. In other words, the marks 352BK, 352C, 352M, and 352Y and the light transmitting window portions 19BK, 19C, 19M, and 19Y that correspond thereto are connected to each other by the horizontal bars L1 to Ln. In addition, the color of the horizontal bars L1 to Ln does not matter.

As described in Example 59 and Example 60, as the reference mark 32 disposed in the outer edge portion 30 is connected to the light transmitting portion 19 by the dots P1 to Pn or the horizontal bars L1 to Ln, the connection between the type of the ink and the amount of the ink becomes apparent, and visibility of the user can be improved.

Above, each of the embodiments and each of the examples according to the invention are described, but the types, the order of the color, and the position of the ink may change. In addition, the gradations and the reference marks may be formed by using a method of printing or marking.

In addition, the invention is not limited to the above-described embodiments and examples, and the can be realized by various configurations within a range that does not depart from the spirit of the invention. For example, the technical characteristics in the embodiments and the examples that correspond to the technical characteristics in each of the aspects described in the field of the summary of the invention, can be appropriately replaced or combined with each other in order to solve a part or the entirety of the above-described problem or in order to achieve a part or the entirety of the above-described effects. In addition, the technical characteristics can be appropriately removed if it is described that the technical characteristics are not necessary characteristics in the specification.

The entire disclosure of Japanese Patent Application No. 2017-003131, filed Jan. 12, 2017 is expressly incorporated by reference herein.

What is claimed is:

1. A droplet ejecting apparatus comprising:

a tank which is configured of at least a part having light transmission property; and a cover portion which forms a portion of the outer surface of the droplet ejecting apparatus and covers the tank;

the cover portion comprising a light transmitting portion through which liquid accommodated on the inside of the tank can be visually confirmed, wherein at least one of gradations and reference marks is provided on the light transmitting portion, wherein at least one printed character is provided on an outer portion of the droplet ejecting apparatus and is located proximately to the at least one of the gradations and reference marks, the at least one printed character being a character corresponding to an ink color of the tank such that the at least one printed character provides an externally visible indication of the tank's ink color, wherein an outer edge portion including an outline arranged along an outer edge of the light transmitting portion is provided on an outer circumferential side of the light transmitting portion, and wherein the reference marks are disposed in the outer edge portion, and connects the light transmitting portion and at least one of the outline and the gradations to each other.

2. The droplet ejecting apparatus according to claim 1, wherein the gradations are provided corresponding to an amount of the liquid, and wherein the reference marks are provided corresponding to the types of the liquid.

3. The droplet ejecting apparatus according to claim 1, wherein the light transmitting portion is configured of a structure integrated with the cover portion.

4. The droplet ejecting apparatus according to claim 1, wherein the light transmitting portion includes a through-hole provided at a part of a wall surface of the cover portion, and a light transmitting plate which covers the through-hole.

5. The droplet ejecting apparatus according to claim 1, further comprising:

a housing which holds the tank, wherein the cover portion is supported to be openable and closable by the housing.

6. The droplet ejecting apparatus according to claim 1, wherein the tank has a filling port through which the tank can be filled with the liquid.

7. The droplet ejecting apparatus according to claim 1, wherein at least a part of the light transmitting portion protrudes from an outer surface of the cover portion.

8. The droplet ejecting apparatus according to claim 1, wherein the outer edge portion is colored.

9. The droplet ejecting apparatus according to claim 1, wherein the outer edge portion is emboss-processed.

10. The droplet ejecting apparatus according to claim 1, wherein at least any one of the gradations and the reference marks is provided on a transparent sheet, and wherein the transparent sheet is attached to the light transmitting portion.

11. The droplet ejecting apparatus according to claim 1, wherein the gradations are disposed in the outer edge portion.

12. The droplet ejecting apparatus according to claim 1, wherein the gradations are configured to include at least one of a point and a line.

13. The droplet ejecting apparatus according to claim 12, wherein the line includes at least one of a solid line and a dotted line.

14. The droplet ejecting apparatus according to claim 12, wherein the residual amount of the liquid is divided by changing at least one of the shape, color, and shades of the color of the point and the line.

15. A droplet ejecting apparatus comprising:

a tank which is configured of at least a part having light transmission property; and a cover portion which forms a portion of the outer surface of the droplet ejecting apparatus and covers the tank;

the cover portion comprising a light transmitting portion through which liquid accommodated on the inside of the tank can be visually confirmed, wherein at least one of gradations and reference marks is provided on the light transmitting portion, wherein at least a part of the light transmitting portion protrudes from an outer surface of the cover portion, wherein an outer edge portion including an outline arranged along an outer edge of the light transmitting portion is provided on an outer circumferential side of the light transmitting portion, and wherein the reference marks are disposed in the outer edge portion, and connects the light transmitting portion and at least one of the outline and the gradations to each other.

16. A droplet ejecting apparatus comprising:

a tank which is configured of at least a part having light transmission property; and a cover portion which forms a portion of the outer surface of the droplet ejecting apparatus and covers the tank;

the cover portion comprising a light transmitting portion through which liquid accommodated on the inside of the tank can be visually confirmed, wherein at least one of gradations and reference marks is provided on the light transmitting portion, wherein the at least one of the gradations and the reference marks is provided on a transparent sheet, and wherein the transparent sheet is attached to the light transmitting portion, wherein an outer edge portion including an outline arranged along an outer edge of the light transmitting portion is provided on an outer circumferential side of the light transmitting portion, and wherein the reference marks are disposed in the outer edge portion, and connects the light transmitting portion and at least one of the outline and the gradations to each other.

* * * * *